United States Patent [19]

Zalesov et al.

[11] 3,934,126

[45] Jan. 20, 1976

[54] CONTROL DEVICE FOR A DRAGLINE EXCAVATOR

[76] Inventors: Oleg Alexandrovich Zalesov, Festivalnaya ulitsa, 7, kv. 134; Mikhail Sergeevich Lomakin, ulitsa Tkatskaya, 33/35, kv. 20; Vadim Nikolaevich Merkulov, Chernomorsky bulvar, 17, korpus 1, kv. 53; Leonid Davidovich Pevzner, ulitsa Udaltsova, 4, kv. 468; Gugo Borisovich Peters, Mosfilmovskaya ulitsa, 43/40, kv. 107; Vladimir Dmitrievich Potapov, Svobodny prospekt, 14-5, kv. 150; Vladimir Vasilievich Rzhevsky, Mosfilmovskaya ulitsa, 17-25, kv. 196; Lev Ivanovich Tolpezhnikov, Bolshaya Cheremushkinskaya ulitsa, 12, kv. 10; Anatoly Danilovich Yarizov, Starokonjushenny pereulok, 33, kv. 26, all of Moscow; Viktor Modestovich Mamkin, pereulok Druzhby, 6, kv. 60, Sverdlovsk; Veniamin Lvovich Raskin, ulitsa Khmeleva, 10, kv. 21, Sverdlovsk; Boris Ivanovich Satovsky, prospekt Ordzhonikidze, 3, kv. 77, Sverdlovsk; Grigory Matveevich Yartsev, pereulok Druzhby, 6, kv. 60, Sverdlovsk, all of U.S.S.R.

[22] Filed: Sept. 23, 1974

[21] Appl. No.: 508,183

Related U.S. Application Data

[63] Continuation of Ser. No. 429,700, Dec. 28, 1973, abandoned.

[52] U.S. Cl. ..... 235/150.2; 37/DIG. 1; 235/151

[51] Int. Cl.[2] ..... E02F 3/46; G06G 7/48

[58] Field of Search..... 235/151, 151.1, 150.2; 37/116, DIG. 1; 212/39 R; 214/135; 340/267 C

[56] References Cited

UNITED STATES PATENTS

| | | | |
|---|---|---|---|
| 3,460,278 | 8/1969 | Pesavento et al. | 37/116 |
| 3,636,325 | 1/1972 | Chytil | 235/151 |
| 3,638,211 | 1/1972 | Sanchez | 340/267 C |

*Primary Examiner*—Joseph F. Ruggiero
*Attorney, Agent, or Firm*—Holman & Stern

[57] ABSTRACT

A control device for a dragline excavator, comprising hoist and drag rope length increment transducers and revolving platform swing angle transducers responding to the movement of a bucket from its breakout point on the face to the dumping point and from the dumping point to the point where the bucket is lowered onto the face, speed transducers for the bucket hoisting and dragging and revolving platform swinging mechanism, as well as a bucket transportation time calculator and speed setters for the bucket hoisting and dragging and platform swinging mechanisms, associated with said transducers. The device of the invention determines bucket travel times by measuring the hoist and drag rope length increments and the swing angle of the platform, in the presence of limitations on the speeds and accelerations, and then calculates and plots velocity diagrams for the bucket hoisting and dragging and platform swinging mechanisms.

75 Claims, 17 Drawing Figures

CONTROL DEVICE FOR A DRAGLINE EXCAVATOR

This is a continuation of application Ser. No. 429,700, filed Dec. 28, 1973, now abandoned.

BACKGROUND OF THE INVENTION

The present invention relates to control devices for mining machinery, and more particularly to a control device for a dragline excavator. It may be employed for automating such operations as transportion of the loaded bucket from its breakout point to the dumping point, further transportation of the emptied bucket from the dumping point to the point where it is lowered on the face, as well as digging at open-cast mines.

DESCRIPTION OF THE PRIOR ART

It is known in the dragline excavator control art to employ a device operating on the principle of determining the time of bucket travel from its breakout point on the face to its dumping point and then computing and plotting the velocity diagrams of the mechanisms hoisting and dragging the bucket and swinging the platform. The time of bucket transportation is calculated by the hoist and drag rope length increments as well as by the swing angle of the dragline platform, in the presence of limitations on the rates and accelerations of motion.

The known device incorporates a unit for determining the time of transportation of the bucket from the breakout point on the face to the dumping point, which unit comprises three adders for determining the minimal times of program execution by the bucket hoisting and dragging and platform swinging mechanisms, respectively. To the inputs of the adders is fed information on the hoist and drag rope length increments and on the swing angle of the dragline platform while the bucket is transported from its breakout point on the face to its dumping point, as well as on the rates of motion of the bucket hoisting and dragging and platform swinging mechanisms, respectively. The outputs of the adders are coupled via a maximum signal selector to the input of a memory storage element formed as an integrator operating either as an initial conditons setter or as a storage unit.

The known device comprises a unit setting the speed of the hoisting mechanism. This unit is built around two strings of computing elements, one of which determines the instant at which the hoisting mechanism stops accelerating, while the other determines the instant at which the mechanism starts decelerating. The outputs of these two circuits are connected to the control circuits of two gates provided at the input of the integrator whose output is proportional to the predetermined speed of the bucket hoisting mechanism. The speed setters for the bucket dragging and platform swinging mechanisms may be similarly structured.

The known device does not take into account such operations as the transportation of the bucket from the dumping point to the point where it is lowered on the face, automatic breakout of the bucket from the face according to a predetermined program, steering of the loaded bucket clear of the spontaneous-dumping zone as the bucket from the breakout point on the face to the dumping point, dumping of the bucket at a predetermined height and in a minimum of time, lowering of the bucket in such paths as to rule out drag rope slackening, adjustment of the platform swinging mechanism accelerations depending on the steady speed thereof, variation of the acceleration time of the platform swinging mechanism depending on the initial length of the pendulum (bifilarly suspended bucket), and the determination of the initial instant of deceleration of the platform swinging mechanism allowing for the current horizontal deflection and speed of the swinging bucket. Furthermore, the known device fails to provide for a 360-degree mode of operation of the dragline excavator, for automatic variation of tension of the hoist rope while digging, or for the protection of the dragline mechanism by preventing the bucket from getting dangerously close to the boom axis or to the hoist and drag rope pulleys.

OBJECTS OF THE INVENTION

It is an object of the present invention to provide automatic operation of the dragline excavator as the bucket is transported from the dumping point to the point where it is lowered on the face or face-contact point.

Another object of the invention is to provide an automatic breakout of the bucket from the face according to a predetermined program. Still another object of the invention is to provide the passage of the loaded bucket clear of the spontaneous-dumping zone as it is transported from the breakout point on the face to the dumping point.

Yet another object of the invention is to provide for the dumping of the bucket at a predetermined height and in a minimum of time.

A further object of the invention is to provide for the lowering of the bucket along paths so as to eliminate such as would rule drag rope slackening.

A still further object of the invention is to minimize the dynamic load exerted by the swinging bucket on the dragline boom by adjusting the platform swinging mechanism acceleration time depending on the initial length of the pendulum (bifilarly suspended bucket).

It is also an object of the invention to provide for the determination of the initial instant of platform swinging mechanism deceleration with an allowance being made for the current horizontal deflection and speed of the swinging bucket.

One more object of the invention is to provide for automatic 360° operation of the dragline excavator.

It is likewise an object of the invention to provide for automatic variation of the drag rope tension during the digging operation.

Moreover, an object of the invention is to protect the dragline excavator mechanisms by preventing the bucket from approaching dangerously close to the boom axis and to the hoist and drag rope pulleys.

SUMMARY OF THE INVENTION

The invention contemplates providing a control device for a dragline excavator which would provide for automatic operation of the dragline excavator while the bucket is transported from the dumping point to the face-contact point, for partial automation of the digging process, automatic breakout and transportation of the bucket to the dumping point along such paths as would rule out untimely dumping of the bucket and prevent it from approaching dangerously close to the boon axis and to the drag and hoist rope pulleys, and would also provide for the execution of automatic operations in a minimum of time.

Accordingly, there is provided a control device for a dragline excavator which determines the time of transportation of the bucket from the breakout point on the face to the dumping point by measuring the hoist and drag rope length increments and the swing angle of the dragline excavator platform taking into account limitations on the speeds and accelerations of the bucket hoisting and dragging and platform swinging mechanisms. On the basis of the bucket transportation time thus found, the control device computes and plots the velocity diagrams of the bucket hoisting and dragging and platform swinging mechanisms, which, in accordance with the invention, comprises hoist and drag rope length increment transducers and a platform swing angle transducer operating as the bucket is transported from the breakout point on the face to the dumping point, hoist and drag rope length increment transducers and a platform swing angle transducer operating as the bucket is transported from the dumping point to the face-contact point, bucket hoisting and dragging and platform swing mechanisms speed transducers, all of said transducers being connected to their respective mechanisms, a bucket transportation time calculator with the inputs thereof connected to the outputs of the hoist and drag rope length increment transducers and to the outputs of the platform swing angle transducers which operate as the bucket is transported from the breakout point on the face to the dumping point and back from the dumping point to the face-contact point, as well as to the outputs of the bucket hoisting and dragging mechanism speed transducers and bucket hoisting and dragging and platform swinging mechanism speed setters, each of which has one input thereof connected to the output of the bucket transportation time calculator, the other inputs of the hoisting mechanism speed setter having connected thereto the output of the transducer responsive to the hoist rope length increments as the bucket is transported from the breakout point to the dumping point, the output of the transducer responsive to the hoist rope length increments as the bucket is transported from the dumping point to the face-contact point, and the output of the hoisting mechanism speed setter is connected to the speed control unit of the latter mentioned mechanism, and the other inputs of the dragging mechanism speed transducer. The output of the hoisting mechanism speed setter is connected to the speed control unit of the latter mechanism, and the other inputs of the dragging mechanism speed setter have connected thereto the outputs of the transducers responsive to the drag and hoist rope length increments as the bucket is transported from the breakout point on the face to the dumping point, the outputs of the transducers responsive to the drag and hoist rope length increments as the bucket is transported from the dumping point to the face-contact point, the output of an element for manual setting of the dragging mechanism speed and the output of the hoisting mechanism speed setter, while the output of the dragging mechanism speed setter is connected to the speed control unit of the latter mentioned mechanism, and the other inputs of the platform swing mechanism speed setter have connected thereto the output of the swing angle transducer sensing the swing of the platform as the bucket is transported from the breakout point on the face to the dumping point, the output of the angle transducer sensing the swing of the platform as the bucket is transported from the dumping point to the face-contact point and the output of the platform swing speed transducer, while the output of the platform swinging mechanism speed setter is connected to the speed control unit of the latter mentioned mechanism.

It is preferable to connect the outputs of the speed transducers of the hoisting, dragging and swinging mechanisms respectively to one of the inputs of each speed control unit of the hoisting, dragging and swinging mechanisms, to connect via a gate the second input of the swinging mechanism speed control unit to the output of the swing mechanism manual speed setting element and to the speed setter of this mechanism, and to connect the second input of the speed control unit of the dragging mechanism to the output of a first OR circuit, whereof one of the inputs should be preferably coupled via a gate to the manual element setting the dragging mechanism speed and to the output of the speed setter of that mechanism. The device may also comprise a hoist rope tension transducer, a hoist rope tension setting circuit and a hoist rope tension controller, the inputs of which are connected to the outputs of the tension transducer and the tension setting circuit, while the output of the tension controller may be connected via a gate, coupled to the output of the hoisting mechanism speed setter, to the input of a second OR circuit, whereof the output may be connected to the input of the hoisting mechanism speed control unit.

The device of this invention may also comprise a transducer of the hoist rope length at the point of bucket dumping, a transducer of the overall length of the hoist and drag ropes, a transducer of the angular deflection of the bucket in a horizontal plane, and also protection means for the hoisting and dragging mechanisms of the dragline excavator.

The bucket transportation time calculator as well as the speed setters of the hoisting and dragging mechanisms and of the platform swing mechanism may be composed of adders, integrators, inverters and relays as well as multiplying and dividing circuits, squarers, threshold and inverting elements.

The device may likewise comprise a protection unit of an electromechanical type for program speed setting of the bucket dragging mechanism.

BRIEF DESCRIPTION OF THE DRAWINGS

A specific embodiment of the present invention will now be described, by way of example, with reference to the accompanying drawings, in which.

DETAILED DESCRIPTION OF THE PREFERRED EMBODIMENTS

Figure 1:
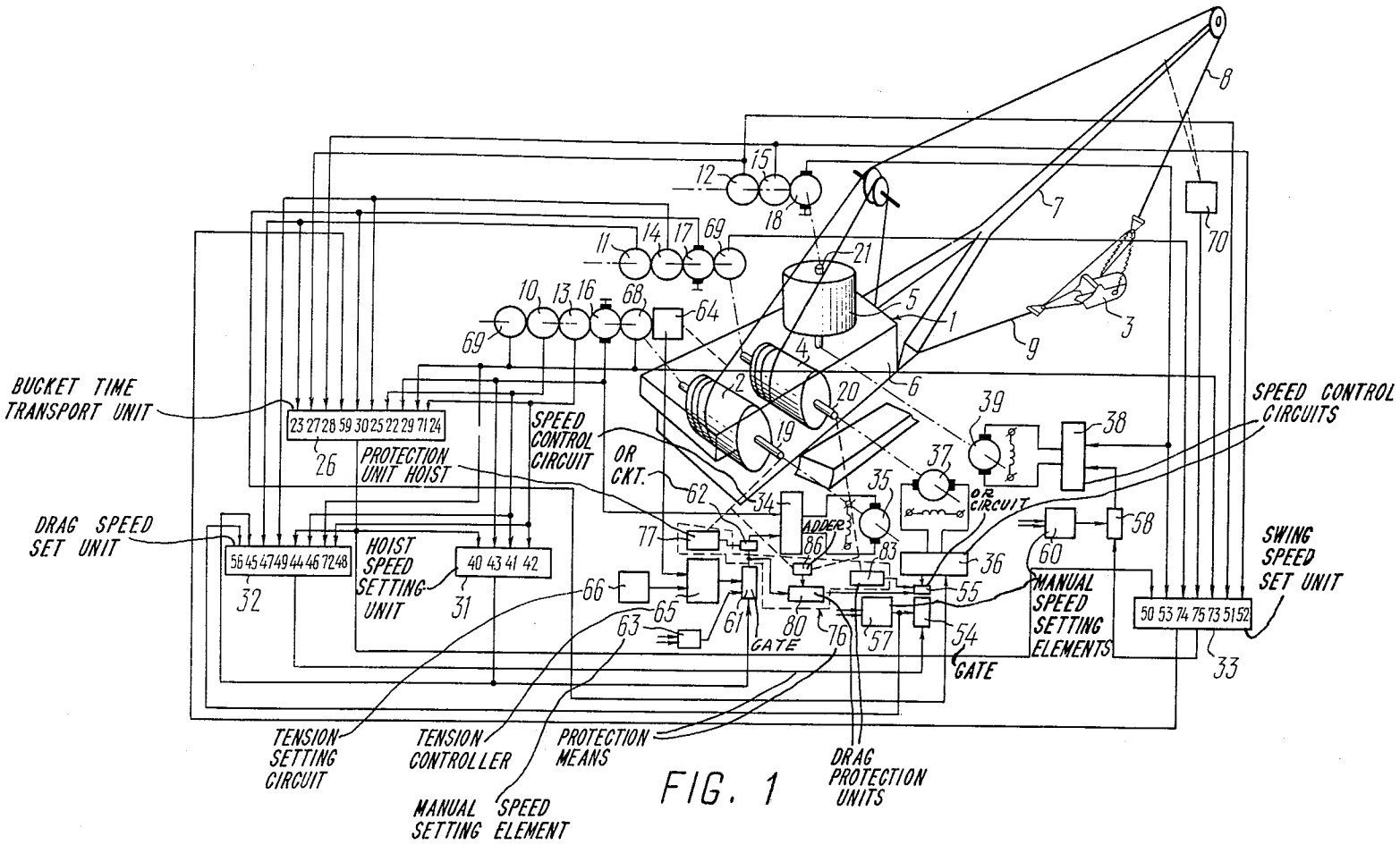
FIG. 1 is a block diagram of a control device for a dragline excavator, in accordance with the invention.

Referring now to FIG. 1, it will be seen to schematically illustrate a dragline excavator 1 with a mechanism 2 hoisting a bucket 3, a mechanism 4 dragging the bucket 3, a swing mechanism 5 which swings a platform 6 of the dragline excavator 1, a boom 7, a hoist rope 8 and a drag rope 9. The proposed control device for the dragline excavator 1 comprises transducers 10 and 11 for sensing the length increments of the hoist and drag ropes 8 and 9, respectively, and also a transducer 12 for sensing the angle of swing of the platform 6 as the bucket 3 is transported from the breakout point on the face to the dumping point, as well as transducers 13 and 14 for sensing the length increments of the hoist and drag ropes 8 and 9, respectively, and also a transducer 15 for sensing the angle of swing of the platform 6 as the bucket 3 is transported from the dumping point to the point where it is lowered on the face or face-contact point.

In order to measure the speed of the mechanisms of the dragline excavator 1, there is mounted on the platform 6 a transducer 16 for sensing the speed of the mechanism 2 hoisting the bucket 3, a transducer 17 for sensing the speed of the mechanism 4 dragging the bucket 3 and a transducer 18 for sensing the speed of the mechanism 5 swinging the platform 6 of the excavator 1. All the transducers from 10 to 18 inclusive are connected with the respective shafts 19, 20 and 21 of the mechanisms 2, 4 and 5.

The outputs of the transducers 10, 11, 13 and 14 for sensing the length increments of the hoist and drag ropes are connected to inputs 22, 23, 24 and 25 of a unit 26 for calculating the time of transportation of the bucket 3. The outputs of the transducers 12 and 15 for sensing the swing angle of the platform 6 are connected to inputs 27 and 28 of unit 26, with the outputs of the transducers 16 and 17 for sensing the speeds of the mechanisms 2 and 4 hoisting and dragging the bucket 3 being connected to inputs 29 and 30 of the same unit 26.

The proposed control device for the dragline excavator 1 also comprises a unit 31 for setting the speed of the bucket hoisting mechanism 2, a unit 32 for setting the speed of the bucket dragging mechanism 4, a unit 33 for setting the speed of the platform swing mechanism 5 and three speed control units for the mechanisms 2, 4 and 5. The speed control unit of the hoisting mechanism 2 incorporates a speed control circuit 34 governing the rotation of an electric motor 35, the speed control unit of the dragging mechanism 4 incorporates a speed control circuit 36 governing the rotation of an electric motor 37, and the speed control unit of the swing mechanism 5 incorporates a speed control circuit 38 governing the rotation of an electric motor 39.

The unit 31 has its outputs 40, 41, 42 and 43 respectively connected to the output of the unit 26 and to the outputs of the transducers 10, 13 and 16. The unit 32 has its inputs 44, 45, 46, 47, 48 and 49 respectively connected to the outputs of the units 26 and 31 and to the outputs of the transducers 10, 11, 13 and 14. The unit 33 has its inputs 50, 51, 52 and 53 likewise connected to the output of the unit 26 and to the outputs of the transducers 12, 15 and 18, respectively. The output of the unit 32 is coupled via a gate 54 and an OR circuit 55 to the input of the speed control circuit 36, the other input of the gate 54 together with input 56 of the unit 32 having coupled thereto the output of a manual speed setting element 57 which sets the speed of the mechanism 4 dragging the bucket 3. The output of the transducer 17 is coupled to the second input of the circuit 36.

One of the outputs of the unit 33 is coupled via a gate 58 to the input of the speed control circuit 38, while the other output of the unit 33 is coupled to input 59 of the unit 26, the other input of the gate 58 having coupled thereto the output of a manual speed setting element 60 which sets the speed of the swing mechanism 5 of the platform 6. The transducer 18 is coupled to the second input of the speed control circuit 38.

The output of the unit 31 is coupled via a gate 61 and an OR circuit 62 to an input of the circuit 34. The output of a manual speed setting element 63 of the mechanism 2 hoisting the bucket 3 is coupled to a second input of the gate 61, while the output of the transducer 16 is coupled to a second input of the circuit 34.

To provide for the possibility of adjusting the tension of the hoisting rope during the process of digging, the proposed device comprises a transducer 64 for sensing the tension of the hoist rope 8, a tension controller 65 for the hoist rope 8 and a tension setting circuit 66 for the hoist rope 8, the output of the transducer 64 being connected to one of the inputs of the controller 65, whereof the other input is connected to the circuit 66 while the output of the controller 65 is connected to a third input of the gate 61.

The proposed device also comprises a transducer 67 for sensing the length of the hoist rope 8 at the dumping point of the bucket 3, a transducer 68 for sensing the overall length of the hoist rope 8, a transducer 69 for sensing the overall length of the drag rope 9 and a transducer 70 for sensing the angular deflection of the bucket 3 in a horizontal plane.

The transducers 67 and 68 are coupled to the shaft 19 of the hoisting mechanism 2 and the transducer 69 is coupled to the shaft 20 of the dragging mechanism 4. The output of the transducer 67 is connected to input 71 of the unit 26 and to input 72 of the unit 32, whereas the outputs of the transducers 68 to 70 inclusive are connected to respective inputs 73, 74 and 75 of the unit 33.

Figure 2:
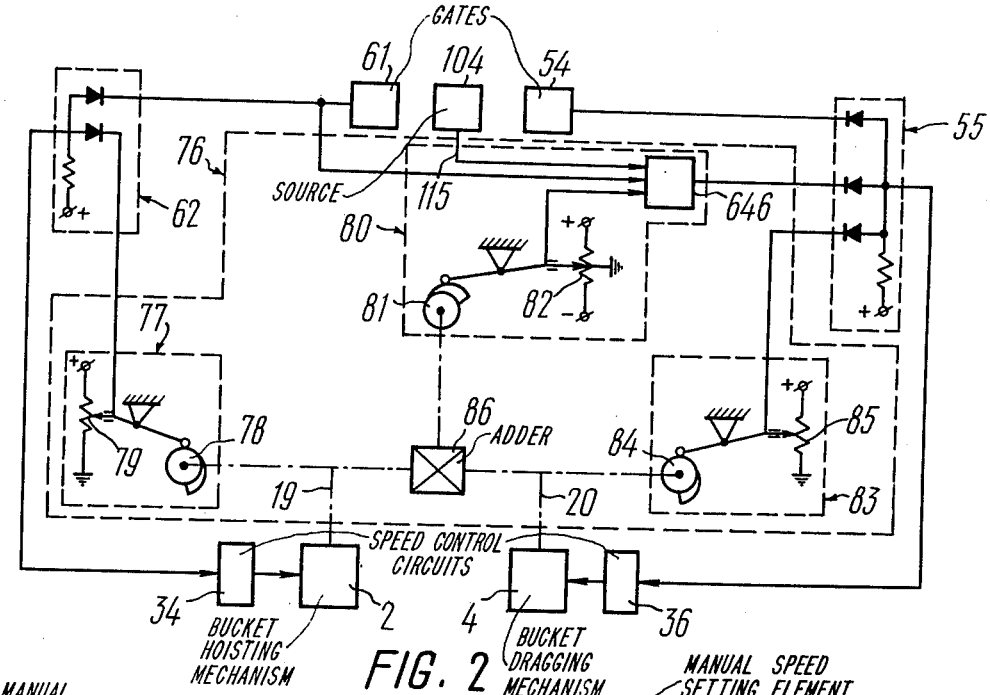
FIG. 2 is a schematic diagram of protection means for the dragline excavator mechanisms, in accordance with the invention.

For emergency protection of the working equipment of the dragline excavator 1, the device of this invention comprises protection means 76, illustrated in FIG. 2, which limits the minimal allowable length of the hoist rope 8 and the minimal allowable length of the drag rope 9 and also prevents the bucket 3 from entering the dangerous strut zone. In its turn, the means 76 comprises a protection unit 77 of program speed setting for the bucket hoisting mechanism 2 with a cam mechanism 78 and a potentiometer 79, a protection unit 80 of program speed setting for the bucket dragging mechanism 4 with a cam mechanism 81 and a potentiometer 82, a second protection unit 83 of program speed setting for the bucket dragging mechanism 4 with a cam mechanism 84 and a potentiometer 85, and a mechanical adder 86.

The input of the protection unit 77 is mechanically coupled with the shaft 19 of the mechanism 2, while its output is electrically connected to a second input of the OR circuit 62. The input of the protection unit 80 is mechanically coupled to the adder 86, while its output is electrically connected to a second input of the OR circuit 55. The input of the protection unit 83 is mechanically coupled with the shaft 20 of the mechanism 4, while its output is electrically connected to a third input of the OR circuit 55. The adder 86 is coupled by way of its inputs to the shafts 19 and 20 of the mechanisms 2 and 4, respectively.

The unit 26 of FIG. 1 which calculates the transportation time of the bucket 3 comprises an adder 87 (FIG. 3) for calculating the minimal possible operating time of the hoisting mechanism 2, an adder 88 for calculating the minimal possible operating time of the dragging mechanism 4, and an adder 89 for calculating the minimal possible operating time of the mechanism 5 swinging the platform 6. Selection of the maximum of the three values calculated by the adders 87, 88 and 89 is accomplished by a maximum value selection circuit 90 built around parallel-placed diodes 91, 92, 93 and 94, so that the diode 92 is connected to the output of the adder 87, the diode 93 at the output of the adder 88 and the diode 94 at the output of the adder 89.

The calculator 26 also comprises a circuit 95 forming a bucket transportation time signal, which circuit is built around two parallel-coupled integrators 96 and 97.

Two groups 101 and 102 of parallel-placed input resistors are connected to summing point 98 of the adder 87 via contacts 99 of a relay 100, with a negative bus 103 of a reference voltage source 104, the output of the transducer 10, the output of the transducer 16 and one of the outputs of the unit 31 (FIG. 1) via a varistor 105 (FIG. 3) being respectively coupled to the resistors of the group 101, whereas the resistor group 102 is connected to the negative bus 103 of the source 104 and the output of the transducer 13.

Two groups 108 and 109 of parallel-placed input resistors are connected to summing point 106 of the adder 88 via contacts 107 of the relay 100, the group 108 being connected to the negative bus 103 of the source 104, the output of the transducer 11 and the output of the transducer 67, respectively, whereas the group 109 is connected to the negative bus 103 of the source 104, the output of the transducer 14, the output of the transducer 17 and one of the outputs of the unit 32, respectively, the connection of the latter being effected via a varistor 110.

The varistors 105 and 110 should be treated hereinafter as accomplishsing a quadratic relationship between the input and output voltages.

To a common point 111 of the resistors of the group 109, are connected in series diode 112 and two parallel-placed resistors 113 and 114, the resistor 113 being connected to the output of the transducer 11, while the resistor 114 is connected to a positive bus 115 of the source 104.

Two groups 118 and 119 of parallel-placed input resistors are coupled via contacts 117 of the relay 100 to summing point 116 of the adder 89. Resistor 120 of the group 118 is connected to the output of the transducer 12, resistor 121 of the group 118 is connected to one of the outputs of the unit 33 (FIG. 1), resistor 122 (FIG. 3) of the group 118 is coupled via a contact 123 to the negative bus 103 of the source 104. Resistor 124 of the group 119 is connected to the output of the transducer 15, resistor 125 of the group 119 is coupled via a contact 126 to one of the outputs of the unit 33 (FIG. 1), and resistor 127 (FIG. 3) of the group 119 is connected to the negative bus 103 of the source 104.

In order to limit the minimal allowable values of bucket transportation time, there are two Zener diodes 129 and 130 coupled to the diode 91 via contacts 128 of the relay 100. The voltages on cathodes 131 and 132 of the Zener diodes 129 and 130, respectively, correspond to the minimal allowable times of bucket transportation from the breakout point on the face to the dumping point (the voltage on the cathode 131) and back from the dumping point to the face-contact point (the voltage on the cathode 132). The cathodes 131 and 132 of the Zener diodes 129 and 130 are coupled via respective resistors 133 and 134 to the positive bus of the source 104.

The integrator 96 of the signal-shaping circuit 95 comprises a diode 135 which prevents a positive signal from being produced at the output of the integrator 96 and a capacitor 136, the diode 135 and the capacitor 136 being connected in parallel into the feedback circuit of the integrator 96. To make the integrator 96 follow-up the output signal of the circuit 90, there is a resistor 137 connected in parallel with the capacitor 136, which resistor is connected to zero point 138 of the integrator 96 via contacts 139 of a relay incorporated in the dragging mechanism speed setter 32. A resistor 140 connected to the output of the circuit 90 is also coupled to the zero point 138 of the integrator 96 via the contacts 139. In order to provide for the operation of the integrator 96 in an integrating mode, a resistor 141 connected to the negative bus 103 of the source 104 is coupled to the zero point 138 via the contacts 139.

The integrator 97 is similarly built in that its feedback circuit includes, in parallel, a diode 142, a capacitor 143 and a resistor 146, the latter coupled via contacts 144 of a relay 145. The integrator 97 has its zero point 147 connected to the output of the circuit 90 via the contacts 144 and a resistor 148 and with the negative bus 103 of the source 104 via a resistor 149 and the contacts 144 of the relay 145.

The relay 100 is designed to switch the adders 87, 88 and 89, using the contacts 99, 107, 117 and 128, from calculating the minimal possible times of displacement of the bucket hoisting and dragging and platform swing mechanisms, respectively, when the bucket 3 (FIG. 1) is transported from the breakout point to the dumping point, to calculating the analogous values when the bucket 3 is transported from the dumping point to the face-contact point, and vice versa.

Control circuit 150 (FIG. 3) of the relay 100 is connected to the output of an OR circuit 151 built around parallel-placed diodes 152 and 153, two outputs of the unit 31 (FIG. 1) being connected to the inputs of the OR circuit 151.

The output of an inverter 154 (FIG. 3) serves as the output of the transportation time calculator. The input128 of the inverter 154 is coupled via contacts 155 of the relay 145 to the outputs of the integrators 96 and 97 of the shaper 95. With the help of its contacts 144 the relay 145 transfers the integrator 97 from the input signal follow-up mode to an integrating mode and vice versa, and with the help of its contacts 155 the relay 145 connects the outputs of the integrators 96 and 97 to the input of the inverter 154. Control circuit 156 of the relay 145 is coupled through a diode 157 and contacts 158 to one of the outputs of the unit 33 (FIG. 1) and of the unit 31.

Figure 3:
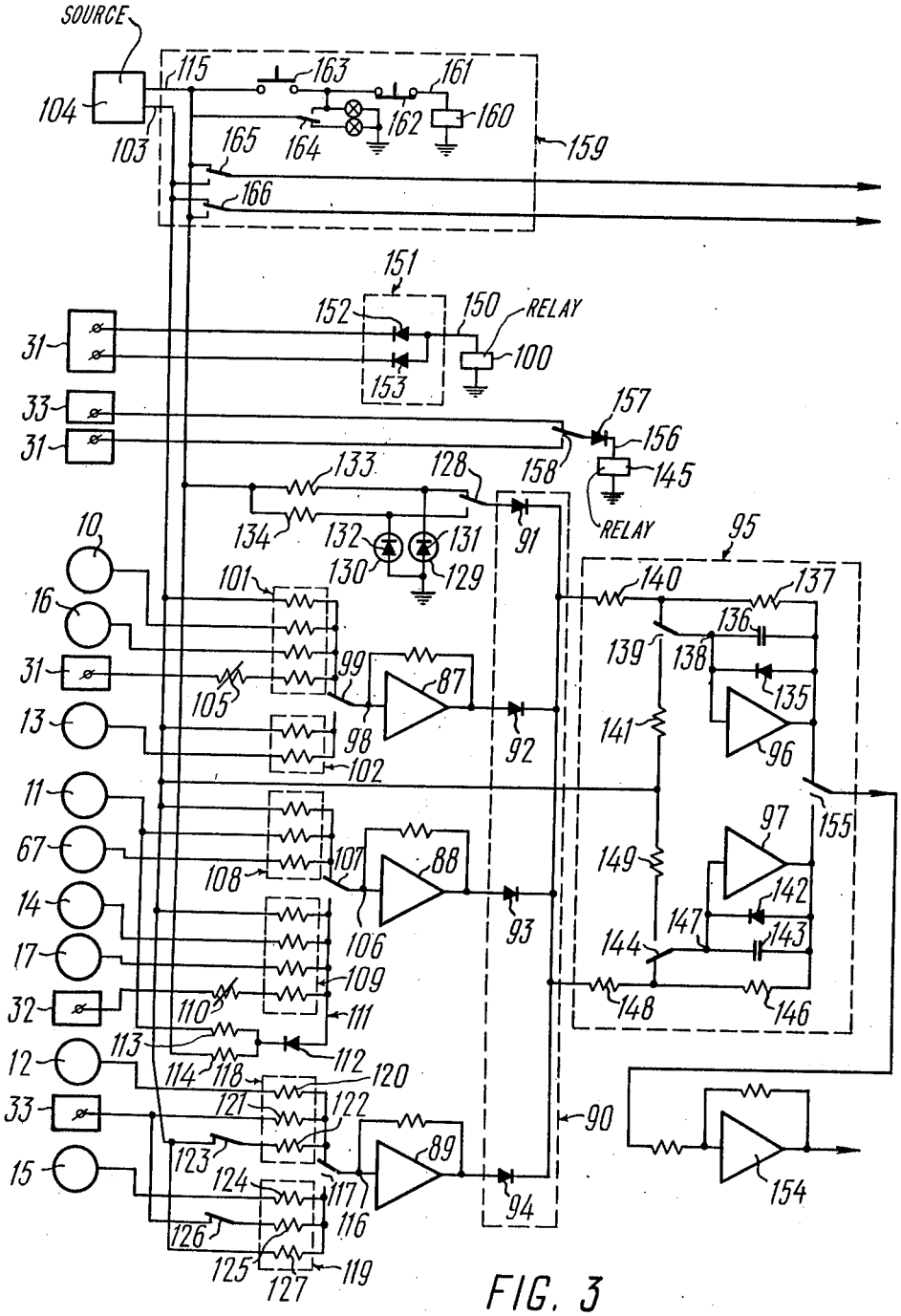
FIG. 3 is a block diagram of a bucket transportation time calculator, in accordance with the invention.

FIG. 3 will also be seen to illustrate starting circuit 159 of the unit 26, comprising a relay 160 whereof a control circuit 161 is coupled to the positive bus 115 of the source 104 via series-connected pushbuttons 162 and 163, contacts 164 of the relay 160, which block the pushbutton 163 as it is depressed by the operator, being connected in parallel with the push-button 163.

Contacts 165 and 166 of the relay 160 connect the buses 103 and 115 of the source 104 with the dragging mechanism speed setter 32 (FIG. 1).

The speed setter 31 (FIG. 1) of the mechanism 2 hoisting the bucket 3 incorporates a hoisting mechanism steady speed determining circuit 167 (FIG. 4), a circuit 168 for determining the instant the hoisting mechanism starts decelerating, a circuit 169 for determining the sense of rotation of the hoisting mechanism, a logic circuit 170 and a shaper 171 forming a predetermined speed signal of the hoisting mechanism.

The shaper 171 comprises an integrator 172 and a resistor 175 coupled in parallel to a capacitor 173 of the integrator 172 via contacts 174. There is a resistor 177 connected to the output of the transducer 16, which resistor is coupled to zero point 176 of the integrator 172 via the same contacts 174, whereby the integrator 172 can follow up the output signal of the transducer 16.

An inverter 178 is connected in series with the integrator 172, with two diodes 179 and 180 poled in opposition being connected in parallel with the inverter 178. Common point 181 of the diodes 179 and 180 produces a signal proportional to the negative modulus of the preset speed value.

The common point 181 is connected to the varistor 105 (FIG. 3). The output of the logic circuit 170 is connected to an input resistor 182 (FIG. 4) of the integrator 172.

The circuit 167 comprises an adder 183, of which an input resistor 184 is connected to the output of the inverter 154 (FIG. 3) and of which input resistors 185 and 186 (FIG. 4) are coupled via contacts 187 of a relay 188 to the common point 181 of the diodes 179 and 180. A multiplier 189 is connected in series with the adder 183, the other input of the multiplier 189 being connected to the common point 181, and the output of the multiplier 189 is connected to an input resistor 190 of a threshold element 191. Input resistor 192 of the threshold element 191 is coupled through contacts 193 of a relay 194 to the outputs of the transducers 10 and 13. At the output of the threshold element 191 there is included an inverting element made as a relay with two windings 195 and 196. The example considered uses a conventional relay, for the output voltage of the threshold element 191 changes in a step from a certain positive value to a certain negative value and vice versa. This relay, of which a contact 197 switches the negative and positive buses 103 and 115 of the source 104, helps shape a signal whose polarity is reversed with respect to the polarity of the threshold element 191.

The winding 195 is coupled to the output of the threshold element 191 through a diode 198, the contact 197 being coupled via a diode 199 to an input resistor 200 of the threshold element 191, whereby the element 191 is blocked after it has operated. Input resistor 201 is coupled through a diode 202 to one of the outputs of the unit 32 (FIG. 1).

The circuit 168 (FIG. 4) comprises a squarer 203, a threshold element 204 and an inverting element similar to the one included in the circuit 167, which inverting element is made as a relay with two control windings 205 and 206. The input of the squarer 203 is connected to the common point 181, while its output is connected via contacts 207 of the relay 188 to input resistors 208 and 209 of the threshold element 204. Input resistor 210 of the threshold element 204 is coupled via the contacts 193 of the relay 194 to the outputs of the transducers 10 and 13. Input resistor 211 is coupled via a diode 212 to one of the outputs of the unit 32 (FIG. 1) The relay coil 205 (FIG. 4) is coupled via a diode 213 to the output of the threshold element 204. Contact 214 of the output relay of the threshold element 204 is coupled via a diode 215 to input resistor 216 of the threshold element 204, which arrangement ensures that the threshold element 204, which arrangement ensures that the element 204 is blocked after it has operated.

The circuit 169 comprises a threshold element 217 and an inverting element made similarly to the one described hereabove, as the relay 188. Input resistor 218 of the element 217 is connected to the output of the integrator 172. The coil of the relay 188 is coupled via a diode 219 to the output of the threshold element 217, contact 220 of the relay 188 being coupled to input resistor 222 of the threshold element 217 via a diode 221. Input resistor 223 has connected thereto a gate 224 comprising diodes 225, 226 and 227 and a resistor 228, the latter being connected to the positive bus 115 of the source 104. The output of the threshold element 204 and the contact 220 of the relay 188 are connected to the inputs of the OR circuit 151 (FIG. 3).

The diode 225 (FIG. 4) is connected to the movable contact 220, while the diode 226 is connected to the output of the threshold element 204. The gate 224 fixed the threshold element 217 in its initial state irrespective of the sign of the initial conditions in respect of the hoisting mechanism speed.

The logic circuit 170 comprises gates 229, 230, 231 and 232, interconnected in parallel. The gate 229 is built around diodes 233, 234, 235 and 236 and a resistor 237, the latter being connected to the negative bus 103 of the source 104. The anodes of the diodes 233, 234 and 235 are connected to one of the outputs of the unit 32 (FIG. 1), to the movable contact 197 (FIG. 4) and to the output of the threshold element 217, respectively. The gate 230 is built around diodes 238, 239 and 240 and a resistor 241, the latter being connected to the positive bus 115 of the source 104. The cathodes of the diodes 238 and 239 are connected to the movable contact 214 and to the movable contact 220, respectively. The gate 231 is built around diodes 242, 243, 244 and 245 and a resistor 246, the latter being connected to the positive bus 115 of the source 104. The cathodes of the diodes 242, 243 and 244 are respectively coupled to the output of the threshold element 191, to the output of the threshold element 217 and via a contact 247 to one of the outputs of the unit 33 (FIG. 1). The gate 232 (FIG. 4) is built around diodes 248, 249 and 250 and a resistor 251, the latter being connected to the negative bus 103 of the source 104. The anodes of the diodes 248 and 249 are respectively connected to the output of the threshold element 204 and to the movable contact 220. Electric circuit 252 of the windings 196 and 206 is connected to the output of the threshold element 217 via a diode 253, a resistor 254 and a capacitor 255, the latter two being interconnected in parallel.

Control circuit 256 of the relay 194 is coupled via diodes 257 and 258 to the contact 220 and to the output of the threshold element 204, respectively.

In order to prevent the output signal of the integrator 172 from being transferred to the positive region at the end of the automatic cycle, the feedback circuit of the integrator 172 includes, in series a diode 259 and a contact 260 of a relay 261, of which a control circuit 262 is connected to the contact 214, while a control circuit 263 of the relay 261 is coupled via a diode 264 and a resistor 265 to the contact 220.

The unit 32 (FIG. 1), which sets the speed of the dragging mechanism of the bucket 3, comprises a circuit 266 (FIG. 5) for determining the steady speed of the dragging mechanism, a circuit 267 for determining the instant at which the dragging mechanism starts decelerating, a circuit 268 for determining the sense of rotation of the dragging mechanism, a starting circuit 269, a circuit 270 for retarding the speed of the dragging mechanism, a circuit 271 for accelerating the dragging mechanism speed in bucket dumping, a circuit 272 for determining whether or not the dragging mechanism maneuvers to rule out the slackening of the drag rope 9 (FIG. 1) as the bucket 3 is transported from the dumping point to the point it is lowered on the face. In addition, the unit 32 comprises a logical circuit 273 (FIG. 5) and a shaper 274 for forming a predetermined dragging mechanism speed signal.

The shaper 274 comprises an integrator 275 and a resistor 278 (FIG. 5) coupled via contacts 277 of the relay 160 (FIG. 3) in parallel with a capacitor 276 of the integrator 275. These same contacts 277 serve to connect zero point 279 of the integrator 275 with a resistor 280 coupled to the output of a maximum signal selector 281 built around diodes 282 and 283. The anode of the diode 282 is connected to the output of the manual speed setting element 58 (FIG. 1) of the mechanism 4, whereas the anode of the diode 283 (FIG. 5) has connected thereto the output of a reference voltage source 284, the source being connected with the positive bus 115 of the source 104. The reference voltage source is formed as a Zener diode 285 and a resistor 286.

The feedback circuit of the integrator 275 includes a diode limiter, built around a resistor 287 and a diode 288, and a resistor 289 connected through a gate circuit comprising a resistor 290 and diodes 291, 292 and 293. An inverter 294 is connected in series with the integrator 275, and two diodes 295 and 296 interconnected in opposition are connected in parallel with the inverter 294, the common point 297 of the diodes 295 and 296 generating a signal which is proportional to the negative modulus of the predetermined speed value. The output of the logic circuit 273 is coupled to an input resistor 298 of the integrator 275.

The circuit 266 comprises an adder 299, of which an input resistor 300 is connected to the output of the inverter 154 (FIG. 3) of the unit 26, while an input resistor 301 (FIG. 5) of the adder 299 is connected to the common point 297 of the diodes 295 and 296. A multiplier 302 is connected in series with the adder 299, the other inputs of the multiplier 302 being coupled via contacts 303 to the outputs of the integrator 275 and the inverter 294, while the output of the multiplier 302 is connected to an input resistor 304 of a threshold element 305. Zero point 306 of the threshold element 305 is coupled via a commutator in the form of contacts 307 of a relay 308 to a resistor 309 and to common point 310 of resistors 311 and 312. The resistor 309 is connected to common point 313 of diodes 314 and 315 connected in parallel with an inverter 316, whereof the input is connected to the output of the transducer 14. The common point 313 produces a signal proportional to the negative modulus of the output signal of the transducer 14.

The resistors 311 and 312 are respectively connected to the output of the transducer 67 and to the output of the transducer 11. An inverting element formed as a relay with two control windings 317 and 318 is connected to the output of the threshold element 305.

The movable contact of this relay is arranged intermediate the positive bus 115 and the negative bus 103 of the source 104. As the relay operates, the movable contact connects one of the outputs of the circuit 266 either to the positive bus 115 or to the negative bus 103, thereby producing at this output a signal of reversed polarity with respect to the signal generated by the threshold element 305. The output of the threshold element 305 serves as a second output of the circuit 266.

The control winding 317 is coupled to the output of the threshold element 305 via a diode 319, and a contact 320 is connected via a diode 321 to an input resistor 322 of the threshold element 305, thereby providing for the blocking of the element 305 after it has operated.

The circuit 267 comprises a squarer 323, a threshold element 324 and an inverting element formed, similarly with the ones described hereabove, as a relay with two control windings 325 and 326. The input of the squarer 323 is connected to the common point 297 of the diodes 295 and 296, while its output is connected to an input resistor 327 of the threshold element 324. Input resistor 328 of the element 324 is coupled via contacts 329 of the relay 308 to the output of the transducer 11 and to the common point 313 of the diodes 314 and 315. The relay winding 325 is coupled via a diode 330 to the output of the threshold element 324, and a contact 331 thereof is coupled via a diode 332 to an input resistor 333 of the threshold element 324, thereby providing for the blocking of the threshold element 324 after it has operated.

The circuit 268 comprises a threshold element 334 and an inverting element formed as a relay 335. Input resistor 336 of the threshold element 334 is coupled to the output of the integrator 275. The winding of the relay 335 is coupled via a diode 337 to the output of the threshold element 334, whereas a contact 338 thereof is coupled via a diode 339 to an input resistor 340 of the threshold element 334, thereby providing for the blocking of the threshold element 334 after it has operated. Input resistor 341 of the threshold element 334 has connected thereto a gate 342 comprising diodes 343, 344 and 345 and a resistor 346, the latter being connected to the positive bus 115 of the source 104. The diode 344 is connected to the movable contact 338, whereas the diode 345 is connected to the output of the threshold element 324.

The contact 303 at the input of the multiplier 302 belongs to the relay 335.

The circuit 269 comprises a threshold element 347, an inverting element in the form of a relay 348 and a delay element in the form of a timer 349. Input resistor 350 of the threshold element 347 is connected to the positive bus 115 of the source 104, input resistor 351 is connected to the output of the integrator 275, input resistor 352 is connected through a diode 353 to the contact 166 (FIG. 3) of the relay 160. The control windings of the relay 348 (FIG. 5) and of the timer 349 are coupled via a diode 354 to the output of the threshold element 347. Movable contact 355 of the relay 348 is coupled via a diode 356 to an input resistor 357 of the threshold element 347, thereby providing for the self-blocking of the threshold element 347 after it has operated.

Figure 4:
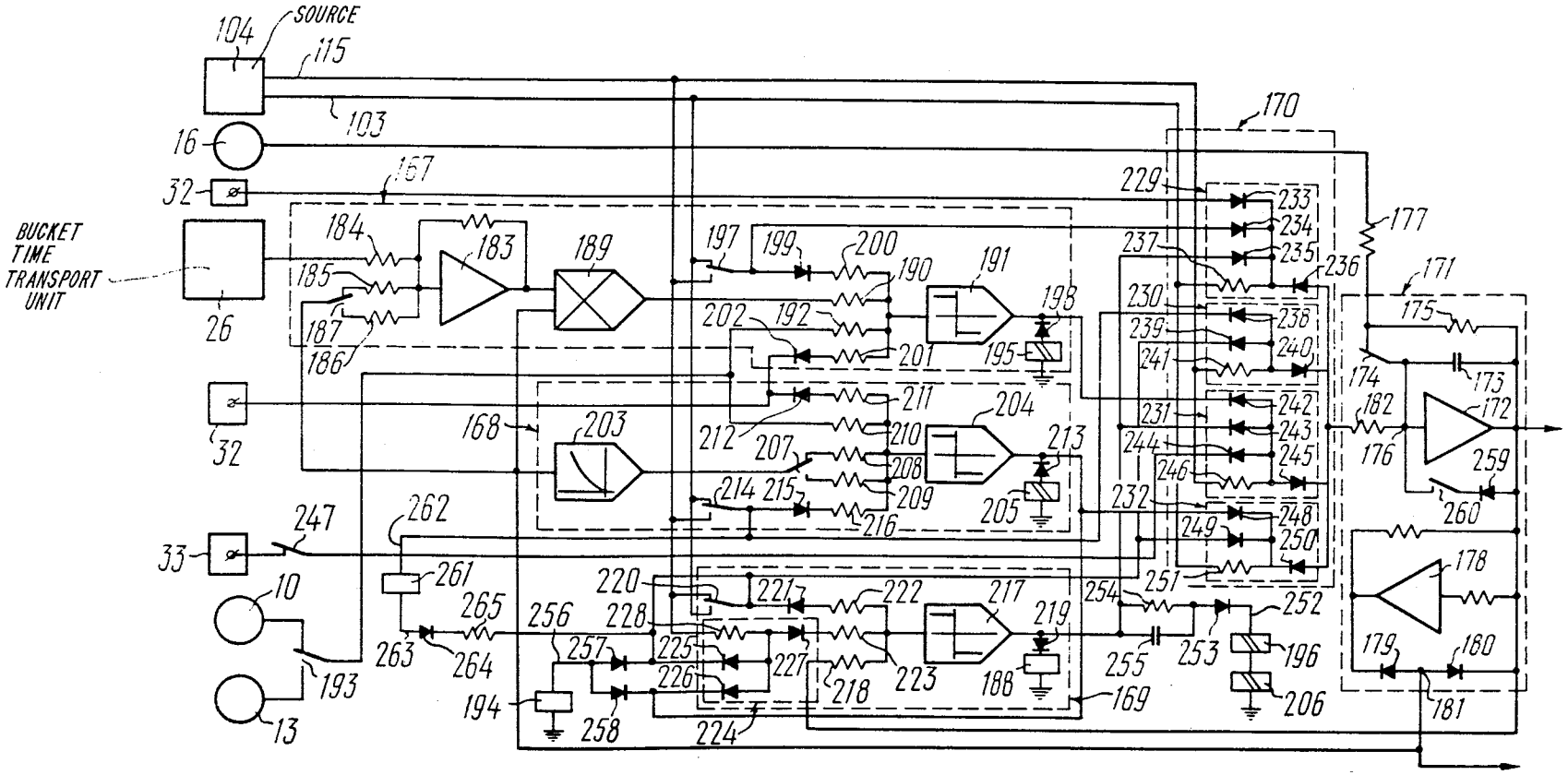
FIG. 4 is a block diagram of a bucket hoisting mechanism speed setter, in accordance with the invention.
Figure 5:
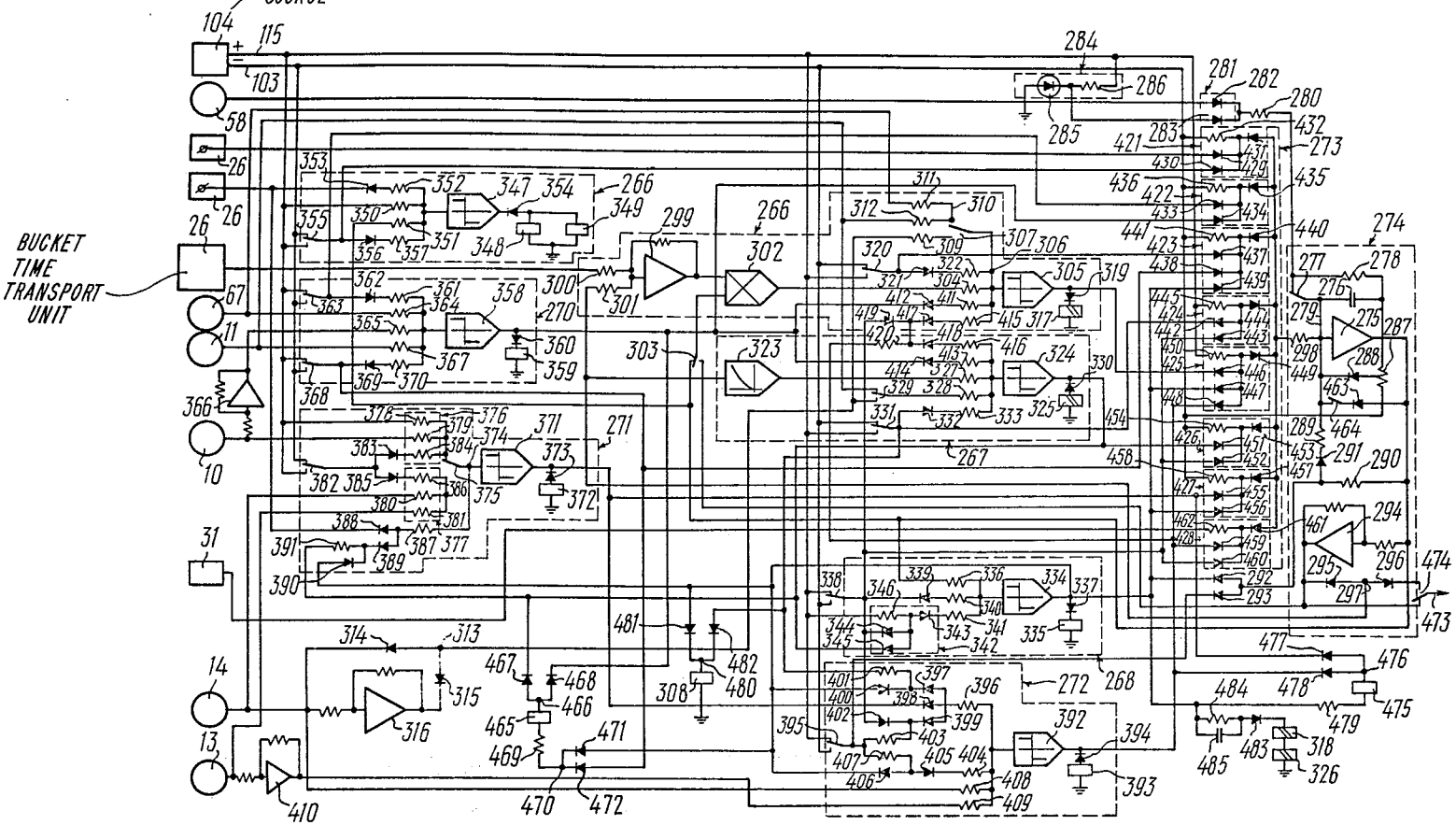
FIG. 5 is a block diagram of a bucket dragging mechanism speed setter, in accordance with the invention.

Contacts 139 (FIG. 3) and contacts 174 (FIG. 4) belong to the relay 348 (FIG. 5). Movable contact 355 of the relay 348 is also coupled via a diode 202 (FIG. 4) and a diode 212 to the resistors 201 and 211 respectively, whereas the diode 233 of circuit 170 is connected to the output of element 347 (FIG. 5).

The circuit 270 comprises a threshold element 358 and an inverting element in the form of a relay 359, of which the winding is coupled via a diode 360 to the output of the threshold element 358. Input resistor 361 is coupled via a diode 362 to a movable contact 363 of the timer 349. Input resistor 364 is connected to the output of the transducer 67, input resistor 365 is coupled through an inverter 366 to the output of the transducer 10, and input resistor 367 is connected to the output of the transducer 11. Movable contact 368 of the relay 359 is coupled via a diode 369 to input resistor 370 of the threshold element 358.

The circuit 271 comprises a threshold element 371 and an inverting element in the form of a relay 372, of which the control winding is coupled to the output of the threshold element 371 via a diode 373. Zero point 374 of the threshold element 371 is coupled via contacts 375 of the relay 308 to input resistor groups 376 and 377. Resistor 378 is connected to the positive bus 115 of the source 104 and resistor 379 of the group 376 is connected to the output of the transducer 10. Resistor 380 of the group 377 is connected to the output of the transducer 14, while resistor 381 is connected to the output of the transducer 13. Contact 382 of the relay 372 is coupled via a diode 383 to a resistor 384 of the group 376 and via a diode 385 to a resistor 386 of the group 377. Input resistor 387 on one side is directly connected to the zero point 374 and on the other side it is directly connected to diodes 388 and 389, the diode 388 being connected to the contact 166 (FIG. 3) of the relay 160, whereas the diode 389 forms a gate with a diode 390 (FIG. 5) and a resistor 391. The resistor 391 is connected to the output of the threshold element 324, while the diode 390 is connected to the output of the threshold element 334.

The circuit 272 comprises a threshold element 392 and an inverter element formed as a relay 393, of which the control winding is coupled to the output of the threshold element 392 via a diode 394. Contact 395 of the relay 393 is connected to the input of the threshold element 392. Input resistor 396 is connected to three parallel-placed diodes 397, 398 and 399. The diode 398 is connected to the output of the threshold element 371. The diode 397 forms a gate with a diode 400 and a resistor 401, the resistor 401 having connected thereto the contact 331 of the relay 325, while the diode 400 is connected to the output of the threshold element 334. The diode 399 likewise forms a gate with a diode 402 and a resistor 403, the resistor 403 being connected to the contact 395 of the relay 393 and the diode 402 - to the contact 338 of the relay 335. Input resistor 404 has connected thereto a gate formed by diodes 405 and 406 and a resistor 407, the resistor 407 being connected to the contact 395 of the relay 393 and the diode 406 to the output of the threshold element 334. Input resistor 408 is connected to the output of the transducer 14, and input resistor 409 is coupled via an inverter 410 to the output of the transducer 13.

In order to ensure that prior to the instant the mechanism 4 (FIG. 1) starts moving the threshold element 305 and 324 stay in a blocked state, input resistor 411 (FIG. 5) of the element 305 and input resistor 413 of the element 324 are respectively coupled via a diode 421 and a diode 414 to the output of the threshold element 358.

In order to ensure that during the time when the dragging mechanism 4 (FIG. 1) is maneuvered with a view to preventing the slackening of the drag rope 9 as the bucket 3 is transported from the dumping point to the point where it is lowered on the face, input resistor 415 (FIG. 5) of the element 305 and input resistor 416 of the element 324 are connected to a gate formed by diodes 417, 418 and 419 and a resistor 420, the resistor 420 being connected to the outputs of the threshold element 392 and the diode 419 to the contact 338 of the relay 335.

The logic circuit 273 comprises parallel-coupled gates 421, 422, 423, 424, 425, 426, 427 and 428. The gate 421 is built around diodes 429, 430 and 431 and a resistor 432, the latter being connected to the negative bus 103 of the source 104. The anodes of the diodes 429 and 430 are respectively connected to the contact 165 (FIG. 3) of the relay 160 and to the contact 355 (FIG. 5) of the relay 348. The gate 422 is built around diodes 433, 434 and 435 and a resistor 436, the latter being connected to the negative bus 103 of the source 104. The anodes of the diodes 433 and 434 are respectively connected to the contact 363 of the relay 349 and to the output of the threshold element 358.

The gate 423 is built around diodes 437, 438, 439 and 440 and a resistor 441 which is connected to the negative bus 103 of the source 104. The anodes of the diodes 437, 438 and 439 are respectively connected to the contact 320 of the output relay of the threshold element 305, to the contact 368 of the relay 359 and to the output of the threshold element 334.

The gate 424 is built around diodes 442, 443 and 444 and a resistor 445 which is connected to the positive bus 115 of the source 104. The cathodes of the diodes 442 and 443 are respectively connected to the contact 331 of the output relay of the threshold element 324 and to the contact 338 of the relay 335. The gate 425 is built around diodes 446, 447, 448 and 449 and a resistor 450 which is connected to the positive bus 115 of the source 104. The cathodes of the diodes 446, 447 and 448 are respectively connected to the output of the threshold element 305, to the output of the threshold element 334 and to the output of the threshold element 392. The gate 426 is built around diodes 451, 452 and 453 and a resistor 454 which is connected to the negative bus 103 of the source 104. The anodes of the diodes 451 and 452 are respectively connected to the output of the threshold element 324 and to the contact 338 of the relay 335. The gate 427 is built around diodes 455, 456 and 457 and a resistor 458 which is connected to the negative bus 103 of the source 104. The anodes of the diodes 455 and 456 are respectively connected to the output of the threshold element 371 and to the output of the threshold element 334. The gate 428 is built around diodes 459, 460 and 461 and a resistor 462 which is connected to the output of the transducer 16. The anodes of the diodes 459 and 460 are respectively connected to the output of the threshold element 392 and to the contact 338 of the relay 335.

The feedback circuit of the integrator 275 includes a diode 463 coupled via a contact 464 of a relay 465. The control winding of the relay 465 is connected by way of one end thereof to common point 466 of diodes 467 and 468, the cathodes thereof being connected to the output of the threshold element 324 and to the output of the threshold element 358, respectively. The other end of the control winding of the relay 465 is coupled via a resistor 460 to common point 470 of diodes 471 and 472, whereof the anodes are connected to the output of the threshold element 334 and to the contact 368 of the relay 359, respectively.

Output bus 473 of the unit 32 is coupled via contact 474 of a relay 475 to the output of the inverter 294 and to the output of the integrator 275. One end of the control winding of the relay 475 is connected to common point 476 of diodes 477 and 478, whereof the cathodes are respectively connected to the output of the threshold element 371 and to the output of the threshold element 392. The other end of the control winding of the relay 475 is coupled via a resistor 479 to the output of the threshold element 334.

The control winding of the relay 308 is connected to common point 480 of diodes 481 and 482, whereof the anodes are respectively connected to the output of the threshold element 334 and to the contact 331 of the output relay of the threshold element 324.

The electric circuit of the windings 318 and 326 is coupled to the output of the threshold element 334 through a diode 483, a resistor 484 and a capacitor 485, the resistor 484 and the capacitor 485 being connected in parallel and forming a differentiating string.

The unit 33 (FIG. 1) for setting the speed of the swing mechanism 5 comprises a circuit 486 (FIG. 6), which converts the coordinates of the bucket position to the acceleration time of the swing mechanism 5 proportional to the period of swing of a pendulum, a circuit 487 for determining the steady speed of the swing mechanism, a circuit 488 for determining the value of the mechanism starting acceleration, a circuit 489 for determining the instant the mechanism starts decelerating, a circuit 490 for determining the sense of motion of the mechanism, a shaper 491 for forming a predetermined mechanism speed signal, and a swing mechanism start-up delay circuit 492.

Figure 6:
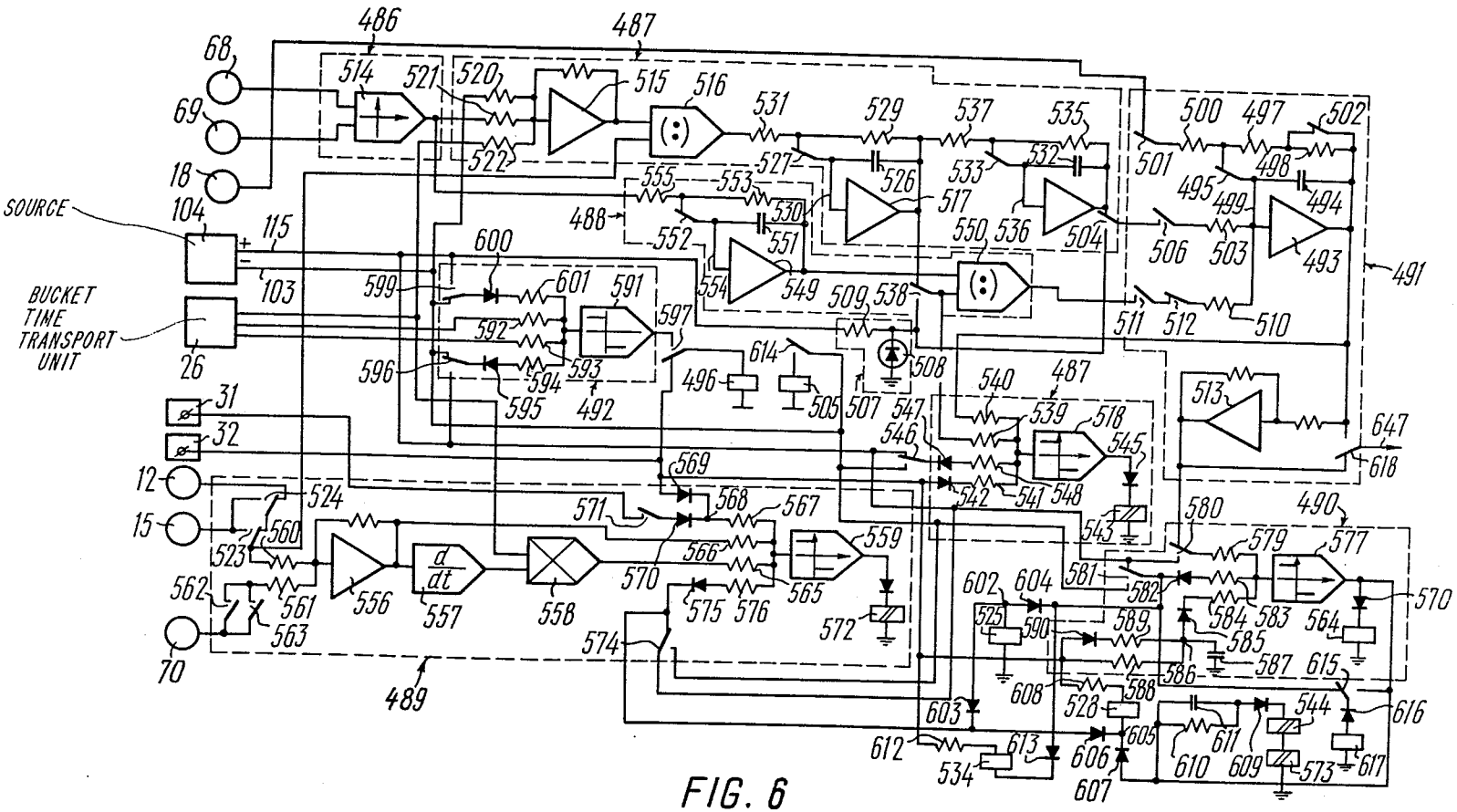
FIG. 6 is a block diagram of a platform swing mechanism speed setter, in accordance with the invention.

The shaper 491 comprises an integrator 493 and resistors 497 and 498 coupled via contacts 495 of a relay 496 in parallel with a capacitor 494 of the integrator 493. These same contacts 495 serve to connect to zero point 499 of the integrator 493 a resistor 500 which is coupled via contacts 501 of the relay 160 (FIG. 3) to the output of the transducer 13 (FIG. 6). Contacts 502 of the relay 160 (FIG. 3) are connected in parallel with the resistor 498. Input resistor 503 of the integrator 493 is coupled via contacts 504 of a relay 505 and contacts 506 to the output of a reference voltage source 507. The source 507 is built around a Zener diode 508 and a resistor 509, the latter being connected to the positive bus 115 of the source 104. Input resistor 510 of the integrator is coupled via contacts 511 of the relay 496 and contacts 512 to the output of the circuit 488. The output of the integrator 493 is connected to the input of an inverter 513.

The circuit 486 is formed as an x-y converter 514 coupled by way of the inputs thereof to the output of the transducer 68 and to the output of the transducer 69.

The circuit 487 comprises an adder 515, a divider 516, a memory element 517, a threshold element 518 and a memory element 519. Input resistor 520 of the adder 515 is connected to the negative bus 103 of the source 104, input resistor 521 is connected to the output of the converter 514, and input resistor 522 is connected to the output of the inverter 154 (FIG. 3) of the unit 26. The output of the adder 515 (FIG. 6) is connected to an input of the divider 516, the output of the transducer 12 and the output of the transducer 15 being coupled to the other input of the divider 516 via contacts 523 of the relay 505 and contacts 524 of a relay 525. The element 517 is formed as an integrator, with a resistor 529 being coupled via contacts 527 of a relay 528 to a capacitor 526 of the ientegrator. These same contacts 527 also serve to connect to zero point 530 of the integrator a resistor 531 connected to the output of the divider 516.

The element 519 is likewise formed as an integrator, with a resistor 535 being connected in parallel to a capacitor 532 of said integrator via contacts 533 of a relay 534. A resistor 537 connected to the output of the element 517 is connected to zero point 536 of the integrator via these same contacts 533. The output of the memory element 519 is coupled via the contacts 504 of the relay 505 and via the contacts 506 to the input resistor 503 of the integrator 493.

The output of the memory element 517 is coupled via contacts 538 of the relay 505 to an input resistor 539 of the threshold element 518. Input resistor 540 of the threshold element 518 is connected to the output of the integrator 493. Input resistor 541 of the threshold element 518 is coupled via a diode 542 to the contact 363 (FIG. 5) of the relay 349 included in the unit 32.

At the output of the threshold element 518 (FIG. 6) there is provided an output relay with two windings 543 and 544, the relay contacts 512 being connected into the circuit of the input resistor 510 of the integrator 493. The movable contact of the output relay is arranged intermediate the positive and negative buses 115 and 103 of the source 104. As the relay operates, its movable contact 546 connects one of the outputs of the circuit 487 either to the positive bus 115 or to the negative bus 103, thereby causing the output in question to generate a signal of reversed polarity with respect to the output signal of the threshold element 518. The output of the threshold element 518 serves as a second output of the circuit 487. The relay winding 543 is coupled via a diode 545 to the output of the element 518, whereas the relay movable contact 546 is coupled via a diode 547 to an input resistor 548 of the element 518.

The circuit 488 comprises a memory element 549 and a divider 550. The memory element 549 is formed as an integrator, with a resistor 553 coupled via contacts 552 of the relay 528 in parallel with a capacitor 551 of the integrator. These same contacts 552 serve to connect to zero point 554 of the integrator a resistor 555 connected to the output of the converter 514. The output of the element 549 is connected to an input of the divider 550, the other input thereof having connected thereto the output of the element 517 and the output of the source 507 via the contacts 538 of the relay 505. The output of the divider 550 is coupled via the contacts 511 of the relay 496 and the contacts 512 with the input resistor 510 of the integrator 493.

The circuit 489 comprises an adder 556, a differentiator 557, a multiplier 558 and a threshold element 559. Input resistor 560 of the adder 556 is coupled via the contacts 523 of the relay 505 and the contacts 524 of the relay 525 to the output of the transducer 12 and to the output of the transducer 15. Input resistor 561 is coupled to the output of the transducer 70 via parallel-connected contacts 562 of the relay 505 and contacts 563 of a relay 564 included in the circuit 490. The output of the adder 556 is connected to the input of the differentiator 557. The output of the differentiator 557 is connected to an input of the multiplier 558, of which the other input has connected thereto the output of the inverter 154 (FIG. 3) of the unit 26. The output of the multiplier 558 (FIG. 6) is connected to an input resistor 565 of the threshold element 559. Input resistor 566 of the threshold element 559 is connected to the output of the adder 556. Input resistor 567 is connected to common point 568 of diodes 569 and 570. The diode 569 has connected thereto the contact 363 (FIG. 5) of the relay 349, whereas the diode 570 (FIG. 6) has coupled thereto via contact 571 of the relay 505 the contact 220 (FIG. 4) of the relay 188. At the output of the threshold element 559 (FIG. 6) there is connected an output relay with two windings 572 and 573, the contacts 506 of the relay being included in the circuit of the input resistor 503 of the integrator 493. Movable contact 574 of this relay is arranged intermediate the positive bus 115 and the negative bus 103 of the source 104. As the relay operates, the movable contact 574 connects one of the outputs of the circuit 489 either to the positive bus 115 or to the negative bus 103, thereby causing the output in question to generate a signal of reversed polarity with respect to the output signal of the threshold element 559.

The output of the threshold element 559 serves as a second output of the circuit 489.

The movable contact 574 of the output relay of the element 559 is coupled via a diode 575 to an input resistor 576 of the element 559.

The circuit 490 comprises a threshold element 577 and an inverter element which is the relay 564 of which the winding is coupled via a diode 578 to the output of the threshold element 577. Input resistor 579 of the threshold element 577 is coupled via contacts 580 of the relay 505 to the output of the inverter 513 and to the positive bus 115 of the source 104. Contact 581 of the relay 564 is coupled via a diode 582 to input resistor 583. Input resistor 584 is coupled via a diode 585 to common point 586 of a capacitor 587, a resistor 588 and a resistor 589. A diode 590 is connected in series with the resistor 589, and the contact 363 (FIG. 5) of the relay 349 is connected to the anode of the diode 590 and to the resistor 588.

The circuit 492 (FIG. 6) comprises a threshold element 591. Input resistor 592 of the element 591 is connected to the movable contact 155 (FIG. 3) of the relay 145 included in the unit 26. Input resistor 593 (FIG. 6) of the element 591 is connected to the output of the adder 89 (FIG. 3) of the unit 26. Input resistor 594 (FIG. 6) is coupled via a diode 595 to a movable contact 596 of the relay 349 (FIG. 5) which switches the positive bus 115 (FIG. 6) and the negative bus 103 of the source 104. The output of the threshold element 591 is coupled via contacts 597 of the relay 505 and a diode 598 to the winding of the relay 496. The diode 598 is also connected by the contacts 597 to the contact 363 (FIG. 5) of the relay 349 included in the unit 32. Movable contact 599 (FIG. 6) of the relay 496 for switching the negative bus 103 and the positive bus 115 of the source 104 is connected via a diode 600 to an input resistor 601 of the element 591.

The winding of the relay 525 is connected to common point 602 of diodes 603 and 604, the cathode of the diode 603 being connected to the contact 574 of the output relay of the threshold element 559, while the cathode of the diode 604 is connected to the contact 581 of the relay 564.

One end of the control winding of the relay 528 is connected to common point 605 of diodes 606 and 607, whereof the anodes are respectively connected to the contact 574 of the output relay of the element 559 and to the output of the threshold element 577. The other end of the winding of the relay 528 is coupled via a resistor 608 to the contact 363 (FIG. 5) of the relay 349.

The electric circuit of the windings 544 (FIG. 6) and 573 is coupled via a diode 609 and parallel-connected resistor 610 and capacitor 611 to the output of the threshold element 577. The control winding of the relay 534 is coupled on one side via a resistor 612 to the contact 363 (FIG. 5) of the relay 349 and on the other side via a diode 613 to the contact 581 of the relay 564.

The unit 33 comprises a function selector for switching the excavator to either of two modes of operation: 360 degree or reversing. Movable contact 614 of the function selector is coupled to the negative bus 103 of the source 104 and with the winding of the relay 505. The contacts 123 (FIG. 3) 126 and 158 belong to the relay 505 (FIG. 6). The output of the converter 514 (FIG. 6) is coupled to the resistor 125 via the contacts 126 (FIG. 3), while the winding of the relay 145 (FIG. 3) is coupled via the contacts 158 to the output of the element 577 (FIG. 6) and to the output of the element 217 (FIG. 4). The diode 244 (FIG. 4) of the circuit 170 is coupled via the contacts 247 of the relay 505 (FIG. 6) to the output of the element 577.

The unit 33 also incorporates an initial swing direction switch of the platform, of which movable contact 615 is coupled to the output of the threshold element 577, with the contact 581 and via a diode 616 with a relay 617, contact 618 thereof being coupled to the output of the integrator 493 and to the output of the inverter 513.

Figure 7:
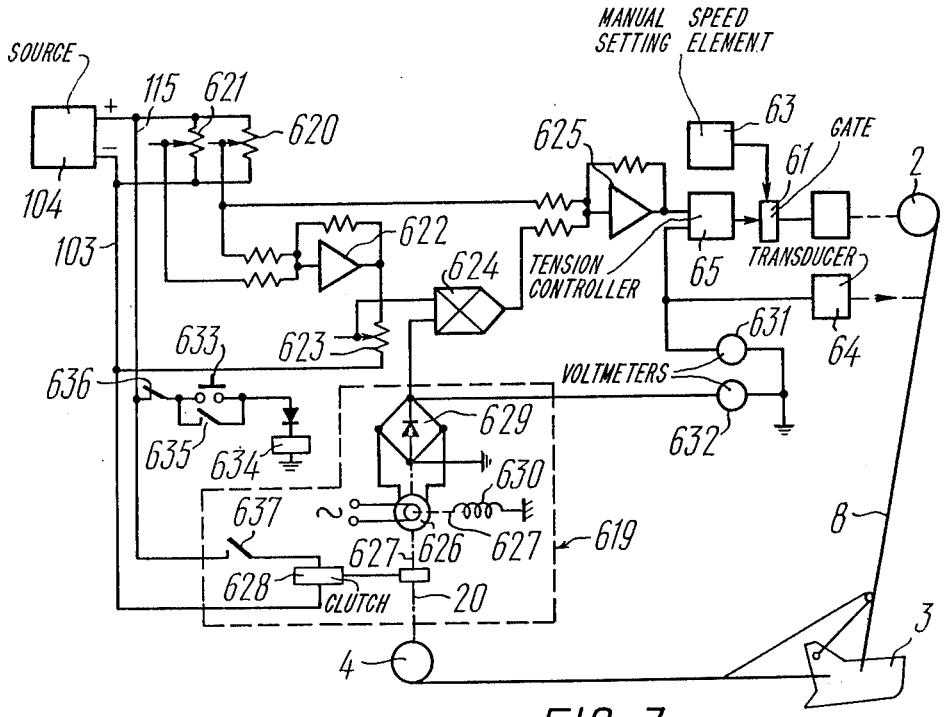
FIG. 7 is a diagram of a hoist rope tension setter, in accordance with the invention.

The hoist rope tension setting circuit 66 (FIG. 1) comprises a digging path transducer 619 (FIG. 7), a hoist rope initial tension setter 620, a hoist rope final tension setter 621, an adder 622, a digging path setter 623, a multiplier 624 and an adder 625.

The outputs of the setters 620 and 621 are coupled to the inputs of the adder 622, of which the output is connected to the input of the setter 623. The multiplier 624 has its inputs connected to the output of the setter 623 and to the output of the transducer 619. The outputs of the setter 620 and of the multiplier 624 are connected to the respective inputs of the adder 625, of which the output is connected with one of the inputs of the tension controller 65.

The transducer 619 comprises a synchro 626, whereof a shaft 627 is coupled via an electromagnetic clutch 628 to the shaft 20 of the mechanism 4. The output of the synchro 626 is coupled via a rectifier 629 to one of the inputs of the multiplier 624. The shaft 627 of the synchro 626 is also connected to a spring 630 resetting the synchro 626.

The circuit 66 comprises a voltmeter 631 designed for visual detection of hoist rope tension variation and a voltmeter 632 designed for visual detection of digging path changes. The voltmeter 631 is electrically connected to the output of the transducer 64, and the voltmeter 632 is electrically connected to the output of the transducer 619. The circuit 66 comprises a start button 633 included in a circuit which connects the positive bus 115 of the source 104 to the winding of a relay 634. The button 633 is shunted by contacts 635 of the relay 634. Contacts 636 of the relay 348 (FIG. 5) are connected in series with the button 633. The control winding of the clutch 628 (FIG. 7) is connected to the positive bus 115 of the source 104 via contacts 637 of the relay 634.

The gate 61 (FIG. 8) comprises a contact assembly 638 of the relay 634 (FIG. 7) and a contact assembly 639 (FIG. 8) of the relay 348 (FIG. 5). The ouput of the element 63 and the output of the controller 65 are respectively connected to fixed contacts 640 (FIG. 8) and 641 of the contact assembly 638, while movable contact 642 of the assembly 638 is connected to a fixed contact 643 of the contact assembly 639. The output of the unit 31 is connected to the other fixed contact 644 of the assembly 639, while movable contact 645 of the contact assembly 639 is connected to one of the inputs of the OR circuit 62.

In order to extend the range of working paths of the bucket 3 (FIG. 1) in the vicinity of the boom 7, the protection unit 80 (FIG. 2) of the assembly 76 incorporates an adder 646. The inputs of the adder 646 are connected to the output of the gate 61, to the output of the potentiometer 82 and to the positive bus 115 of the source 104. The output of the adder 646 is connected to the second input of the OR circuit 55.

OPERATION

The following describes the operation of the proposed control device for a dragline excavator which will be referred to hereafter as simply an excavator.

Analyzing the operation of the excavator, one can represent its full operating cycle as a sequence of operations common to and independent of the various process diagram, used in mining. The operations of digging, transportation of the loaded bucket to the dumping point and transportation of the empty bucket to the point where it is lowered on the face form a closed cycle which is frequently repeated while the face is being worked, whereas the operation of walking is repeated only after considerable intervals of time. The overall performance of the excavator depends to a considerable degree on how the former three operations are carried out.

The device of this invention is a means of automating the following three operations:

a. transportation of the filled bucket to the dumping point;

b. transportation of the empty bucket to the point at which it is lowered on the face; and c. digging.

The bucket 3 is moved in space by the mechanisms 2, 4 and 5 acting concertedly. The minimal time that may be spent on transporting the bucket 3 from one point in space to another is determined by that one of the three mechanisms which takes the greatest time to operate, with the proviso that this mechanism moves at its top speed and accelerations.

Such a mechanism will be referred to hereafter as the limiting one in a given operation.

Any one of the mechanisms 2, 4 and 5 may be the limiting one in an operation, depending on the coordinates of the breakout point of the bucket 3, its dumping point and the point where is makes contact with the face.

The laden bucket is transported to the dumping point or the empty bucket is transported to the face-contact point within a minimum of time only if the electric drive of the mechanism which is the limiting one in the operation in question conforms to its optimal speed diagram.

The optimal speed diagram for a limited-power electric drive is shaped like a trapezoid, the height of which is equal to the maximal speed value while the tangents of the angles of the lateral sides correspond to the maximum acceleration values. Further, a basic condition for automatic control of the transportation of the bucket 3 to the dumping point, or the transportation of the bucket 3 to the face-contact point, is synchronized operation of the electric drives of the mechanisms 2, 4 and 5 so that all the mechanisms (2, 4 and 5) preferably take an equal amount of time to perform their operations. From the two conditions, whereby the bucket 3 should be transported from one point to another as fast as possible and the electric drives of the mechanisms 2, 4 and 5 should operate in a synchronized manner, it follows that the minimal time within which an operation can be carried out is equal to the minimal time it takes the electric drive of the limiting mechanism to execute its program, and the speeds of the electric drives of the limiting mechanisms should not be less than their maximum values so that these drives can execute their programs within an interval of time equal to the duration of a given operation.

The duration of a working operation depends not only on the length increment of the hoist rope 8 or the drag rope 9 or on the swing angle of the platform 6, but also on initial speed conditions of the mechanism, on the steady-state value of this speed as well as on the acceleration and deceleration values.

The length increment of the hoist rope 8 or the drag rope 9 should be hereinafter taken to imply the difference between the length of the rope in question with the bucket 3 at the breakout point and that with the bucket 3 at the dumping point in the transportation operation of the bucket 3 from the breakout point to the dumping point, and the difference between the length of the rope with the bucket 3 at the dumping point and that with the bucket 3 at the face-contact point in the trangentation operation of the bucket 3 from the dumping point to the face-contact point.

Thus, while an operation is being carried out, the values of the length increments of the ropes 8 and 9 and of the swing angle of the platform 6 vary from certain initial values determined by the coordinates of the breakout and dumping points of the bucket 3 or the dumping and face-contact points of the bucket 3, to zero at the end of the operation.

The synchronized minimal duration of the operation to transport the bucket from the breakout point to the dumping point $T\uparrow$ or the operation to transport the bucket from the dumping point to the face-contact point $T\downarrow$ is $$T^{\uparrow(\downarrow)} = \max\,[\min T_1^{\uparrow(\downarrow)}, \min T_2^{\uparrow(\downarrow)}, \min T_3^{\uparrow(\downarrow)}] \quad (1)$$

where $T_1$, $T_2$ and $T_3$ are the times of program execution by the mechanisms 2, 4 and 5, respectively.

The index $\uparrow$ hereinafter designates the operation of transporting the bucket from the breakout point to the dumping point, while the index $\downarrow$ designates the operation of transporting the bucket from the dumping point to the face-contact point. The subscripts "1," "2" and "3" correspond to the mechanisms 2, 4 and 5, respectively.

In a general form, the steady speed of the hoisting or dragging mechanisms 2 or 4 is expressed by the following function:

$$sgn\left[\left(T - t - \frac{v(t)}{2a_3}\right) v(t) - l(t)\right] \quad (2)$$

where

*sgn* is the function of the sign;

$T$ is the duration of the operation;

$t$ is the current time;

$v(t)$ is the current value of the corresponding mechanism;

$a_3$ is the magnitude of deceleration of the mechanisms 2 or 4, and $l(t)$ is the current value of the rope length increment, while the instant at which deceleration begins is expressed by the function $$sgn\left[\frac{v^2(t)}{2a_3} - l(t)\right] \quad (3)$$

Should the mechanism 2 or 4 be the limiting one in the operation, its steady speed (the height $v$ of the trapezoid $v_1(t)$ in FIG. 9) is at its maximum value, while if the mechanism 2 or 4 is not the limiting one in the operation, its steady speed is below the maximum value.

The paths of the bucket of the automatically controlled excavator 1 (FIG. 10) should lie within the operating zone of the excavator delimited by the zones of minimal permissible approach of the bucket 3 to the excavator 1 (zone *a*), to the head of the boom 7 (zone *c*) and, lest there should be undesirable load exerted on the ropes 8 and 9 and the boom 7, to the axis of the boom 7 (zone *b*). Further, as the laden bucket 3 passes through the spontaneous dumping zone d its fill spills out, which is the reason why the bucket 3 should be lifted off and transported to the dumping point staying clear of this zone *d*, whereas at the end of the operation, in order to speed up the dumping process, the bucket 3 should enter the spontaneous dumping zone *d* with the drag rope 9 payed out at a maximum speed, thereby providing for the highest possible precision of dumping at a prescribed point. When the filled bucket 3 is lifted off the face, the dragging mechanism 4 should not be reversed until after the bucket 3 has been lifted off the face, for otherwise the bucket 3 may tip off.

All the listed requirements constitute a system of geometrical limitations on the paths of motion of the bucket 3.

As has been noted, accurate dumping of the bucket 3 at a prescribed height may be achieved only provided the bucket 3 crosses the spontaneous-dumping zone *d* along the shortest path, with the drag rope 9 being payed out at a maximum speed.

To fulfill these conditions, the bucket 3 is first moved to a certain theoretical or reference point M (FIG. 10) in the vicinity of the contemplated dumping point A and then, having crossed the boundary of this vicinity (point Z), the speed of the dragging mechanism 4 is accelerated to the maximum possible limit. In such a case, whatever the speed of the bucket 3 outside the spontaneous-dumping zone *d*, inside this zone the bucket 3 moves at its greatest speed.

Figure 9:
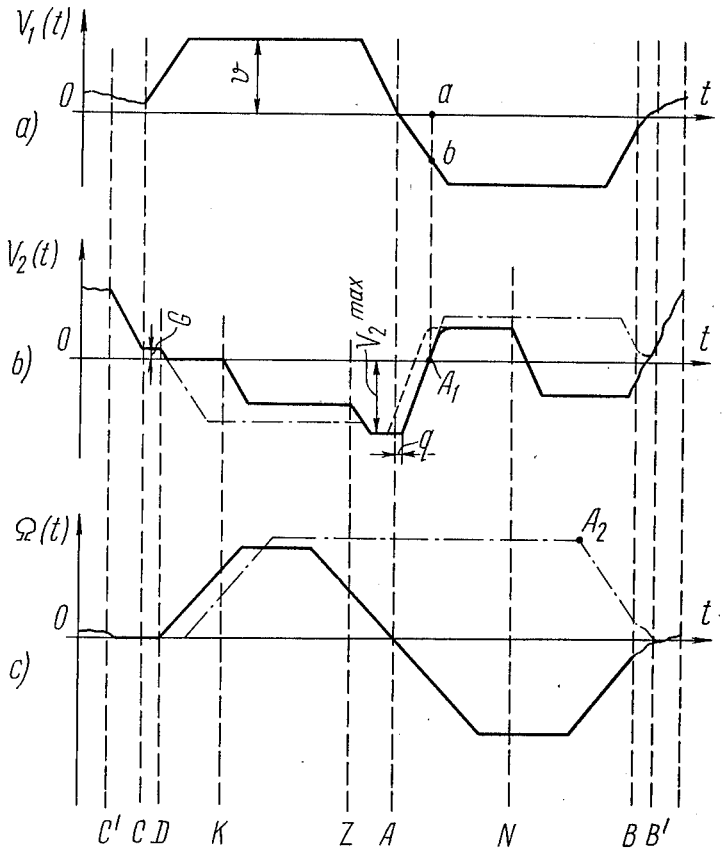
FIG. 9*a*, *b*, *c* are timing charts of signals proportional to the speed of the bucket hoisting and dragging mechanisms and the platform swing mechanism, in accordance with the invention.
Figure 10:
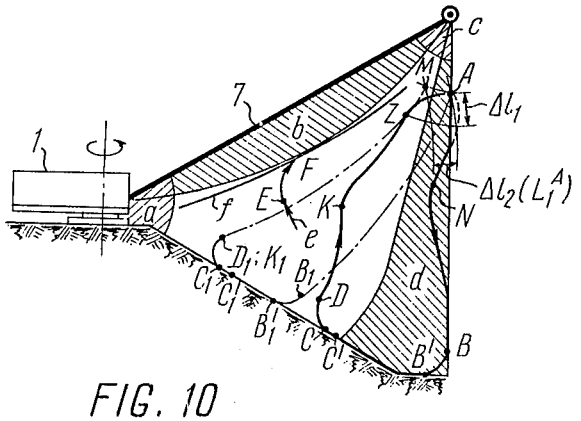
FIG. 10 represents bucket paths in automatic control of a dragline excavator, in accordance with the invention.

FIG. 9 illustrates the laws of speed variation of the mechanisms 2, 4 and 5, whereby the bucket 3 moves along the paths graphically represented in FIG. 10, the letters designating the main time instants and their corresponding points on the paths of motion of the bucket 3.

The reference point M lies beyond the spontaneous-dumping zone *d*, though close to its boundary. The bucket 3 initially moves to the reference point M because the coordinates of the point M are allowed for when determining the speed of the mechanism 4 dragging the bucket 3. The coordinates of the point M, just as those of any dumping point (for example point A), are determined by the length increments of the hoist and drag ropes 8 and 9 and the swing angle of the platform 6 as the bucket 3 is transported from the breakout point to the dumping point. The length increment of the hoist rope 8 and the swing angle of the platform 6 are the same as those for the real dumping point A, whereas the length increment of the drag rope 9 diminishes by a certain value $\Delta\, 1_2$ determined by the position of the boundary of the spontaneous-dumping zone d of the bucket 3.

The value $\Delta\, 1_2$, by which the length increment of the drag rope 9 should be decreased if the bucket 3 is to move to the reference point M, is proportional to the length $L_1^A$ of the hoist rope 8 when the bucket 3 is disposed at the dumpint point A. Thus, a change in position of the dumping point A of the bucket 3 will cause a change in the length $L_1^A$ of the hoist rope 8 when the bucket 3 is located at the dumping point A, thereby varying the value $\Delta\, 1_2(L_1^A)$ by which the length increment of the drag rope 9 diminishes as the bucket 3 is transported from the breakout point *c* to the dumping point A.

The steady speed of the dragging mechanism 4 as the bucket 3 is transported from the breakout point to the dumping point is determined by the function (2) which looks as follows:

$$sgn\left\{1_2^{\uparrow}(t) - \Delta 1_2(L_1^A) - [T^{\uparrow} - t - \frac{v_2(t)}{2a_{32}}]v_2(t)\right\} \quad (4)$$

where $a_{32}$ is the rate of deceleration of the mechanism 4.

The instant at which the speed of the dragging mechanism 4 of the bucket 3 starts to be increased (point Z in FIG. 10) is determined by the current length increment $l_1\ (t)$ of the hoist rope 8 reaching a certain reference value $\Delta\ l_1$ as the bucket is transported to the dumping point. The value $\Delta\ l_1$ is chosen to be equal to the breaking distance of the hoisting mechanism 2 from the top speed down to zero.

Thus, the time instant Z (FIG. 9) is defined by the function $$sgn[l_1^{\uparrow}(t) - \Delta\ l_1] \quad (5)$$

When determining the instant at which the dragging mechanism 4 of the bucket 3 starts decelerating in accordance with function (3), the length increment $l_2^{\uparrow}\ (t)$ of the drag rope 9 corresponds to the real dumping point A.

If the paths from the breakout point C of the bucket 3 lie close to the spontaneous-dumping zone *d*, in order to prevent the bucket 3 moving to the reference point M from prematurely entering the spontaneous-dumping zone *d*, the actuation of the dragging mechansim 4 is delayed, and the initial part of the path is traversed by the bucket 3 with the drag rope 9 remaining constant in length, that is to say the bucket 3 moves in a circumference (section DK). When the ratio of the length increments of the hoist rope 8 and the drag rope 9 reaches a certain value $\alpha_1$, the dragging mechanism 4 is started (point K). In this case the time T of transportation of the bucket 3 from the breakout point to the dumpimg point does not increase, for the dragging mechanism 4 cannot be the limiting one in the operation with the breakout point C of the bucket 3 located close to the spontaneous-dumping zone *d*. If the bucket 3 moves along paths lying closer to the dragline excavator 1, the startup of the dragging mechansim 4 is not delayed. FIG. 10 indicates by a dot-and-dash line one of such paths, and FIG. 9 shows the corresponding section of the speed diagram of the dragging mechanism 4. In this case the section DK is absent. As a result, the instant of start-up of the dragging mechanism 4 (point K) is determined by the function $$sgn[l_2^{\uparrow}\ (t) - \Delta l_2(L_1^A) - \alpha_1 l_1^{\uparrow}\ (t)]. \quad (6)$$

An important phase preceding the transportation of the bucket 3 to the dumping point is the breakout of the laden bucket 3 from the face. During the digging operation the tension of the hoist rope 8 is regulated to prevent slackening of the hoist rope 8 both in digging and in the breakout of the bucket 3 from the face, with the result that dynamic loading on the boom 7 is substantially reduced and one of the chief requirements to the bucket breakout process — jerkless running of the hoist rope 8 — is satisfied.

Toward the end of the digging operation (point C′ in FIGS. 9 and 10), the predetermined speed of the mechanism 5 (section CC′) is reduced to a certain fixed value G and maintained at this level a certain time CD during which the hoisting mechanism 2 performs the breakout of the bucket 3. This provides for the tautness of the drag rope 9 when the bucket 3 emerges from earth and prevents the bucket 3 from tipping off at the instant of its breakout from the face of the excanation.

The instant of start-up of the hoisting mechanism 2 (point C) is determined from the function $$sgn[\bar{v}(t) - G] \quad (7)$$

where $\bar{V}(t)$ is the output signal of the integrator 275 (FIG. 5)

While transporting the bucket 3 from the dumping point A to the face-contact point B, two modes of controlling the dragging mechanism 4 are adopted. If the bucket is lowered into the remotest parts of the face, for example vertically downward, the drag rope 9 slakens, an undesirable feature liable to cause the slack drag rope 9 to be drawn into the face as the platform 6 swings.

In order to avoid slackening of the drag rope 9 when the bucket 3 is lowered onto remote parts of the face, a law is adopted whereby the speed diagram of the dragging mechanism 4 has the form of two sequential trapezoidal signals of different polarities, the bucket 3 moving along a deformed path made up of two sections. Over the first section the length of the drag rope 9 diminishes and the path of the bucket 3 deviates from the vertical (section AN) (FIG. 10). causing the drag rope 9 to remain taut; over the second section (section NB) the bucket 3 is brought to the face-contact point, with the drag rope 9 increasing in length.

This kind of maneuvering of the dragging mechanism 4 does not affect the duration of the operation, for the mechanism 4 cannot be the limiting one when the bucket 3 is lowered onto the parts of the face most remote from the excavator 1. The boundary of the "maneuver zone" is defined by a certain path moving along which the slack of the drag rope 9 is eliminated the instant the bucket 3 has reached a horizontal level. The position of the face-contact point of the bucket with respect to the "maneuver zone" is determined by the ratio of the length increments of the hoist rope 8 and the drag rope 9 as the bucket 3 is transported from the dumping point to the point where it is lowered on the face.

This position is defined by the function $$sgn[l_1^{\downarrow}(t) - \beta_1 l_2^{\downarrow}(t)] \quad (8)$$

where $\beta_1$ is the proportionality factor characterizing the length increment ratio for the ropes 8 and 9 at the instant the bucket 3 crosses the boundary of the "maneuver zone."

Movement along the first section of the path is made possible by the constant speed ratio of the hoisting and dragging mechanisms 2 and 4, and the transfer of the bucket to the second section of the path is indicated by the instant (point N in FIGS. 9 and 10) at which the length increments of the hoist rope 8 and the drag rope 9 ($\beta_1'$) reach a certain ratio expressed by the formula $$\mathrm{sgn}[\beta_1' l_2^{\downarrow}(t) - l_1^{\downarrow}(t)] \quad (9)$$

In case the bucket 3 is lowered on the face at a point lying outside the "maneuver zone," that is to say located near the excavator or in the middle of the face, the speed diagram of the mechanism 4 is shaped like a single trapezoidal signal, and the bucket path has a single characteristic section. Such a path and section of the speed diagram of the mechanism 4 are indicated in FIGS. 9 and 10 by a dot-and-dash line. It will be seen that the section AN is absent here.

The trapezoidal speed diagram of the swing mechanism 5, in case it is not the limiting one in the operation, is deformed by decreasing the steady-state speed value and the acceleration values, the acceleration and deceleration times of the mechanism 5 as well as the duration of the operation remaining unchanged. As a consequence of such a change of the speed diagram of the mechanism 5, while the platform 6 is slewed the bucket 3 exerts minimal inertial load on the boom 7, its angular and speed deviations being comparatively small. At the same time, from one operation to another, the magnitude of acceleration of the swing mechanism 5 or its acceleration time depend on the assumed length of the pendulum — bifilarly suspended bucket — by the instant the operation begins. In this case the acceleration time of the mechanism 5 is proportional to the period of swing of the pendulum which is obtained by converting the coordinates of the bucket breakout and dumping points expressed as the overall lenghts of the hoist rope 8 and the drag rope 9 ($L_1$ and $L_2$, respectively).

Figure 11:
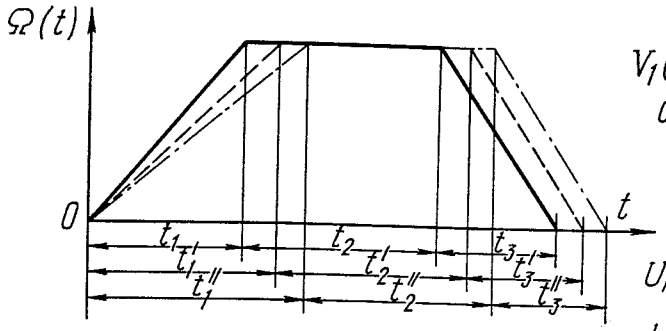
FIG. 11 represents limiting velocity diagrams of the platform swing mechanism provided the latter is the limiting one.

The limiting speed diagrams of the slewing mechanism 5 of the platform 6, if the mechanism 5 is the limiting one, are given in FIG. 11. Dotted lines indicate how the acceleration times or acceleration of the mechanism 5 vary depending on the initial assumed length of the pendulum (different periods of swing of the pendulum).

Figure 12:
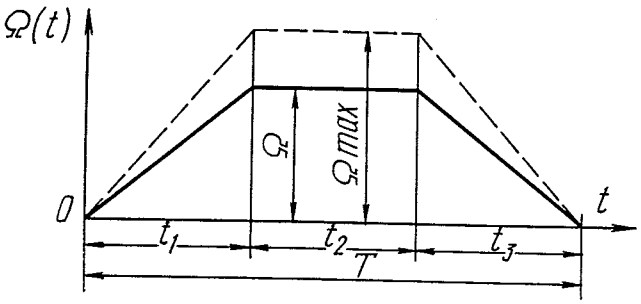
FIG. 12 represents velocity diagrams of the turn table swinging mechanism in case the latter is not the limiting one.

The speed diagram of the mechanism 5 is given in FIG. 12 for the case where the mechanism 5 is not the limiting one in the operation.

FIGS. 11 and 12 have the following deisgnations: $\Omega$ (t) is the current speed of the mechanism 5, T is the duration of the operation, $t_1$, $t_2$ and $t_3$ are the acceleration time, the steady speed time and the deceleration time of the mechanism 5, respectively, and $\Omega_{max}$ is the maximum permissible speed of the mechanism 5.

The acceleration time $t_1$ of the mechanism 5 is determined by converting the overall lengths of the hoist rope 8 and the drag rope 9 into a quantity proportional to the period of swing of the pendulum - bifilarly suspended buckle: which is done in the following manner. The operating zone of the excavator is shown to be convered by a coordinate grid, whereof each node is assigned a valve of the acceleration time $t_1$ of the mechanism 5 precalculated to be proportional to the period of swing of the bucket. The proportionality factor for different pendulum lengths is chosen depending on the period of swing of the bucket. At all intermediate points of the operating zone the acceleration time $t_1$ of the mechanism 5 is calculated by linear interpolation. The coordinates of the nodes are determined by the overall lengths $L_1$ and $L_2$ of the hoist rope 8 and the drag rope 9, i.e., $$t_1 = f(L_1, L_2) \quad (10)$$

The steady speed of the mechanism 5 is determined as $$\Omega = \frac{\Phi}{T - 0.5(t_1 + t_3)} \quad (11)$$

where $\phi$ is the swing angle of the platform when the bucket is transported to the dumping point or the face-contact point.

The acceleration $E_1$ and deceleration $E_3$ of the mechanism 5 are determined as follows:

$$\Sigma_1 = \frac{\Omega}{t_1} \quad (12)$$

$$\Sigma_3 = \frac{\Sigma_{3\,max}}{\Omega_{max}}\Omega \quad (13)$$

The job of controlling the mechanism 5 as the bucket 3 is transported from the breakout point to the dumping point consists in swinging the platform 6 by the angle $\phi$ through which the platform 6 is to be slewed.

The initial instant of deceleration of the mechanism 5 swinging the platform 6 as the bucket 3 is transported from the breakout point to the dumping point is defined by the function $$sgn[\Phi(t) - 0.5(T - t)\Omega(t)] \quad (14)$$

The task of controlling the mechanism 5 as the bucket 3 is transported from the dumping point to the face-contact point consists in displacing the bucket 3 by the angle through which the platform 6 is turned. Therefore, the initial instant of deceleration of the mechanism 5 is determined not only on the basis of the current swing angle of the platform 6 and its speed $\Omega(t)$, but also with due regard for the current angular deflection $\psi(t)$ of the swinging bucket 3 in the horizontal plane and the rate $\psi(t)$ of its variation.

The initial deceleration instant is determined by the function $$sgn\{\phi(t) + \psi(t) - 0.5(T - t)[\Omega(t) + \psi(t)]\} \quad (15)$$

When determining the minimal possible times of program execution by the mechanisms 2, 4 and 5 as the bucket 3 is transported from the breakout point C to the dumping point A and from the dumping point A to the face-contact point B, it is necessary to take into account the maximum capabilities of the mechanisms 2, 4 and 5, that is to say the maximum speed and accelerations of these mechanisms. The instant the bucket 3 is lifted off the face (instant C on the diagrams of FIG. 9 and point C on the paths of FIG. 10) is taken to be the initial instant of the operation to transport the bucket 3 to the dumping point A. The instant of sign reversal of the motion of the mechanisms 2 and 5 (instant A on the diagrams of FIG. 9) is taken to be the initial instant of the operation to transport the bucket 3 from the dumping point A to the face-contact point B.

The minimal possible time of program execution by the mechanism 2 hoisting the bucket 3 as the bucket 3 is transported from the breakout point C to the dumping point A is determined according to the following expression:

$$\min T_1^{\uparrow} = \frac{l_1^{\uparrow}(C)}{V_1^{max}} + V_1^{max}\left(\frac{a_{11}+a_{31}}{2a_{11}a_{31}}\right) + \frac{[V_1(C)^2]}{2a_{11}V_1^{max}} - \frac{V_1(C)}{a_{11}} \quad (16)$$

where $a_{11}$ is the value of acceleration of the mechanism 2, $a_{31}$ is the value of deceleration of the mechanism 2, $V_1$ is the top speed of the mechanism 2, and C is the time instant in FIG. 9.

At the instant the bucket 3 is to be transported from the dumping point A to the face-contact point B (instant A in FIG. 9), the initial speed of the hoisting mechanism 2 is equal to zero. Therefore, the minimal time of program execution by the mechanism 2 as the bucket 3 is transported to the face-contact point B is determined by the formula $$\min T_1^{\downarrow} = \frac{l_1^{\downarrow}(A)}{V_1^{max}} + V_1\left(\frac{a_{11}+a_{31}}{2a_{11}+a_{31}}\right) \quad (17)$$

The minimal possible time of program execution by the mechanism 4 as the bucket 3 is transported from the breakout point C to the dumping point A is determined with due regard for the fact that prior to the dumping instant Z the bucket 3 has moved to the reference point M and also that the initial speed of the mechanism 4 by the instant C is known equal to G:

$$\min T_2^{\uparrow} = \frac{l_2^{\uparrow}(C) - \Delta l_2(L_1^{\uparrow})}{V_2^{max}} + \frac{G\theta}{V_2^{max}} + V_2^{max}\left(\frac{a_{12}+a_{32}}{2a_{12}a_{32}}\right) + \frac{G^2}{2a_{12}V_2^{max}} + \frac{G}{a_{12}} + \theta \quad (18)$$

where $\theta$ = const is the time interval CD in FIG. 9 within which the bucket 3 is raised clear of the face.

In formula (18) all the terms but the first one are constant quantities which can be determined in advance.

As has already been noted, the steady speed of the mechanism 4 as the bucket 3 is transported to the dumping point is determined by calculating the movement of the bucket 3 to the reference point M, and the initial instant of deceleration of the mechanism 4 is determined on the basis of the coordinates of the real dumping point A. Consequently, the mechanism 4 is reversed later than the mechanisms 2 and 5, and by the instant the bucket 3 starts to move toward the face-contact point B (instant A in FIG. 9) the speed of the mechanism 4 may be less than or equal to the maximum value.

Depending on the coordinates of the breakout point C and the dumping point A of the bucket 3, at the beginning of the operation to transport the bucket 3, to the face-contact point B the speed diagram of the mechanism 4 may contain a maximum speed section (section $q$ in the speed diagram of the mechanism 4 in FIG. 9). This means that the mechanism 4 may be reversed both prior to the instant A (the section $q$ of the speed diagram of the mechanism 4 for this case is indicated by a dotted line in FIG. 9) and following it.

The minimal time of program execution by the mechanism 4 as the bucket is transported from the dumping point A to the face-contact point B is determined from the formula $$\min T_2^{\downarrow} = \frac{l_2^{\downarrow}(A)}{V_2^{max}} + V_2^{max}\left(\frac{a_{12}+a_{32}}{2a_{12}a_{32}}\right) + \frac{[V_2(A)]^2}{2a_{12}V_2^{max}} + \frac{V_2(A)}{a_{12}} + \tau \quad (19)$$

where $$\tau = \begin{cases} \dfrac{2l_2^{\uparrow}(t)}{V_2^{max}} - \dfrac{V_2^{max}}{a_{32}} \text{ for } \dfrac{2l_2^{\uparrow}(t)}{V_2^{max}} - \dfrac{V_2^{max}}{a_{32}} \geqslant 0 \\ 0 \text{ for } \dfrac{2l_2^{\uparrow}(t)}{V_2^{max}} - \dfrac{V_2^{max}}{a_{32}} < 0 \end{cases}$$

The minimal time of program execution by the mechanism 5 as the bucket 3 is transported from the breakout point C to the dumping point A is $$\min T_3^{\uparrow} = \frac{\Phi^{\uparrow}(C)}{\Omega\ \max} + 0.5\left[t_1(L_1,L_2) + \frac{\Omega\ \max}{\Sigma_3^{max}}\right] + \theta \quad (20)$$

The minimal time of program execution by the mechanism 5 as the bucket is transported from the dumping point A to the face-contact point B is determined from the following formula:

$$\min T_3^{\downarrow} = \frac{\Phi^{\downarrow}(A)}{\Omega\ \max} + 0.5\left[t_1(L_1,L_2) + \frac{\Omega\ \max}{\Sigma_3^{max}}\right] \quad (21)$$

In case the platform 6 is turned through sufficiently large angles it may be found expedient to switch to a 360° mode of operation of the dragline excavator 1. Then the speed diagram of the mechanism 5 reduces to two rectangular trapezoidal diagrams which correspond to the operation to transport the bucket 3 from the breakout point to the dumping point and the operation to transport the bucket 3 from the dumping point to the face-contact point. One of such diagrams is indicated in FIG. 9 by a dot-and-dash line.

The minimal time of program execution by the mechanism 5 as the bucket 3 is transported to the dumping point, the excavator operating in a 360° made, is $$\min T_3^{\uparrow} = \frac{\Phi^{\uparrow}(C)}{\Omega\ \max} + 0.5\ t_1(L_1,L_2) + \theta \quad (22)$$

while that for the operation to transport the bucket 3 to the face-contact point is $$\min T_3^{\downarrow} = \frac{\Phi^{\downarrow}(A)}{\Omega\ \max} + \frac{\Omega\ \max}{2\ \Sigma_3^{max}} \quad (23)$$

In the 360° mode of excavator operation, the limiting mechanism is usually the mechanism 5 for swinging the platform 6. The steady speed of the mechanism 5 is known in advance and is equal to its maximum value.

In some cases, however, at large length increments of the hoist rope 8 and the drag rope 9 while the bucket 3 is transported from the breakout point to the dumping point, the mechanism 5 may not be the limiting one. For such cases a provision is made to delay the start-up of the mechanism 5 until an equality is established:

$$T^{\uparrow} - t = \min T_3^{\uparrow} \quad (24)$$

whereby it is possible to avoid calculating the steady speed of the mechanism 5 which is equal to the maximum value with the excavator operating in a 360° mode.

The bucket 3 is lowered on the face (section BB′ in FIGS. 9 and 10) by the operator acting on the elements 57, 60 and 63.

The operation of digging (section B′C′ in FIGS. 9 and 10), the last in the operating cycle of the dragline excavator 1, is performed by the operator acting on the elements 57 and 60, the mechanism 2 being controlled with the help of the hoist rope tension setter 66, wherein the initial and final tension values $S_1$ and $S_2$, respectively, of the hoist rope 8 are established in a trial digging run, and where the digging path H is also memorized.

The law of variation of the hoist rope tension as a function of the current digging path $S[h(t)]$ is formed in accordance with the function $$S[h(t)] = S_1 + \frac{S_2 - S_1}{H} h(t) \quad (25)$$

When the bucket 3 approaches dangerously near the strut zone (zone *b* in FIG. 10), control of the dragging mechanism 4 of the bucket 3 is transferred to protection means which varies the speed of the mechanism 4 as a function of deviation $\phi$ of the sum of lengths of the hoist and drag ropes from the boundary value of this sum $\delta_1$, i.e., $V_2(\delta)$ adjusted depending on the current velocity $V_1(t)$ of the hoisting mechanism 2. The programmed variation of the speed $V_2'$ of the dragging mechanism 4, with the turned-on bucket protection means, is carried out according to the function $$V_2' = V_2(\delta) + [V_1^{max} - V_1(t)] \quad (26)$$

$$V_2(\delta) = \begin{cases} V_2^{max}(b\delta^{1/2} - 1) & \text{for } \delta < \delta_1 \\ V_2^{max} & \text{for } \delta \geqslant \delta_1 \end{cases}$$

where where $$b = \sqrt{\frac{2a_{12}}{(V_2^{max})^2}} \text{ is a constant factor}$$

$$\delta_1 = \frac{4}{b^2} \text{ is a constant factor.}$$

Before starting the excavator 1 in an automatic mode of operation, the operator, controlling the mechanisms 2, 4 and 5 with the help of the elements 57, 60 and 63, performs a trial cycle during which he establishes the initial conditions of the system requisite or its automatic operation.

Having stopped the bucket 3 at a desired dumping point, the operator notes the zero positions of the transducers 10, 11 and 12, thereby establishing points of reference of said transducers.

Continuing the trial cycle, the operator lowers the bucket 3 onto the face, stops it and fixes the zero positions of the transducers 13, 14 and 15, thereby establishing reference points for the transducers 13, 14 and 15.

While performing the last operation of the trial cycle, that of digging, the operator notes visually the values of the initial and final tension of the hoist rope, $S_1$ and $S_2$ respectively, using the instrument 621 for the purpose. Prior to carrying out the automatic cycle, the operator uses the setters 610, 611 and 613 to set the initial tension $S_1$ of the hoist rope 8, the final tension $S_2$ of the hoist rope 8 and the digging path H.

The trial run being over, the operator presses the button 163 (FIG. 3), thereby transferring the system to automatic operation.

The output signals of the transducers 10 (FIG. 3), 16, 11, and 67 continuously vary in the process of digging, the above transducers being respectively coupled to the inputs of the adders 87 and 88. The output signals of the transducer 12 and of the circuit 486 (FIG. 6) coupled to the inputs of the adder 89 (FIG. 3) also continuously vary in the process of digging.

Expression (16) is realized with the help of the input resistor group 101.

The constant term of expression (16) (the second term of the sum) is accomplished by connecting the source 115 to one of the input resistors of the group 101, whereas the quadratic relationship (the third term of the sum) is accomplished with the help of the varistor 105.

The input resistor group 108 accomplishes expression (18). The constant terms of expression (18) (all the terms of the sum but the first one) are accomplished by connecting the source 115 to one of the input resistors of the group 108.

Similarly, expression (20) is accomplished with the help of the input resistor group 118.

The continuously varying output signals of the adders 87, 88 and 89 are proportional to the values min $T_1$, min $T_2$ and min $T_3$ calculated according to expressions (16), (18) and (20).

The diodes 92, 93 and 94 help to continuously select the maximum output signal of the adders 87, 88 and 98 in accordance with expression (1). The diode 91 has connected thereto the cathode 131 of the Zener diode 129, the voltage of which is proportional to the minimal accepted time of the operation of transporting the bucket 3 from the breakout point to the dumping point.

The output of the circuit 90 is fed to the inputs of the integrators 96 and 97 and charges the capacitors 136 and 143 to a voltage proportional to the value of $T^{\uparrow}$.

Visually observing how the bucket 3 is being filled in the process of digging, the excavator operator presses the button 163, thereby fixing the instant when the bucket 3 is lifted off the face and starts moving toward the dumping point (instant C in FIG. 9).

After the output of the integrator 275 (FIG. 5) drops to the value G according to expression (7), the relay 348 operates to connect via the contacts 139 (FIG. 3) the zero point 138 of the integrator 96 to the input resistor 141. The integrator 96 is switced to the integrating mode, and its output signal inverted by the inverter 154 is proportional to $T^{\uparrow} - t$, i.e., the duration of the operation of transporting the bucket 3 from the breakout point to the dumping point, which value decreases with time.

At the end of the operation to transport the bucket 3 from the breakout point to the dumping point, at the instant when the mechanism 2 hoisting the bucket 3 starts decelerating, the threshold element 204 (FIG. 4) operates. The output of the threshold element 204 actuates the relay 100 (FIG. 3) which couples via the contacts 99, 117 and 107 the input resistor groups 102 and 119 and the common point 111 to the zero points 98, 116 and 106, respectively.

As a result, the adders 87, 88 and 89 calculate the values of min $T_1$, min $T_2$ and min $T_3$ in accordance with expressions (17), (19) and (21). The last term of expression (19) ($\tau$) is accomplished by the resistors 113 and 114 and the diode 112. Thus, if $$-\frac{21_2^{\uparrow}(t)}{V_2^{max}}+\frac{V_2^{max}}{a_{23}}<0$$

the diode 112 is conducting and the last term of (19)

$$\tau=\frac{21_2^{\uparrow}(t)}{V_2^{max}}-\frac{V_2^{max}}{a_{23}}$$

But if $$-\frac{21_2^{\uparrow}(t)}{V_2^{max}}+\frac{V_2^{max}}{a_{23}}>0$$

the diode 112 is blocked and $\tau = v$.

The capacitor 143 of the integrator 97 is charged to a voltage proportional to the magnitude of $T^{\downarrow}$.

At the instant of sign reversal of the motion of the mechanism 5 swinging the platform 6 (instant A in the diagrams of FIG. 9), the threshold element 577 (FIG. 6) operates, actuating by its output the relay 145 (FIG. 3), the latter coupling via the contacts 144 the resistor 149 to the zero point 147 of the integrator 97, thereby transferring the integrator 97 to an integrating mode. Simultaneously, the output of the integrator 97 is coupled via the contacts 155 to the input of the inverter 154. The output voltage of the inverter 154 is proportional to $T^{\downarrow} - t$.

While determining and forming a signal proportional to the time of transportation of the bucket 3 from the breakout point to the dumping point, the input of the inverter 154 is connected to the output of the integrator 96, and while determining and forming a signal proportional to the time of transportation of the bucket 3 from the dumping point to the face-contact point, the input of the inverter 154 is connected to the output of the generator 97.

The unit 26 is reset by the operator pressing the button 162.

Following is a discussion of the operation of the unit 31.

On the basis of information furnished by the unit 26 and the transducers 10 and 13, the circuit 167 determines in accordance with expression (2) the instants when the mechanism 2 hoisting the bucket 3 stops accelerating. Expression (3) is accomplished by the circuit 168, thereby determining the instants of the onset of deceleration of the mechanism 2.

During the operation of digging, the threshold elements 191, 204 and 217 are blocked in their initial states. Thus, the threshold elements 191 and 204 are blocked by the negative voltage of the source 104 delivered via the contact 355 (FIG. 5) of the relay 348 and via the conducting diodes 202 (FIG. 4) and 212 to the input resistors 201 and 211 of the elements 191 and 204. The gains at the above inputs are considerably in excess of the gains at the remaining inputs of the elements 191 and 204, in consequence of which no variation of the voltages fed to the resistors 190 and 192 of the elements 191 and to the resistors 210 and 208 of the element 204 can actuate the securely blocked elements 191 and 204.

The threshold element 217 is blocked in its initial state by the positive voltage of the source 104, the bush 115 of which is connected via the open gate 224 to the input resistor 223 of the element 217. The positive voltage is fed to the resistor 223 via the resistor 228 and the conducting diode 227. The gate 224 in its initial state is open, for the diode 225 is blocked by the positive voltage of the source 104 delivered from the bus 115 via the contact 220 of the relay 188 to the cathode of the diode 225, and the diode 226 is blocked by the positive output voltage of the element 204.

In the initial state, the output signal of the circuit 170 is equal to zero, for the diodes 236, 240, 245 and 250 are cut off and consequently the gates 229, 230, 231 and 232 are closed. The diode 236 is cut off by the positive output signal of the threshold element 347 (FIG. 5) which passes through the conducting diode 229 (FIG. 4). The diode 240 is cut off by the negative voltage of the source 104 which passes through the conducting diode 238. The diode 245 is cut off by the negative output signal of the threshold element 217 which passes through the conducting diode 243. The diode 250 is cut off by the positive output signal of the threshold element 204 which passes through the conducting diode 248.

In the initial state, that is to say during the operation of digging, the integrator 172 of the shaper 171 operates as an initial conditions setter. The output signal of the speed transducer 16 of the mecanism 2 is delivered to the input resistor 177 of the integrator 172 and, since in the initial state the output signal of the circuit 170 is equal to zero, the output signal of the integrator 172 is proportional to the speed of the mechanism 2.

Figure 13:
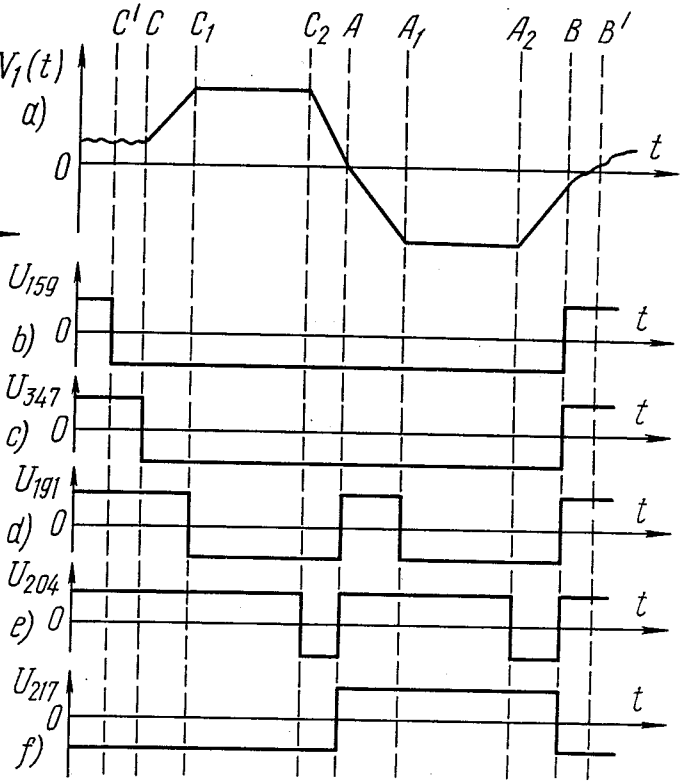
FIG. 13*a, b, c, d, e, f* represents a timing chart of a signal proportional to the speed of the hoisting mechanism, a timing chart of the output signal of the starting circuit of the transportation time calculator, and timing charts of the output signals of the threshold elements of the starting circuit of the dragging mechanism speed setter, of a circuit for determining the steady speed of the hoisting mechanism, of a circuit for determining the instant the hoisting mechanism starts decelerating, and of a circuit for determining the sense of motion of the hoisting mechanism.

FIG. 13 represents the timing chart $V_1(t)$ of the signal proportional to the speed of the mechanism 2, the timing chart $U_{159}$ of the output signal of the starting circuit 159 (FIG. 3), and the timing charts $U_{347}$, $U_{191}$, $U_{204}$ and $U_{217}$ of the output signals of the threshold element 347 (FIG. 5) of the circuit 269, of the threshold element 191 (FIG. 4) of the circuit 167, of the threshold element 204 of the circuit 168 and of the threshold element 217 of the circuit 169.

After the operator has pressed the button 163 (FIG. 3) (instant C in FIG. 13) and after 11speed of the mechanism 4 has dropped down to $V_2 = G$ (instant C), the threshold element 347 (FIG. 5) and the relay 348 are actuated, with the result that the contact 355 of the relay 348 is connected to the bus 115 of the source 104, while the contact 174 (FIG. 4) disconnects the resistors 177 and 175 from the zero point 176 of the integrator 172, thereby transferring the integrator 172 to an integrating mode. The threshold elements 191 and 204 are unblocked, for the voltage fed to the diodes 202 and 212 has reversed polarity, rendering said diodes non-conductive. Simultaneously the gate 229 is enabled due to the blocking of the diode 233 by the negative output voltage of the element 347 (FIG. 5), and the input resistor 182 of the integrator 172 is coupled via the conducting diode 236 (FIG. 4) and the resistor 237 to the bus 103 of the source 104. A voltage proportional to the starting acceleration $a_{11}\uparrow$ of the mechanism 2 is delivered to the input of the integrator 172. The output signal of the integrator 172 starts linearly increasing from a certain initial value dependent on the output voltage of the transducer 16 at an instant preceding the operation of the element 347 (FIG. 5) and the relay 348.

The inputs of the adder 183 (FIG. 4) receive a linearly increasing signal proportional to the negative modulus of the predetermined speed signal for the mechanism 2 produced at the point 181, and a linearly diminishing signal proportional to the difference $T\uparrow - t$. The output signal of the adder 183 is multiplied by the signal arriving from the common point 181 at the second input of the multiplier 189, whereof the output signal is compared by the threshold element 191 with the signal of the transducer 10. In other words, the sequence of the above elements accomplishes relationship (2). As long as the decreasing signal at the output of the transducer 10 exceeds the increasing output signal of the multiplier 189, the threshold element 191 will be maintained in its initial state. At the instant said signals are equalized (instant $C_1$ in FIG. 13) the output signal of the threshold element 191 changes in a step from a certain positive value to a certain negative value. Simultaneously current passes through the winding 195, and the contact 197 connects the diodes 199 and 234 to the bus 115 of the source 104. The positive voltage of the source 104 is fed via the conducting diode 199 to the input of the threshold element 191 blocking the latter in its new state. This same positive voltage also unblocks the diode 234 and cuts off the diode 236, i.e., the gate 229 is closed, and since all the other gates (230, 231 and 232) of the logic circuit 170 are closed, its output signal is equal to zero. The signal at the output of the integrator 172 stops increasing and acquires a magnitude proportional to the steady speed of the mechanism 2. The signal at the output of the squarer 203 is proportional to the path of retarded motion of the mechanism 2, i.e., $$\frac{V(t)}{2a_{31}}.$$

The output signal of the squarer 203 is compared with the decreasing output signal of the transducer 10 by the threshold element 10 in accordance with (3). When the output signal of the transducer 10 equalizes with the calculated output signal of the squarer 203 (instant $C_2$ in FIG. 13), the threshold element 204 operates reversing the polarity of its output signal. Simultaneously current passes through the winding 205 and the contact 214 connects the diodes 215 and 238 to the bus 115 of the source 104. The positive voltage of the source 104 is fed via the conducting diode 215 to the input of the threshold element 204, blocking it in its new state. This same positive voltage also serves to cut off the diode 238, thereby opening the gate 230, with the result that a positive signal proportional to the decelaration $a_{31}\uparrow$ of the mechanism 2 is fed to the input of the integrator 172 through the resistor 240 and the conducting diode 241.

The output signal of the integrator 172 starts decreasing from the calculated steady speed of the mechanism 2 down to zero.

As the threshold element 204 operates (instant $C_2$ in FIG. 13), the negative output signal of the element 204 unblocks the diodes 226 and 258, actuating the relay 194 to connect the output of the transducer 13 to the inputs of the threshold elements 191 and 204 via the contacts 193, and also cutting off the diode 227 of the gate 224, thereby unblocking the threshold element 217. When the output of the transducer 13 is connected to the threshold elements 191 and 204, the latter are not actuated, being in a blocked state.

The sign reversal of the output signal of the integrator 173 (instant A in FIG. 13) actuates the threshold element 217 and the relay 188.

At the instant the output signal of the threshold element 217 reverses polarity, an enabling pulse passes through the differentiating string composed of the capacitor 255 and the resistor 254 to the second windings 196 and 206 of the output relays of the threshold elements 191 and 204, with the result that the contacts 197 and 214 are reset, connecting the bus 103 of the source 104 to the diodes 199 and 215 which are thus rendered non-conducting. The threshold elements 191 and 204 are unblocked, and, since the output signals of the multiplier 189 and the squarer 203 are equal to zero, the output signal of the transducer 13 resets the threshold elements 191 and 204, which are thus prepared to accomplish the next operation. Simultaneously the contacts 187, 207 and 220 of the relay 188 are switched over.

The contacts 187 and 207 respectively connect the point 181 with the resistor 186 and the output of the squarer 203 with the resistor 209, which corresponds to a change of the coefficients proportional to the magnitude of $a_{31}\downarrow$ in accordance with formulas (2) and (3). The contact 220 connects the bus 103 of the source 104 to the diode 221; rendering the latter conductive and thus, blocking the threshold element 217. The positive and thus, blocking the threshold element 217. The positive output signal of the element 217 cuts off the diode 243 of the gate 231, and, since the diode 242 is cut off by the positive output signal of the threshold element 191 while the diode 244 is cut off by the positive (as will be shown hereafter) output signal of the threshold element 577 (FIG. 6), the gate 231 opens and a signal proportional to the magnitude of $a_{11}\downarrow$ is delivered to the input of the integrator 172 via the resistor 246 and the conducting diode 245.

The output signal of the integrator varies toward a higher absolute value. The instant at which steady speed is achieved (instant $A_1$ in FIG. 13) is determined in a way similar to the one described above by comparing the output signals of the multiplier 189 and the transducer 13. When the threshold element 191 operates, its negative output signal enables the diodes 242 and cuts off the diode 245, the gate 231 is closed and, since the gates 229, 230 and 232 are closed, the output signal of the circuit 170 is equal to zero. The element 191 is blocked in a similar manner. The instant at which the mechanism 2 starts decelerating (instant $A_2$ in FIG. 13) is also found by comparing the output signals of the squarer 203 and the transducer 13. As the element 204 operates, its negative output signal cuts off the diode 248, thereby opening the gate 232. A signal proportional to the deceleration $a_{31}\downarrow$ of the mechanism 2 is delivered to the input of the integrator via the resistor 251 and the conducting diode 250. The output signal of the integrator starts decreasing. Simultaneously the threshold element 204 is blocked and the relay 261 operates, causing current to flow in the relay winding through a circuit made up of the bus 115, the contact 214, the winding of the relay 261, the conducting diode 264, the resistor 265, the contact 220 and the bus 103 of the source 104. The contact 260 of the relay 261 closes, thereby connecting the diode 259 into the feedback circuit of the integrator 172, the diode 259 preventing polarity reversal of the output signal of the integrator 172 when that signal becomes equal to zero. Having reached zero, the output signal of the integrator 172 is maintained at zero level until the operator depresses the button 161, which corresponds to the transfer of control of the mechanisms 2, 4 and 5 of the excavator 1 to the elements 57, 60 and 63.

Following is a discussion of the operation of the unit 32 (FIG. 5).

The circuit 269 accomplishes relationship (7), i.e., the instant of equality $\tilde{V}_2 = G$ is determined and the time delay $\theta$ is realized. The circuit 270 accomplishes relationship (6) and delays the motion of the dragging mechanism 4 (instant K in FIG. 9). The circuit 266 accomplishes expressions (4) and (2), i.e., determines the instants at which the mechanism 4 stops accelerating when the bucket 3 is transported from the breakout point to the dumping point and from the dumping point to the face-contact point.

The circuit 267 accomplishes relationship (3), i.e., determines the instants at which the mechanism 4 starts decelerating when the bucket 3 is transported from the breakout point to the dumping point and from the dumping point to the face-contact point. The circuit 271 accomplishes expression (5) when the bucket 3 is transported from the breakout point to the dumping point, i.e., it determines the instant at which dumping of the bucket 3 begins (instant Z in FIG. 9). The circuit 271 also accomplishes relationship (9), i.e., it determines the instant at which the mechanism 4 stops maneuvering when the bucket 3 is transported from the dumping point to the face-contact point (instant N in FIG. 9).

The circuit 272 accomplishes relationship (8), determining whether or not the mechanism 4 maneuvers when the bucket 3 is transported from the dumping point to the facecontact point.

The circuit 268 is designed to determine the sense of rotation of the mechanism 4. The threshold elements 347, 358, 305, 324, 334, 371 and 392 of the circuits 269, 270, 266, 267, 268, 271 and 272 in their initial states, i.e., during the operation of digging, are blocked by respective signals. The threshold element 347 is blocked by a voltage delivered from the circuit 159 (FIG. 3) by the bus 103 via the contact 166 of the relay 160 and via the conducting diode 353 (FIG. 5) to the input resistor 352 of the threshold element 347. The threshold element 358 is blocked by the voltage delivered from the bus 115 of the source 104 via the contact 363 of the relay 349 and via the conducting diode 362 to the input resistor 361 of the threshold element 358.

The threshold elements 305 and 324 are blocked by the negative output voltage of the threshold element 358 delivered via the conducting diodes 412 and 414 to their input resistors 411 and 413, respectively. The threshold element 334 is blocked in its initial state by the voltage derived from the bus 115 of the source 104 via the open gate 342 to the input 341. The gate 342 is open because the diode 345 is cut off by the output signal of the threshold element 324 and the diode 344 is cut off by the voltage derived from the bus 115 of the source 104 via the contact 338 of the relay 335. The threshold element 371 is blocked by the voltage derived from the bus 103 of the source 104 via the contact 166 (FIG. 3) of the relay 160 and the conducting diode 388 (FIG. 5) to the resistor 387. The diode 389 is cut off by the positive output signal of the threshold element 324.

The threshold element 392 is blocked by the voltage derived from the bus 103 of the source 104 via the contact 331 of the relay 325, the resistor 401 and the conducting diode 397 to the resistor 396 of the threshold element 392. The diode 400 is cut off by the negative output signal of the threshold element 334, the diode 398 is cut off by the positive output signal of the threshold element 371, and the diode 399 is cut off by the voltage delivered thereto from the bus 115 of the source 104 via the contact 338 of the relay 335 and the conducting diode 402.

In its initial state the circuit 273 has a zero output, since the diodes 431, 435, 440, 444, 449, 453, 457 and 461 are cut off, that is to say the gates 421, 422, 423, 424, 425, 426, 427 and 428 are closed. The diode 431 is cut off by the positive voltage of the source 104 delivered from the bus 115 via the contact 165 (FIG. 3) of the relay 160 and the conducting diode 429 (FIG. 5). The diode 435 is cut off by the positive voltage of the source 104 derived from the bus 115 via the contact 363 of the relay 349 and the conducting diode 433. The diode 440 is cut off by the positive voltage of the source 104 derived from the bus 115 via the contact 368 of the relay 359 and the conducting diode 438. The diode 444 is cut off by the negative voltage of the source 104 derived from the bus 103 via the contact 331 of the output relay of the threshold element 324 and via the conducting diode 442. The diode 449 is cut off by the negative output signal of the threshold element 334 derived via the conducting diode 447.

The diode 453 is cut off by the positive voltage of the source 104 delivered from the bus 115 via the contact 338 of the relay 335 and the conducting diode 452. The diode 457 is cut off by the positive output signal of the threshold element 371 delivered via the conducting diode 455.

The diode 461 is cut off by the positive voltage of the source 104 delivered via the contact 338 of the relay 335 and the conducting diode 460.

The integrator 275 in its initial state operates as an initial conditions setter. The output signal of the element 58 is fed via the circuit 281 to the input resistor 280. The output signal of the source 284 is fed to the other input of the circuit 281. The signal of the source 284 limits the minimal possible output signal of the circuit 281 delivered to the input resistor 280. The output signal of the integrator 275 during the operation of digging varies proportionately to the variation of the output signal of the element 58 if the latter signal exceeds the output signal of the source 284, or proportionately to the output signal of the source 284 if the output signal of the element 58 is equal to or less than the output signal of the source 284.

Figures 14, 15:
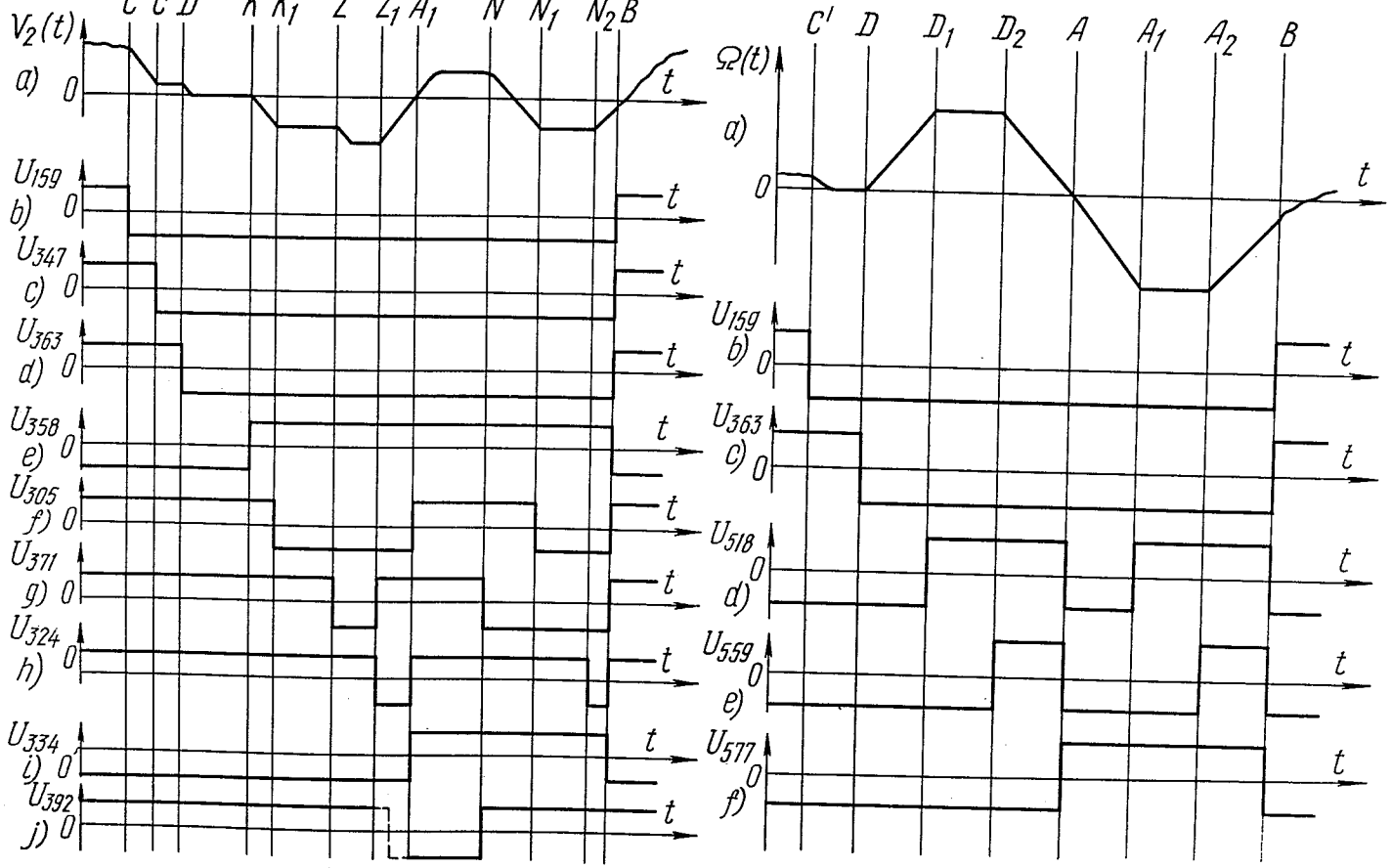
FIG. 14*a, b, c, d, e, f, g, h, i, j* represents a timing chart of a signal proportional to the speed of motion of the bucket dragging mechanism, a timing chart of the output signal of the starting circuit of the transportation time calculator, a timing chart of the output signal of the threshold element of the starting circuit of the dragging mechanism speed setter, a timing chart of the voltage on the timing relay of the dragging mechanism speed setter, and timing charts of the output signals of the threshold elements of the dragging mechanism motion delay circuit, of a circuit for determining the steady speed of the dragging mechanism, of a dragging mechanism accelerating circuit, of a circuit for determining the instant the dragging mechanism starts decelerating, of a circuit for determining the sense of motion of the dragging mechanism, and of a circuit for determining the maneuverability of the dragging mechanism.
FIG. 15*a, b, c, d, e, f* represents a timing chart of a signal proportional to the speed of the swing mechanism, a timing chart of the output signal of the starting circuit of the transportation time calculator, a timing chart of the voltage across the timing relay of the dragging mechanism speed setter, and timing charts of the output signals of the threshold elements of a circuit for determining the steady speed of the swing mechanism, of a circuit for determining the instant the swing mechanism starts decelerating and of a circuit for determining the sense of motion of the swing mechanism.

FIG. 14 represents the timing chart $V_2(t)$ of the signal proportional to the speed of the mechanism 4, the timing chart $U_{159}$ of the output signal of the starting circuit 159 (FIG. 3), the timing chart $U_{347}$ of the output signal of the threshold element 347 of the circuit 269, the timing chart $U_{363}$ of the voltage across the contact 363 of the relay 349, the timing charts $U_{358}$, $U_{305}$, $U_{371}$, $U_{324}$, $U_{334}$ and $U_{392}$ of the output signals of the threshold element 358 of the circuit 270, the threshold element 305 of the circuit 266, the threshold element 371 of the circuit 271, the threshold element 324 of the circuit 267, the threshold element 334 of the circuit 268 and the threshold element 392 of the circuit 272, respectively. When at the end of the digging operation the operator presses the button 163 (FIG. 3), the relay 160 operates to connect the contact 165 to the bus 103 of the source 104 and the contact 166 to the bus 115.

The negative voltage of the source 104 is delivered from the bus 103 via the contact 165 of the relay 160 to the diode 429 (FIG. 5) of the circuit 273, rendering the diode 429 non-conducting. With the diode 429 cut off, the gate 421 is opened, with the result that a signal proportional to the deceleration of the mechanism 4 at the end of the digging operation is delivered to the input resistor 298 of the integrator 275 via the resistor 432 and the conducting diode 431. Simultaneously, the contact 277 of the relay 160 (FIG. 3) disconnects the resistors 278 and 280 from the feedback circuit of the integrator 275 (FIG. 5), thereby switching the integrator 275 to an integrating mode. The output signal of the integrator 275 starts varying from a value equal to the output signal of the circuit 281. The threshold element 347 (FIG. 5), unblocked at the moment of starting (FIG. 3) (instant C′ in FIG. 14) when the relay 160 operates, compares the output signal of the integrator 275 with the constant voltage of the source 104 proportional to the magnitude of G in accordance with relationship (7). As there is established an equality $\bar{V}_2 = G$, the threshold element 347 and the relay 348 operate, connecting the contact 355 to the bus 115 of the source 104 (instant C in FIG. 14). The threshold element 347 is blocked by the positive voltage of the source 104 which is delivered from the bus 115 via the contact 355 (relay 348) and the conducting diode 356 to the input resistor 357. Simultaneously, the positive voltage of the source 104 delivered via the contact 355 of the relay 348 and the conducting diode 430 cuts off the diode 431. The output signal of the circuit 273 becomes equal to zero, with the result that the output signal of the integrator 275 stops varying and is maintained equal to $V_2 = G_D$ till the timer 349 operates (instant D in FIG. 14). When the timer 349 operates, its contact 363 is connected to the bus 103 of the source 104. The negative voltage of the source 104 delivered from the bus 103 via the contact 363 (timer 349) cuts off the diode 433 of the circuit 273. The gate 422 is opened and the voltage of the source 104 proportional to the acceleration of the mechanism 4 is fed to the input resistor 298 of the integrator 275 via the resistor 436 and the conducting diode 435.

The output signal of the integrator 275 drops to zero and remains at zero level, since there is a shunting diode 463 included in the feedback circuit of the integrator 275. At the instant the relay 349 operates, the threshold element 358 is unblocked, since the negative voltage of the source 104 cuts off the diode 362, and the output signals of the transducers 67, 11 and 10 are compared at the inputs of the threshold element 358, that is to say relationship (6) is accomplished. The operation of the threshold element 358 and the relay 359 (instant K in FIG. 14) causes the diode 435 to be cut off by the positive output signal of the threshold element 358 which is delivered via the conducting diode 434. Simultaneously, with the diode 468 being cut off, the control winding of the relay 465 is deenergized and its contact 464 in the feedback circuit of the integrator 275 opens. The negative voltage of the source 104 is delivered via the switched-over contact 368 of the relay 359 to the circuit 273, cutting off the diode 438. The gate 423 is opened and a signal proportional to the acceleration of the mechanism 4 is fed to the input of the integrator 275 via the resistor 441 and the conducting diode 440. The output signal of the integrator 275 starts increasing. At the instant the threshold element 358 operates the threshold element 305 and 324 are unblocked because the positive output signal of the threshold element 358 cuts off the diodes 412 and 414.

The process of determining the steady speed of the mechanism 4 is similar to that employed for the mechanism 2. The unblocked threshold element 305 compares the total signal of the transducers 67 and 11 with the output signal of the multiplier 302 in accordance with relationship (4). At the instant of operation of the threshold element 305, the winding 317 of its output relay carries current, and the contact 320 is connected to the bus 115 of the source 104 (instant $K_1$ in FIG. 14). The element 305 is blocked. The positive voltage of the source 104 via the contact 320 and the conducting diode 437 cuts off the diode 440. The output signal of the integrator 275 is maintained at a constant level equal to the calculated magnitude of the steady speed of the mechanism 4. The unblocked threshold element 371 compares the output signal of the transducer 10 with the positive voltage of the source proportional to the value $\Delta\, l_1$ in accordance with relationship (5).

At the instant of operation of the threshold element 371 and the relay 372 (instant Z in FIG. 14) the element 371 is blocked by the positive voltage of the source 104 which is delivered from the bus 115 via the switched-over contact 382 of the relay 372 and via the conducting diode 383 to the input resistor 384.

The negative output signal of the threshold element 371 cuts off the diode 455 of the gate 427, opening the latter so that a signal proportional to the acceleration of the mechanism 4 is delivered to the input of the integrator via the resistor 458 and the conducting diode 457. The output signal of the integrator starts increasing toward a value corresponding to the maximum speed of the mechanism 4 which is limited by the diode limiter built around the diode 288 and the resistor 287.

The initial instant of deceleration of the mechanism 4 (instant $Z_1$ in FIG. 14) is determined by comparing at the threshold element 324 the output signals of the squarer 323 and of the transducer 11 in accordance with relationship (3). When the threshold element 324 operates, the winding 325 of its output relay carries current and the contact 331 is connected to the bus 115 of the source 104. The element 324 is blocked. The negative output signal of the threshold element 324 delivered to the resistor 391 resets the threshold element 371, whereof the positive output signal passes through the conducting diode 455 to cut off the diode 457. Simultaneously the positive voltage of the source 104 is fed via the contact 331 to the circuit 273 to cut off the diode 442. The gate 424 is opened and a signal proportional to the deceleration of the mechanism 4 is fed to the input of the integrator via the resistor 445 and the conducting diode 444. The positive voltage of the source 104 delivered via the contact 331 and the conducting diode 482 to the control winding of the relay 308 makes the latter operate and switch over its contacts 307, 329 and 375. The contacts 375 connect the group 377 of input resistors to the point 374. The contact 307 connects the zero point 306 of the threshold element 305 to the resistor 309 coupled to the point 313 which produces the negative modulus of the output signal of the transducer 14. The contact 329 of the relay 308 connects the point 313 with the input resistor 328 of the threshold element 324. Simultaneously, i.e., at the instant $Z_1$ in FIG. 14, the threshold element 334 is unblocked by the negative output signal of the threshold element 324 which passes through the conducting diode 345 and cuts off the diode 343, while the threshold element 392 is unblocked by the positive voltage of the source 104 delivered through the contact 331 and the resistor 401 and cutting off the diode 397.

The output signal of the integrator 275 decreases and at the instant it reaches zero, the threshold element 334 and the relay 335 operate, blocking the element 334 by the negative voltage of the source 104 delivered to the input of the element 334 via the switched-over contact 338 of the relay 335 and the conducting diode 339.

The unblocking of the threshold elements 305 and 324 is effected with the help of the second windings 318 and 326 of the output relays of the threshold elements 305 and 324. The unblocking pulse is fed to the windings 318 and 326 via a differentiating string, formed by the resistor 484 and the capacitor 485, at the instant of operation of the threshold element 334. The threshold element 392 compares the output signals of the transducers 13 and 14 and thereby determines the position of the face-contact point of the bucket 3 relative to the "maneuver zone," i.e., accomplishing expression (8). At the instant of operation of the threshold element 334 (instant $A_1$ in FIG. 14), the diode 402 is cut off by the negative voltage of the source 104 and the diode 406 is cut off by the positive output signal of the element 334, so that the threshold element 392 is blocked with the help of the contact 395 of the relay 393 in a position characteristic of the previous instant. If the facecontact point of the bucket 3 is inside the "maneuver zone," the negative output signal of the threshold element 392 cuts off the diodes 449 and 459, while the positive voltage of the source 104 is delivered via the contact 395 of the relay 394 to the diode 293, cutting off same. The resistors 289, 290 and the diode 291 are connected into the feedback circuit of the integrator 275, and the output signal of the unit 31 which is proportional to the speed of the mechanism 2 is fed to the input of the integrator 275 via the resistor 462 and the conducting diode 461, the output signal of the unit 31 having a certain negative value (line "*ab*" in FIG. 9) at the instant $A_1$ (FIG. 9) of sign reversal of the speed of the mechanism 4. The parameters of the resistors 289 and 290 are so chosen that in a stepwise change of the input signal the rise time of the output pulse of the integrator 275 will not exceed the maximum permissible acceleration of the mechanism 4. The integrator 4 operates as an initial conditions setter with its output signal being proportional to the speed of the mechanism 2. The bucket 3 is lowered along the path section AN (FIG. 10) defined by the predetermined speed ratio of the mechanisms 2 and 4. This ratio is assigned with the help of a proportionality factor and is determined by the parameters of the resistors 462 and 298. The threshold elements 305 and 324 are blocked for the time of the maneuver by the negative output signal of the threshold element 392 delivered via the resistor 420 and the conducting diodes 417 and 418 to the input resistors 415 nd 416 of the elements 305 and 324, respectively.

The threshold element 371 is used to compare the continuously varying output signals of the transducers 13 and 14 in accordance with relationship (9). At the instant of operation of the threshold element 371, the latter is blocked by the relay 372, with the negative output signal fed via the conducting diode 398 to the input resistor 396 of the threshold element 392, actuating same. The positive output signal of the threshold element 392 passes through the conducting diode 459 and cuts off the diode 461 of the circuit 273. Simultaneously the negative voltage fed from the bus 103 via the switched-over contact 395 of the relay 393 and the conducting diode 293 cuts off the diode 291, thereby disconnecting the resistors 289 and 290 from the feedback circuit of the integrator 275 and switching the integrator 275 to an integrating mode. Since the output signal of the threshold element 392 becomes positive in sign, the diodes 417 and 418 of the threshold elements 305 and 324 are cut off, thereby unblocking the latter two threshold elements. The positive output signal of the threshold element 392 cuts off the diode 448 so that a signal proportional to the acceleration of the mechanism 4 is delivered to the integrator 275 via the conducting diode 449. The output signal of the integrator 275 starts varying from the value which was present at the instant of operation of the threshold elements 371 and 392 (instant N in FIG. 14).

The process of determining the steady speed of the mechanism 4 while the bucket 3 is transported from the dumping point to the face-contact point is carried out in a manner similar to the one described hereabove. As the threshold element 305 operates (instant $N_1$ in FIG. 14), its negative output signal cuts off the diode 449, with the result that the output signal of the integrator 275 stops varying. As the threshold element 324 operates (instant $N_2$ in FIG. 14), its negative output signal cuts off the diode 451 so that a signal proportional to the deceleration of the mechanism 4 is fed to the input of the integrator 275 via the conducting diode 453.

The negative output signal of the threshold element 324 passing through the diode 467 and the positive output signal of the threshold element 334 passing through the diode 471 to the winding of the relay 465, actuate the latter relay which connects with its contact 464 the diode 463 into the feedback circuit of the integrator 275. When the output signal of the integrator 275 reaches zero it remains at zero level, for the shunting diode 463 prevents any further variation of the output signal of the integrator 275.

The output signal of the unit 32 is formed at the bus 473 which is connected via the contact 474 of the relay 475 to the outputs of the integrator 275 and the inverter 294. If the mechanism 4 is not maneuvered while the bucket 3 is transported from the dumping point to the face-contact point, that is to say when the output signals of the threshold elements 371 and 392 are positive, the winding of the relay 475 is deenergized and the contact 474 of the relay 475 is connected to the output of the inverter 294.

If the mechanism 4 is maneuvered, the bus 473 prior to the instant $A_1$ (FIG. 14) is connected to the output of the inverter 294, and at the instant of operation of the threshold element 334 the negative output signal of the threshold element 392 and the positive output signal of the threshold element 334 actuate the relay 475 so that the bus 473 is connected by the contact 474 to the output of the integrator 275.

If the mechanism 4 is not maneuvered while the bucket 3 is transported from the dumping point to the face-contact point, the positive output signal of the threshold element 392 cuts off the diodes 448 and 461, while the negative voltage from the bus 103 delivered via the contact 395 of the relay 393 cuts off the diode 291 so that a signal proportional to the acceleration of the mechanism 4 is fed via the conducting diode 449 to the input of the integrator 275. In other words, the process of determination and formation of the steady speed of the mechanism 4 begins immediately following the sign reversal of the speed of the mechanism 4 at the instant $A_1$ (FIG. 14). FIG. 9 indicates by a dash-and-dot line the section $A_1B$ of the velocity diagram of the mechanism 4 for the case when the latter is not maneuvered.

When the operator presses the button 161 (FIG. 3) and the relay 160 operates, the unit 32 is reset, with all the threshold elements blocked in a manner described hereinabove.

Following is a discussion of the operation of the unit 34 (FIG. 6).

The serially connected converter 514, adder 515 and divider 516 accomplish expression (11). On the basis of information delivered from the transducers 68 and 69 to the converter 514, the acceleration times of the mechanism 5 are continuously calculated in accordance with expression (10). In the process of digging, variation of the lengths of the hoist rope 8 and the drag rope 9 causes variations in the output signal of the converter 514 which is added to the output signals of the unit 26 and of the source 104 by the adder 515. The output signal of the divider 516 is proportional to the steady speed of the mechanism 5. The memory elements 517 and 519 in their initial state follow up the output signal of the divider 516, while the memory element 549 follows up the output signal of the converter 514. The output signal of the memory element 517 is fed to the threshold element 518 to be compared with the output signal of the integrator 493 and also to one of the inputs of the divider 550, the other input thereof receiving the output signal of the memory element 549. The output signal of the divider 550 is proportional to the starting acceleration of divider 550 is proportional to the starting acceleration of the mechanism 5 according to expression (12). In its initial state the threshold element 518 is blocked by the positive voltage of the source 104 which is delivered from the bus 115 via the contact 363 (FIG. 5) of the relay 349 and the conducting diode 543 (FIG. 6) to the input resistor 541 of the element 518.

The series connected adder 556, differentiator 557, multiplier 558 and threshold element 559 accomplish expression (14) while the bucket 3 is transported from the breakout point to the damping point, and expression (15) while the bucket 3 is transported from the dumping point to the face-contact point. In the initial state, the output signal of the transducer 12 is fed to the input of the adder 556, and the threshold element 559 is blocked by the positive voltage of the source 104 which is delivered from the bus 115 via the contact 363 (FIG. 5) of the relay 349 and the conducting diode 569 (FIG. 6) to the input resistor 567 of the element 559. The threshold element 577 determines the sign of the speed of the mechanism 5. In the initial state, the threshold element 577 is blocked by the positive voltage of the source 104 which is delivered from the bus 115 via the contact 363 (FIG. 5) of the relay 349, the diode 590 (FIG. 6), an integrating string composed of the resistors 589 and 588 and the capacitor 587, and the conducting diode 585 to the resistor 584 of the threshold element 577.

In its initial state the integrator 493 operates as an initial conditions setter. The output signal of the transducer 18 is delivered via the contact 501 of the relay 160 (FIG. 3) to the input resistor 500 (FIG. 6) of the integrator 493. Thus, the output signal of the integrator 493 in the initial state is proportional to the speed of the mechanism 5.

FIG. 5 is the timing chart $\Omega(t)$ of the signal proportional to the speed of the mechanism 5, the timing chart $U_{159}$ of the output signal of the starting circuit 159 (FIG. 3), the timing chart $U_{363}$ (FIG. 15) of the voltage at the contact 363 of the relay 349, and the timing charts $U_{518}$, $U_{559}$ and $U_{577}$ of the output signals of the threshold elements 518, 559 and 577, respectively.

At the instant C′ (FIG. 15), when the operator presses the button 163 (FIG. 3), the relay 160 operates to disconnect with the contact 501 (FIG. 6) the output of the transducer 18 from the input resistor 500 and to break with the contact 502 the circuit shunting the resistor 498. The capacitor 494 starts discharging into the resistors 497 and 498. The output signal of the integrator continuously decreases from its initial magnitude proportional to the speed of the mechanism 5 at the instant C′ down to zero.

After the bucket 3 is lifted clear of the face at the instant D (FIG. 15), the negative voltage of the source 104 is delivered via the contact 363 (FIG. 5) of the relay 349 to the control windings of the relays 496 (FIG. 6), 528 and 534, and also cuts off the diodes 569 and 542 of the threshold elements 559 and 518, respectively, unblocking the latter two threshold elements. The contacts 552 and 527 of the relay 528 and the contacts 533 of the relay 534 are open, switching the memory elements 549, 517 and 519 to storage duty. Their output signals are maintained constant and equal to the values that were obtained while switching over the contacts 552, 527 and 533.

When the relay 496 operates, its contacts 495 disconnect the resistors 497 and 498 from the feedback circuit of the integrator 493, and the contact 511 of the relay 496 connects the output of the divider 550 to the input of the integrator 493 which is switched to an integrating mode, the output signal of the divider 550 being proportional to the starting acceleration of the mechanism 5. The output signal of the integrator 493 starts increasing.

The negative voltage delivered from the bus 103 of the source 104 via the contact 363 (FIG. 5) of the relay 349 to the integrating string provided at the input of the threshold element 577 (FIG. 6), recharges the capacitor 587, and at the instant the voltage at the point 586 passes through zero the threshold element 577 is unblocked, for the diode 585 blocks the negative signal from the input of the element 577. At the instant of unblocking of the threshold element 577, the output signals of the integrator 493, and hence those of the inverter 513, are not equal to zero so that the unblocked threshold element 577 is in a stable initial state.

The output signal of the memory element 517 proportional to the calculated value of the steady speed of the mechanism 5 at the instant D (FIG. 15) is compared at the threshold element 518 with the linearly increasing output signal of the integrator 493.

At the instant $D_1$ (FIG. 15) of equality of said signals, the threshold element 518 is actuated and, now that the winding 543 is carrying current, the output relay of the element 518 operates, with the contact 546 of the output relay of the element 518 connecting the input of the element 518 to the bus 103 of the source 104. The threshold element 518 is blocked. The contact 512 of the output relay of the element 518 opens to disconnect the output of the divider 550 from the input resistor 510 of the integrator 493, with the result that the output signal of the integrator 493 stops increasing. Its value is proportional to the calculated magnitude of the steady speed of the mechanism 5. The instant $D_2$ (FIG. 15) at which the mechanism 5 starts decelerating, the bucket 3 being transported from the breakout point to the dumping point, is determined in accordance with function (14) when the threshold element 559 and its output relay operate, the winding 572 of said output relay carrying current. The contact 547 of said relay is used to block the element 559 by the negative voltage of the source 104. The contact 506 of the output relay of the threshold element 559 closes, connecting the output of the memory element 519 to the input resistor 503 of the integrator 493.

A signal proportional to the deceleration of the mechanism 5 is fed to the input of the integrator 493, the magnitude of said signal in keeping with expression (13) being proportional to the calculated value of the steady speed of the mechanism 5. The output signal of the integrator 493 starts increasing.

At the instant $D_2$ (FIG. 15) the negative voltage from the bus 103 delivered via the contact 574 of the output relay of the element 559 to the diodes 603 and 606, actuates the relay 525 so that, the diode 606 being cut off, the relay 528 is reset. The contacts 524 of the relay 525 connect the output of the transducer 15 to the input of the adder 556 and to the input of the divider 516. Simultaneously the contacts 527 and 552 of the relay 528 are closed, transferring the memory elements 517 and 549 to the mode of following up the output signals of the divider 516 and the converter 514, respectively, which prepares the system for the operation of transporting the bucket 3 from the dumping point to the face-contact point.

At the instant A (FIG. 15) at which the output signal of the integrator 493 (FIG. 6), and consequently the output signal of the inverter 513, reaches zero, the threshold element 577 and its output relay 564 are actuated, and the element 577 is blocked by the negative voltage of the source 104 which is delivered to the resistor 583 via the switchedover contact 581 of the relay 564 and the conducting diode 582. An unblocking pulse is generated at the output of the threshold element 577, which pulse is delivered via the differentiating string, formed by the resistor 610 and the capacitor 611, to the second windings 544 and 573 of the output relays to the threshold elements 518 and 559, respectively, unblocking and resetting the latter elements. The contact 506 of the output relay of the threshold element 559, which disconnects the output of the memory element 519 from the input resistor 503 of the integrator 493, and the contact 512 of the output relay of the threshold element 518, which connects the input resistor 510 of the integrator 493 with the output of the divider 550, are also reset. A signal proportional to the acceleration of the mechanism 5 arrives at the input of the integrator 493.

At the instant A (FIG. 15) of operation of the threshold element 577, its positive output signal again actuates the relay 528 which opens its contacts 527 and 552 in the circuits of the memory elements 517 and 549, respectively, transferring the latter elements to storage duty. Simultaneously, the diode 613 being cut off by the negative voltage of the source 104 delivered via the contact 581 of the relay 564, the relay 534 is reset to close its contacts 533 in the circuit of the memory element 519, thereby transferring the latter element to the mode of following up the output signal of the memory element 517. The output signal of the integrator 493 starts increasing.

The subsequent steps of the process of determining the steady speed of the mechanism 5 and forming the output signal of the unit 33, with the bucket 3 being transported from the dumping point to the face-contact point, is similar to the process for the operation of transporting the bucket 3 from the breakout point to the dumping point. But the instant at which the mechanism 5 starts decelerating is determined with due regard for the angular deflection of the swinging bucket 3 in a horizontal plane in accordance with expression (15). To this end, at the instant A (FIG. 15) of operation of the threshold element 577 and the relay 564, the contacts 563 of the relay 564 connect the output of the transducer 70 to the input resistor 561 of the adder 556. After the threshold element 559 and its output relay have operated, the output signal of the integrator 493 drops to zero.

Since the output signal of the integrator 493 is invariably of negative polarity, while the output signal of the inverter 513 is invariably of positive polarity, to form the output signal of the unit 33 shaped as two sequential trapezoidal pulses of opposite polarities, the output bus 647 of the unit 33 is connected to the outputs of the inverter 513 and the integrator 493 via the contact 618 of the relay 617. The initial sense of rotation of the platform 6 (FIG. ) of the excavator 1 is set by the operator with a switch, of which the contact 615 (FIG. 6) is connected either to the output of the threshold element 577 or to the contact 581 of the relay 564 commutating the positive bus 115 and the negative bus 103 of the source 104. Thus, with the dragline excavator 1 (FIG. 1) operating in a reversing mode, when the threshold element 577 and the relay 564 operate at the instant A (FIG. 15), the output bus 647 is switched from the output of the inverter 513 to the output of the integrator 493, or vice versa, depending on the position of the contact 615 of the sense of rotation switch of the platform 6 (FIG. 1).

The 360-degree mode of operation of the dragline excavator 1 is set by the operator with a switch, of which the contact 614 (FIG. 6) is connected to the control winding of the relay 505. The voltage from the source 104 delivered via the contact 614 of the switch to the winding of the relay 505 actuates the latter relay so that its contacts 504, 538, 571, 580, 597, 523 and 562 are switched over.

The output of the source 507, the voltage of which is proportional to the maximum rate of motion of the mechanism 5, is connected by the contacts 504 to the input resistor 503 of the integrator 493. The output of the source 507 is also connected by the contact 538 to the input of the divider 550. Hence, the acceleration and deceleration of the mechanism 5 are determined with due regard for the maximum value of the steady speed of the mechanism 5. The threshold element 577 is blocked in its initial state until the end of the automatic cycle by the contacts 580 which disconnect the output of the inverter 513 from the input resistor 579 and connect the blocking positive voltage of the source 104 to the resistor 579. The movable contact 220 (FIG. 4) of the relay 188 is connected to the input resistor 567 of the threshold element 559 via the diode 570 by the contacts 571. The threshold element 559 (FIG. 6) is consequently blocked until the instant A (FIG. 9) at which the speed of the mechanism 2 (FIG. 4) passes through zero. The contacts 523 (FIG. 6) and 562 connect the outputs of the transducers 15 and 70 to the input resistors 560 and 561 of the adder 556. The control winding of the relay 496 is connected by the contacts 597 to the output of the threshold element 591. At the same time, to ensure that the minimal time of program execution by the mechanism 5 is calculated in accordance with expressions (22) and (23), the contacts 123 and 136 of the relay 505 (FIG. 6) are open at the inputs of the adder 89 in the unit 26 (FIG. 3). The control winding of the relay 145 (FIG. 3) is connected by the contacts 158 of the relay 505 (FIG. 6) to the output of the threshold element 217 (FIG. 4).

When the dragline excavator 1 (FIG. 1) operates in a 360-degree mode, the threshold element 591 (FIG. 6) in its initial state is blocked by the negative voltage of the source 104 delivered from the bus 103 via the contact 596 of the relay 349 (FIG. 5) and the conducting diode 595 (FIG. 6) to the input resistor 594. At the instant D (FIG. 9) of operation of the relay 349 (FIG. 5), the threshold element 591 (FIG. 6) is unblocked so that the output signals of the integrator 95 (FIG. 3) and of the adder 89 are compared in accordance with expression (24) at the resistors 592 and 593 of the threshold element 591.

If the mechanism 5 is the limiting one, the threshold element 591 (FIG. 6) is actuated immediately following the unblocking, but if the mechanism 5 is not the limiting one in the operation, the element 591 is actuated at the instant when the diminishing output signal of the integrator 95 (FIG. 3) becomes equal to the output signal of the adder 89 — $T - t$, that is to say the start-up of the mechanism 5 is delayed.

In the 360-degree mode of operation, the steady speed is known in advance to equal the maximum speed of the mechanism 5. Therefore, the threshold element 518 compares the output signal of the integrator 493 with the voltage of the source 507 proportional to the maximum speed of the mechanism 5. As the threshold element 518 and its output relay are actuated, the contacts 512 of the output relay are open and the output signal of the integrator 493 stops increasing. The threshold element 518 is blocked until the bucket 3 has been transported from the dumping point to the face-contact point.

At the instant A (FIG. 9) at which the mechanism 2 changes its direction of motion, the negative voltage of the source 104 delivered from the bus 103 via the contact 220 (FIG. 4) of the relay 188 cuts off the diode 570 (FIG. 6), thereby unblocking the threshold element 559. The instant $A_2$ (FIG. 9) at which the mechanism 5 starts decelerating is determined in accordance with expression (15) when the threshold element 559 and its output relay are actuated, with the contacts 506 of the output relay being closed to connect the output of the source 507 to the input of the integrator 493. The output signal of the integrator 493 drops to zero.

The unit 33 is reset by pressing the button 162 (FIG. 3), which causes all the threshold elements to be blocked in their initial states, as has been noted herein before.

According to the invention, when the excavator operates in a 360-degree mode, at the instant A (FIG. 9) the operation of the units 31 and 33 is synchronized. To this end, the output signal of the threshold element 577 (FIG. 6) is fed to one of the control circuits of the gate 231 (FIG. 4) of the circuit 170. Until the threshold element 577 (FIG. 6) is actuated, that is to say as long as its output signal has a negative polarity, the gate 231 (FIG. 4) remains closed, for the negative output signal of the threshold element 577 (FIG. 6) keeps the diode 245 (FIG. 4) cut off. Therefore, in cases the output signal of the integrator 172 becomes zero before the output signal of the integrator 493 (FIG. 6) at the end of the operation to transport the bucket 3 from the breakout point to the dumping point (instant A in FIG. 9), the output signal of the integrator 172 (FIG. 4) will be maintained equal to zero until the instant the output signal of the threshold element 577 (FIG. 6) reverses its sign and the gate 231 (FIG. 4) of the circuit 170 opens. When the excavator operates in a 360° mode, the contact 247 of the relay 506 (FIG. 6) disconnects the output of the threshold element 577 from the gate 231 (FIG. 4).

Figure 16:
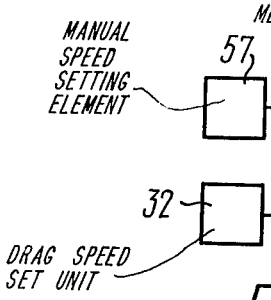
FIG. 16 is a diagram of a gate at the output of the bucket dragging mechanism speed setter, in accordance with the invention.
Figure 17:
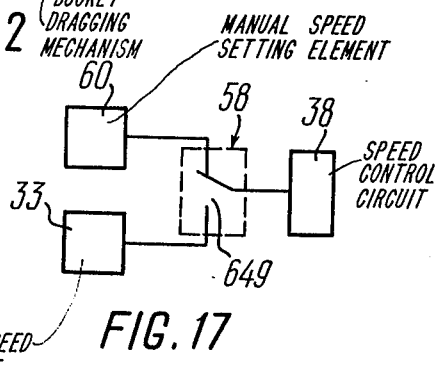
FIG. 17 is a diagram of a gate at the output of the swing mechanism speed setter, in accordance with the invention.
Figure 8:
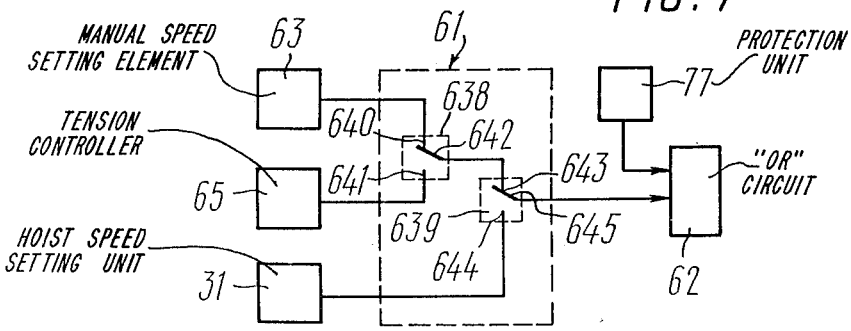
FIG. 8 is a diagram of a gate of the bucket hoisting mechanism speed setter, in accordance with the invention.

The bucket 3 is lowered on the face by operator controlling the mechanisms 2, 4 and 5 with the elements 63, 57 and 60. For this purpose operator observes the movement of the bucket 3 from the dumping point to the face-contact point and at the end of this operation chooses an instant to transfer the system from automatic to manual control (instant B in FIG. 9 and point B in FIG. 10). The system is switched to manual control by pressing the button 162 (FIG. 3), which resets the units 26 (FIG. 1), 31, 32 and 33 together with all their elements. The contacts 648 (FIG. 16) of the relay 160 (FIG. 3) connect the output of the element 57 to one of the inputs of the OR circuit 55 (FIG. 16). The contacts 649 (FIG. 17) of the relay 160 (FIG. 3) connect the output of the element 60 to the input of the circuit 38 (FIG. 17). The contact 645 (FIG. 8) of the relay 348 (FIG. 5) connects the output of the element 63 to the input of the OR circuit 62 (FIG. 8).

Controlling the mechanisms 2 (FIG. 1), 4 and 5 with the elements 63, 57 and 60, the operator lowers the bucket 3 on the face and at the instant B (FIG. 9), at the point B (FIG. 10), presses the button 633 (FIG. 7), simultaneously, with the element 57 (FIG. 1), increasing the speed of the mechanism 4 toward a reduction in length of the drag rope 9. The relay 634 (FIG. 7) is actuated, closing it contact 635 which blocks the button 633, and connecting by the contacts 642 (FIG. 8) and 641 the output of the controller 65 to the input of the OR circuit 62. Simultaneously, the contacts 637 of the relay 634 connect the source 104 to the control winding of the electromagnetic clutch 628 which in turn connects the shaft 20 of the mechanism 4 with the shaft 627 of the synchro 626 of the transducer 619. The output signal of the synchro 626 is rectified by the rectified 629 and fed to the input of the multiplier 624.

The setters 620, 621 and 623, the adders 622 and 625 and the multiplier 624 accomplish expression (25). The output signal of the adder 622 which is proportional to the difference between the initial and final tensions of the hoist rope 8, $S_2 - S_1$, is delivered as the supply voltage to the digging path setter 623. The output of the setter 623 gives out a signal proportional to the quotient $$\frac{S_2 - S_1}{H}$$

which is then multiplied in the multiplier 624 by the output signal of the transducer 619. The output of the adder 625 forms a program of predetermined tension adjustment for the hoist rope 8 during the operation of digging from the predetermined initial tension to the predetermined final tension of the hoist rope 8 as a function of the current digging path.

Watching the bucket 3 being filled, the operator fixes the end of the digging operation by pressing the button 163 (FIG. 3) — instant C in FIG. 9 and point C in FIG. 10. The output of the unit 32 is connected to the OR circuit 55 (FIG. 9) with the help of the contacts 649 (FIG. 9) of the relay 160 (FIG. 3). Simultaneously the contacts 649 (FIG. 17) of the relay 160 (FIG. 3) connect the output of the unit 33 to the circuit 38 (FIG. 17).

The output signal of the unit 32 linearly diminishes, and at the instant C (FIG. 9) when the bucket 3 starts being lifted off the face, the relay 348 (FIG. 5) is actuated to connect via its contacts 645 (FIG. 8) and 644 the output of the unit 31 to the input of the OR circuit 62.

The contact 636 (FIG. 7) of the relay 348 (FIG. 5) breaks the supply circuit of the relay 634 (FIG. 7), resetting the circuit 66.

The blocking contact 635 of the relay 634 and the contact 637 connected to the supply circuit of the electromagnetic clutch 628 are open. The shaft 20 of the mechanism 4 is disconnected from the shaft 627 of the synchro 626 and the latter is reset by the spring 630.

The initial information required to set the predetermined parameters of the digging process on the setters 620, 621 and 623 is obtained by the driver in trial digging runs by the readings of the voltmeters 631 and 632. The operator may adjust the predetermined parameters of the digging process, if same is required, while the bucket 3 is transported either to the dumping point or to the face-contact point.

The protection means 76 ensures that the bucket 3 of the dragline excavator stays clear of the zones *a*, *b* and *c* (FIG. 10). In order to prevent the bucket 3 from getting into the strut zone *b* there is envisaged a limiting path *f* of bucket motion in the form of an elliptic curve characterized by the constant sum of lengths of the hoist rope 8 and the drap rope 9. The actual sum of lengths of the ropes 8 and 9 is measured by an adder.

If the signals produced at the outputs of the gates 54 and 61 are such that the bucket 3 following the path e (FIG. 10) approaches the limiting path *f*, then, at a certain distance therefrom, the output signal of the protection unit 80 starts varying in accordance with law (26). The output signal of the unit 80 is compared with the output signal of the gate 61 in the OR circuit 55, the output signal of which is equal to the least of the signals being compared. Should the output signal of the gate 61 exceed that of the unit 80, the circuit 55 automatically passes the output signal of the unit 80 to the input of the circuit 36, with the result that the path of motion of the bucket is shaped as indicated in FIG. 10 by the section EF. Here the unit 80 (FIG. 2) takes over at the point E (FIG. 10), and at the point F the bucket 3 reaches the limiting path *f* and thence follows it to the dumping point.

Bucket protection against overlifting is effected as a function of the length of the hoist rope 8. When the length of the hoist rope 8 drops to a value defined as the lower limit, the cam mechanism 78 starts moving the slider of the potentiometer 79, linearly varying the output signal of the unit 77 from the value corresponding to the maximum speed of the mechanism 2 down to zero. The output signal of the unit 77 is compared with the output signal of the gate 61 in the circuit 62 which passes to the input of the circuit 32 the least of the signals being compared.

The protection unit 83, which limits the minimal length of the drag 9 and whose output signal is fed of one of the inputs of the circuit 55, operates in a similar manner.

What we claim is:

1. A control device for a dragline excavator comprising a bucket, a hoist rope and a drag rope of said bucket, a platform, a mechanism for hoisting said bucket, a mechanism for dragging said bucket, and a mechanism for swinging said platform of the dragline excavator; wherein all of said mechanisms move the bucket in a digging operation and in the transportation of the bucket to the dumping point and to the point where the bucket is lowered on the face of an excavation; wherein the control device comprises: a transducer for sensing the length increments of said hoist rope as the bucket is transported from the breakout point on the face of said excavation to the dumping point; a transducer for sensing the length increments of said drag rope as the bucket is transported from the breakout point of the face of said excavation to the dumping point; a transducer for sensing the swing angle of said platform as the bucket is transported from the breakout point on the face of said excavation to the dumping point; a transducer for sensing the length increments of the hoist rope as the bucket is transported from the dumping point to the point where it is lowered on the face of said excavation; a transducer for sensing the length increments of the drag rope as the bucket is transported from the dumping point where it is lowered on the face of said excavation; a transducer for sensing the swing angle of the platform as the bucket is transported from the dumping point to the point where it is lowered on the face of said excavation; a transducer for sensing the speed of said bucket hoisting mechanism; a transducer for sensing the speed of said bucket dragging mechanism; a transducer for sensing the speed of said platform swinging mechanism; a speed control unit of the bucket hoisting mechanism for controlling the bucket hoisting mechanism; a speed control unit of the bucket dragging mechanism for controlling the bucked dragging mechanism; a speed control unit of the platform swinging mechanism for controlling the platform swinging mechanism; a bucket transportation time calculator unit having a plurality of inputs and an output; said inputs of the bucket transportation time calculator being connected to the output of said hoist rope length increment transducer as the bucket is transported from the breakout point on the face of said excavation to the dumping point, to the output of said drag rope length increment transducer as the bucket is transported from the breakout point on the face of said excavation to the dumping point, to the output of said platform swing angle transducer as the bucket is transported from the breakout point on the face of said excavation to the dumping point, to the output of said hoist rope length increment transducer as the bucket is transported from the dumping point to the point where it is lowered on the face of said excavation, to the output of said drag rope length increment transducer as the bucket is transported from the dumping point to the point where it is lowered on the face of said excavation, to the output of said platform swing angle transducer as the bucket is transported from the dumping point to the point where it is lowered on the face of said excavation, to the output of said bucket hoisting mechanism speed transducer, and to the output of said bucket dragging mechanism speed transducer; a bucket hoisting mechanism speed setter unit having a plurality of inputs and outputs; the first input of said setter being connected to the output of said bucket transportation time calculator, the second input of said setter being connected to the output of said hoist rope length increment transducer as the bucket is transported from the breakout point to the dumping point, the third input of said setter being connected to the output of said hoist rope length increment transducer as the bucket is transported from the dumping point to the point where it is lowered on the face of said excavation, and the fourth input of said setter being connected to the output of said bucket hoisting mechanism speed transducer, said output of the bucket hoisting mechanism speed setter being connected to said bucket hoisting mechanism speed control unit; a manual speed setting element of the dragging mechanism; a bucket dragging mechanism speed setter unit having a plurality of inputs and an output, the first input of said bucket dragging mechanism speed setter being connected to the output of said bucket transportation time calculator, the second input being connected to the output of said drag rope length increment transducer as the bucket is transported from the breakout point to the dumping point, the third input being connected to the output of said hoist rope length increment transducer as the bucket is transported from the breakout point to the dumping point, the fourth input being connected to the output of said drag rope length increment transducer as the bucket is transported from the dumping point to the point where it is lowered on the face of said excavation, the fifth input being connected to the output of said hoist rope length increment transducer as the bucket is transported from the dumping point to the point where it is lowered on the face of said excavation, the sixth input being connected to the output of said manual speed setting element of the dragging mechanism, the seventh input being connected to the output of said bucket hoisting mechanism speed setter, and said output of the bucket dragging mechanism speed setter being connected to said bucket dragging mechanism speed control unit; a platform swinging mechanism speed setter unit having a plurality of inputs and an output; the first input of said platform swinging mechanism speed setter being connected to the output of said bucket transportation time calculator, the second input of said platform swinging mechanism speed setter being connected to the output of said platform swing angle transducer as the bucket is transported from the breakout point to the dumping point, the third input of said platform swinging mechanism speed setter being connected to the output of said platform swing angle transducer as the bucket is transported from the dumping point to the point where it is lowered on the face of said excavation, the fourth input of said platform swinging mechanism speed setter being coupled to the output of said platform swinging speed transducer, and the output of said platform swinging mechanism speed setter being connected to said platform swinging mechanism speed contol unit.

2. A device as recited in claim 1, further comprising: a hoist rope tension transducer; a hoist rope tension setting circuit; a hoist rope tension controller having a plurality of inputs and an output; one input of said controller connected to the output of said hoist rope tension transducer; the other input of said controller connected to the output of said hoist rope tension setting circuit; a first gate having an input connected to the output of said tension controller and to the output of said hoisting mechanism speed setter; the input of said hoisting mechanism speed control unit connected to the output of said hoisting mechanism speed transducer; the input of said dragging mechanism speed control unit connected to the output of said dragging mechanism speed transducer; the input of said platform swinging mechanism speed control unit connected to the output of said platform swinging mechanism speed transducer; a manual speed setting element of the dragging mechanism; a manual speed setting element of the platform swinging mechanism; a second gate having a plurality of inputs and an output; one input of said second gate connected to the output of said manual speed setting element of the swinging mechanism and to the output of said swinging mechanism speed setter unit; the second input of said swinging mechanism speed control unit connected to the output of said second gate; a first OR circuit having a plurality of inputs and an output; one input of said first OR circuit connected to the output of the third gate; the other input of said first OR circuit connected to the output of said dragging mechanism speed setter unit; the output of said first OR circuit connected to the second input of the dragging mechanism speed control unit; a second OR circuit having a plurality of inputs and outputs; the input of said second OR circuit connected to the output of said first gate; the output of said second OR circuit connected to the input of said hoisting mechanism speed control unit.

3. A device as recited in claim 2, further comprising: a transducer for sensing the hoist rope length at the bucket dumping point, the output thereof being connected to the input of said bucket transportation time calculator and to the input of said dragging mechanism speed setter; a hoist rope overall length transducer connected to the input of said swinging mechanism speed setter; a drag rope overall length transducer connected to the input of said swinging mechanism speed setter; a transducer for sensing the angular deflection of the bucket in a horizontal plane, said angular deflection transducer being connected to the input of said swinging mechanism speed setter, the output of which is connected to the input of said bucket transportation time calculator.

4. A device as recited in claim 2, further comprising: protection means for the hoisting and dragging mechanisms having a plurality of inputs and outputs; the inputs of said protection means connected to the outputs of said hoisting and dragging mechanisms; one output of said protection means connected to the second input of said second OR circuit, the second and third outputs of said protection means connected respectively to the second and third inputs of said first OR circuit.

5. A device as recited in claim 4, wherein said protection means comprises: a protection unit of hoisting mechanism program speed setting; the input of said protection unit connected to said hoisting mechanism; the output of said protection unit connected to the second input of said second OR circuit; a mechanical adder having inputs connected to said hoisting and dragging mechanisms; two protection units of dragging mechansim program speed setting; the input of the first protection unit connected to the output of said mechanical adder, the output of said first protection unit connected to the second input of said first OR circuit, the input of the second protection unit connected to said dragging mechanism, and the output of said second protection unit connected to the third input of said first OR circuit.

6. A device as recited in claim 3, wherein said bucket transportation time calculator includes means for determining the minimal possible times of operation of each of the three mechanisms and selects the maximum out of said three time values; said time calculator comprises: three adders connected in parallel and each having a plurality of inputs and an output; the inputs of the first adder being connected to the output of said hoist rope length increment transducer as the bucket is transported from the breakout point to the dumping point, to the output of said hoist rope length increment transducer as the bucket is transported from the dumping point to the point where it is lowered on the face of said excavation, and to the output of said hoisting mechanism speed transducer; the inputs of said second adder being connected to the output of said drag rope length increment transducer as the bucket is transported from the breakout point to the dumping point, to the output of said drag rope length increment transducer as the bucket is transported from the dumping point to the point where it is lowered on the face of said excavation, to the output of said dragging mechanism speed transducer and to the output of said transducer sensing the hoist rope length at the dumping point; the inputs of said third adder being connected to the output of said platform swing angle transducer as the bucket is transported from the breakout point to the dumping point, to the output of said platform swing angle transducer as the bucket is transported from the dumping point to the point where it is lowered on the face of said excavation, and to the second output of said swinging mechanism speed setter; a maximum displacement value selector, the inputs of which are connected to the outputs of said adders; a bucket transportation time signal-shaper, the inputs of which are connected to the output of said maximum displacement value selector.

7. A device as recited in claim 6, wherein said transportation time signal shaper comprises: a first integrator and a second integrator connected in parallel and each having an input and an output; the inputs of said integrators connected to the output of said maximum displacement value selector; and a relay means for forming the times of bucket transportation from the breakout point to the dumping point and from the dumping point to the point where the bucket is lowered on the face of said excavation, the contacts of said relay being connected at the outputs of said integrators.

8. A device as recited in claim 6, wherein said bucket transportation time calculator comprises a starting circuit, the outputs thereof being connected to said dragging mechanism speed setter unit.

9. A device as recited in claim 6, wherein said hoisting mechanism speed setter comprises a circuit for determining the steady speed of the hoisting mechanism, the inputs thereof being connected to the output of said transportation time signal shaper, to the output of said hoist rope length increment transducer as the bucket is transported from the breakout point to the dumping point, and to the output of said hoist rope length increment transducer as the bucket is transported from the dumping point to the point where it is lowered on the face of said excavation; a circuit for determining the instant at which the hoisting mechanism starts decelerating, the inputs of which are connected to the output of said hoist rope length increment transducer as the bucket is transported from the breakout point to the dumping point, and to the output of said hoist rope length increment transducer as the bucket is transported from the dumping point to the point where it is lowered on the face of said excavation; a circuit for determining the sense of rotation of the hoisting mechanism; a logic circuit having a plurality of inputs and an output; the inputs of said logic circuit connected to the outputs of said circuit for determining the steady speed of the hoisting mechanism, to the outputs of said circuit for determining the instant at which the hoisting mechanism starts decelerating, and to the outputs of said circuit for determining the sense of rotation of the hoisting mechanism; and a hoisting mechanism predetermined speed signal shaper having two inputs and two outputs; the first input of said shaper connected to the output of said logic circuit; the second input of said shaper connected to the output of said hoisting mechanism speed transducer; the first output of said shaper connected to the input of said circuit for determining the sense of rotation of the hoisting mechanism; the second output of said shaper connected to the input of said circuit for determining the steady speed of the hoisting mechanism and to the input of the circuit for determining the instant at which the hoisting mechanism starts decelerating.

10. A device as recited in claim 7, wherein said hoisting mechanism speed setter comprises a circuit for determining the steady speed of the hoisting mechanism having inputs connected to the output of said transportation time signal shaper, to the output of said hoist rope length increment transducer as the bucket is transported from the breakout point to the dumping point, and to the output of said hoist rope length increment transducer as the bucket is transported from the dumping point to the point where it is lowered on the face of said excavation; a circuit for determining the instant at which the hoisting mechanism starts decelerating having inputs connected to the output of said hoist rope length increment transducer as the bucket is transported from the breakout point to the dumping point, and to the output of said hoist rope length increment transducer as the bucket is transported from the dumping point to the point where it is lowered on the face of said excavation; a circuit for determining the sense of rotation of the hoisting mechanism; a logic circuit having a plurality of inputs and an output; the inputs of said logic circuit connected to the outputs of said circuit for determining the steady speed of the hoisting mechanism, to the outputs of said circuit for determining the instant at which the hoisting mechanism starts decelerating, and to the outputs of said circuit for determining the sense of rotation of the hoisting mechanism; and a hoisting mechanism predetermined speed signal shaper having two inputs and two outputs; the first input of said shaper connected to the output of said logic circuit; the second input of said shaper connected to the output of said hoisting mechanism speed transducer; the first output of said shaper is connected to the input of said circuit for determining the sense of rotation of the hoisting mechanism; the second output of said shaper connected to the input of said circuit for determining the steady speed of the hoisting mechanism and to the input of said circuit for determining the instant at which the hoisting mechanism starts decelerating.

11. A device as recited in claim 9, wherein said hoisting mechanism predetermined speed signal shaper comprises: an integrator having an input connected to the output of said logic circuit and an output connected to the input of said circuit for determining the sense of rotation of the hoisting mechanism; a circuit for setting the initial conditions of said integrator, said circuit being connected to the output of said hoisting mechanism speed transducer; an inverter having an input connected to the output of said integrator; a first diode and a second diode poled in opposition and having a common point of connection; said first and second diodes connected in parallel with said inverter; said common point of said diodes producing a signal proportional to the negative modulus of the predetermined speed of the hoisting mechanism.

12. A device as recited in claim 10, wherein said hoisting mechanism predetermined speed signal shaper comprises: an integrator having an input connected to the output of said logic circuit and an output connected to the input of said circuit for determining the sense of rotation of the hoisting mechanism; a circuit for setting the initial conditions of said integrator, said circuit being connected to the output of said hoisting mechanism speed transducer; an inverter having an input connected to the output of said integrator; a first diode and a second diode poled in opposition and having a common point of connection; said first and second diodes connected in parallel with said inverter; said common point of connection of said diodes for producing a signal proportional to the negative modulus of the predetermined speed of the hoisting mechanism.

13. A device as recited in claim 11, wherein said circuit for determining the steady speed of the hoisting mechanism comprises: an adder having one input connected to the output of said bucket transportation time signal shaper, and a second input connected to said common point of said diodes; a multiplier having one input connected to the output of said adder and a second input connected to said common point of said diodes; a threshold element having one input connected to the output of said multiplier; a relay with contacts; a second input of said threshold element being connected via said contacts to the output of said hoist rope length increment transducer as the bucket is transported from the breakout point to the dumping point, and to the output of said hoist rope length increment transducer as the bucket is transported from the dumping point to the point where it is lowered on the face of said excavation; the output of said threshold element connected to the input of said logic circuit; an inverter element having an input connected to the output of said threshold element and an output connected to the input of said logic circuit.

14. A device as recited in claim 12, wherein said circuit for determining the steady speed of the hoisting mechanism comprises: an adder having one input connected to the output of said bucket transportation time signal shaper, and a second input connected to said common point of said diodes; a multipler having one input connected to the output of said adder, and a second input connected to said common point of said diodes; a threshold element having one input connected to the output of said multiplier; a relay with contacts; a second input of said threshold element being coupled via said contacts to the output of said hoist rope length increment transducer as the bucket is transported from the breakout point to the dumping point, and to the output of said hoist rope length increment transducer as the bucket is transported from the dumping point to the point where it is lowered on the face of said excavation; the output of said threshold element connected to the input of said logic circuit; and an inverter element having an input connected to the output of said threshold element and an output connected to the input of said logic circuit.

15. A device as recited in claim 11, wherein said circuit for determining the instant at which the hoisting mechanism starts decelerating comprises: a squarer having an input connected to said common point of the diodes; a threshold element having one input connected to the output of said squarer and a second input connected to the output of said hoist rope length increment transducer as the bucket is transported from the breakout point to the dumping point, and to the output of said hoist rope length increment transducer as the bucket is transported from the dumping point to the point where it is lowered on the face of said excavation, the output of said threshold element being connected to the input of said logic circuit; an inverter element having an input connected to the output of said circuit for determining the instant at which the hoisting mechanism starts decelerating and an output connected to the input of said logic circuit.

16. A device as recited in claim 14, wherein said circuit for determining the initial instant of deceleration comprises: a squarer having an input connected to said common point of the diodes; a threshold element having one input connected to the output of said squarer and a second input coupled via said contacts of the relay to the output of said hoist rope length increment transducer as the bucket is transported from the breakout point to the dumping point, and to the output of said hoist rope length increment transducer as the bucket is transported from the dumping point to the point where it is lowered on the face of said excavation, the output of said threshold element being connected to the input of said logic circuit; an inverter element having an input connected to the output of said threshold element of said circuit for determining the initial instant of deceleration and an output connected to the input of said logic circuit.

17. A device as recited in claim 11, wherein said circuit for determining the sense of rotation of the hoisting mechanism comprises: a threshold element having an input connected to the output of said integrator of the hoisting mechanism predetermined speed signal shaper and an output connected to the input of said logic circuit; and an inverter element having an input connected to the output of said circuit for determining the sense of rotation and an output connected to the input of said logic circuit of the hoisting mechanism speed setter.

18. A device as recited in claim 16, wherein said circuit for determining the sense of rotation of the hoisting mechanism comprises a threshold element having an input connected to the output of said integrator of the hoisting mechanism predetermined speed signal shaper and an output connected to the input of said logic circuit, and an inverter element having an input connected to the output of said threshold element of said circuit for determining the sense of rotation, the output of said inverter element connected to the input of said logic circuit of the hoisting mechanism speed setter.

19. A device as recited in claim 11, wherein said logic circuit of the hoisting mechanism speed setter comprises a source of reference voltage and four gates, each gate having a main input and a plurality of control circuits; said main input of each gate connected to the output of said reference voltage source; said control circuits of the first gate connected to the output of said dragging mechanism speed setter, to the output of said circuit for determining the steady speed of the hoisting mechanism, and to the output of said circuit for determining the sense of rotation of the hoisting mechanism; said control circuits of the second gate connected to the output of said circuit for determining the instant at which the hoisting mechanism starts decelerating and to the output of said circuit for determining the sense of rotation of the hoisting mechanism; one of said control circuits of the third gate connected to the output of said circuit for determining the steady speed of the hoisting mechanism; another of said control circuits of the third gate connected to the output of said circuit for determining the sense of rotation of the hoisting mechanism; said control circuits of the fourth gate connected to the output of said circuit for determining the instant at which the hoisting mechanism starts decelerating and to the output of said circuit for determining the sense of rotation of the hoisting mechanism.

20. A device as recited in claim 18, wherein said logic circuit of the hoisting mechanism speed setter comprises a reference voltage source and four gates, each gate having a main input and a plurality of control circuits; said main input of each gate connected to the output of said reference voltage source; said control circuits of the first gate connected to the output of said dragging mechanism speed setter, to the output of said inverter element of the circuit for determining the steady speed of the hoisting mechanism and to the output of said threshold element of the circuit for determining the sense of rotation of the hoisting mechanism; said control circuits of the second gate connected to the output of said inverter element of the circuit for determining the instant at which the hoisting mechanism starts decelerating and to the output of said inverter element of the circuit for determining the sense of rotation of the hoisting mechanism; one of said control circuits of the third gate connected to the output of said threshold element of the circuit for determining the steady speed of the hoisting mechanism; another of said control circuits of the third gate being connected to the output of said threshold element of the circuit for determining the sense of rotation of the hoisting mechanism; said control circuits of the fourth gate connected to the output of said threshold element of the circuit for determining the instant at which the hoisting mechanism starts decelerating and to the output of said inverter element of the circuit for determining the sense of rotation of the hoisting mechanism.

21. A device as recited in claim 6, wherein said dragging mechanism speed setter unit comprises: a circuit for determining the steady speed of the dragging mechanism having inputs connected to the output of said bucket transportation time calculator, to the output of said drag rope length increment transducer as the bucket is transported from the breakout point to the dumping point, to the output of said transducer sensing the hoist rope length at the dumping point, and to the output of said drag rope length increment transducer as the bucket is transported from the dumping point to the point where it is lowered on the face of said excavation; a circuit for determining the initial instant of deceleration of the dragging mechanism having inputs connected to the output of said drag rope length increment transducer as the bucket is transported from the breakout point to the dumping point, and to the output of said drag rope length increment transducer as the bucket is transported from the dumping point to the point where it is lowered on the face of said excavation; a circuit for determining the sense of rotation of the dragging mechanism; a starting circuit; a dragging mechanism motion delay circuit having inputs connected to the output of said drag rope length increment transducer as the bucket is transported from the breakout point to the dumping point, to the output of said transducer for sensing the hoist rope length at the dumping point, and to the output of said hoist rope length increment transducer as the bucket is transported from the breakout point to the dumping point; a circuit for accelerating the dragging mechanism speed in bucket unloading having three inputs and an output; the first input of said circuit for accelerating the dragging mechanism speed connected to the output of said hoist rope length increment transducer as the bucket is transported from the breakout point to the dumping point; a logic circuit having inputs connected to the outputs of said circuit for determining the steady speed of the dragging mechanism, to the outputs of said circuit for determining the instant at which the dragging mechanism starts decelerating, to the outputs of said circuit for determining the sense of rotation of the dragging mechanism, to the output of said starting circuit, to the outputs of said dragging mechanism motion delay circuit, and to the output of said circuit for accelerating the dragging mechanism speed; a dragging mechanism predetermined speed signal shaper having a plurality of inputs and three outputs; the inputs of said shaper connected to the output of said logic circuit, to the output of said manual speed setting element of the dragging mechanism and to the output of the circuit for determining the sense of rotation of the dragging mechanism; the first output of said shaper connected to the input of said circuit for determining the sense of rotation of the dragging mechanism, to the input of the starting circuit, and to the input of the circuit for determining the steady speed of the dragging mechanism; the second output of said shaper connected to the input of said circuit for determining the steady speed of the dragging mechanism, the third output of the shaper connected to the inputs of said circuit for determining the steady speed of the dragging mechanism and to the input of said circuit for determining the instant at which the dragging mechanism starts decelerating.

22. A device as recited in claim 21, wherein said dragging mechanism speed setter unit comprises a circuit for determining whether or not the dragging mechanism is maneuvered in order to prevent slackening of the drag rope as the bucket is transported from the dumping point to the point where it is lowered on the face of said excavation, the inputs of said maneuver determining circuit connected to the output of said hoist rope length increment transducer as the bucket is transported from the dumping point to the point where it is lowered on the face of said excavation, to the output of said drag rope length increment transducer as the bucket is transported from the dumping point to the point where it is lowered on the face of said excavation, and to the output of said circuit for accelerating the dragging mechanism speed in bucket unloading; the second input of said circuit for accelerating the dragging mechanism speed connected to the output of said hoist rope length increment transducer as the bucket is transported from the dumping point to the point where it is lowered on the face of said excavation; the third input of said dragging mechanism speed accelerating circuit connected to the output of said drag rope length increment transducer as the bucket is transported from the dumping point to the point where it is lowered on the face of said excavation in order to fix the instant at which the dragging mechanism stops maneuvering as the bucket is transported from the dumping point to the point where it is lowered on the face of said excavation; the output of said dragging mechanism maneuver determining circuit connected to the input of said logic circuit of the dragging mechanism speed setter.

23. A device as recited in claim 7, wherein said dragging mechanism speed setter unit comprises: a circuit for determining the steady speed of the dragging mechanism having inputs connected to the output of said bucket transportation time calculator, to the output of said drag rope length increment transducer as the bucket is transported from the breakout point to the dumping point, to the output of said transducer for sensing the hoist rope length at the dumping point, and to the output of said drag rope length increment transducer as the bucket is transported from the dumping point to the point where it is lowered on the face of said excavation; a circuit for datermining the instant at which the dragging mechanism starts decelerating having inputs connected to the output of said drag rope length increment transducer as the bucket is transported from the breakout point to the dumping point, and to the output of said drag rope length increment transducer as the bucket is transported from the dumping point to the point where it is lowered on the face of said excavation; a circuit for determining the sense of rotation of the dragging mechanism; a starting circuit; a dragging mechanism motion delay circuit having inputs connected to the output of said drag rope length increment transducer as the bucket is transported from the breakout point to the dumping point, to the output of said transducer for sensing the hoist rope length at the dumping point, and to the output of said hoist rope length increment transducer as the bucket is transported from the breakout point to the dumping point; a circuit for accelerating the dragging mechanism speed during bucket unloading having three inputs and an output; the first input connected to the output of said hoist rope length increment transducer as the bucket is transported from the breakout point to the dumping point; a logic circuit having inputs connected to the outputs of said circuit for determining the steady speed of the dragging mechanism, to the outputs of said circuit for determining the instant at which the dragging mechanism starts decelerating, to the outputs of said circuit for determining the sense of rotation of the dragging mechanism, to the output of said starting circuit, to the outputs of said dragging mechanism motion delay circuit, and to the output of said dragging mechanism speed accelerating circuit; a dragging mechanism predetermined speed signal shaper having a plurality of inputs and three outputs; the inputs of said shaper connected to the output of said logic circuit, to the output of said manual speed setting element of the dragging mechanism and to the output of the circuit for determining the sense of rotation of the dragging mechanism; the first output of said shaper connected to the input of said circuit for determining the sense of rotation of the dragging mechanism, to the input of the starting circuit, and to the input of the circuit for determining the steady speed of the dragging mechanism; the second output of said shaper connected to the input of said circuit for determining the steady speed of the dragging mechanism and the third output of said shaper connected to the inputs of said circuit for determining the steady speed of the dragging mechanism and to the input of said circuit for determining the instant at which the dragging mechanism starts decelerating.

24. A device as recited in claim 9, wherein said dragging mechanism speed setter unit comprises: a circuit for determining the steady speed of the dragging mechanism having inputs connected to the output of said bucket transportation time calculator, to the output of said drag rope length increment transducer as the bucket is transported from the breakout point to the dumping point, to the output of said transducer for sensing the hoist rope length at the dumping point, and to the output of said drag rope length increment transducer as the bucket is transported from the dumping point to the point where it is lowered on the face of said excavation; a circuit for determining the instant at which the dragging mechanism starts decelerating having inputs connected to the output of said drag rope length increment transducer as the bucket is transported from the breakout point to the dumping point, and to the output of said drag rope length increment transducer as the bucket is transported from the dumping point to the point where it is lowered on the face of said excavation; a circuit for determining the sense of rotation of the dragging mechanism; a starting circuit; a dragging mechanism motion delay circuit having inputs connected to the output of said drag rope length increment transducer as the bucket is transported from the breakout point to the dumping point, to the output of said transducer sensing the hoist rope length at the dumping point, and to the output of said hoist rope length increment transducer as the bucket is transported from the breakout point to the dumping point; a circuit for accelerating the dragging mechanism speed during bucket unloading having three inputs and three outputs; the first input of said accelerating circuit connected to the output of said hoist rope length increment transducer as the bucket is transported from the breakout point to the dumping point; a logic circuit having inputs connected to the outputs of said circuit for determining the steady speed of the dragging mechanism, to the outputs of said circuit for determining the instant at which the dragging mechanism starts decelerating, to the outputs of said circuit for determining the sense of rotation of the dragging mechanism, to the output of said starting circuit, to the outputs of said dragging mechanism motion delay circuit, and to the output of said dragging mechanism speed ascelerating circuit; a dragging mechanism predetermined speed signal shaper having a plurality of inputs and three outputs; the inputs of said shaper connected to the output of said logic circuit, to the output of said manual speed setting element of the dragging mechanism, and to the output of the circuit for determining the sense of rotation of the dragging mechanism; the first output of said shaper connected to the input of said circuit for determining the sense of rotation of the dragging emchanism, to the input of the starting circuit and to the input of the circuit for determing the steady speed of the dragging mechanism; the second output of said shaper connected to the input of said circuit for determining the steady speed of the dragging mechanism, and the third output of said shaper connected to the inputs of said circuit for determining the steady speed of the dragging mechanism and to the input of said circuit for determining the instant at which the dragging mechanism starts decelerating.

25. A device as recited in claim 19, wherein said dragging mechanism speed setter unit comprises: a circuit for determining the steady speed of the dragging mechanism having inputs connected to the output of said bucket transportation time calculator, to the output of said drag rope length increment transducer as the bucket is transported from the breakout point to the dumping point, to the output of said transducer for sensing the hoist rope length at the dumping point, and to the output of said drag rope length increment transducer as the bucket is transported from the dumping point to the point where it is lowered on the face of said excavation; a circuit for determining the instant at which the dragging mechanism starts decelerating having inputs connected to the output of said drag rope length increment transducer as the bucket is transported from the breakout point to the dumping point, and to the output of said drag rope length increment transducer as the bucket is transported from the dumping point to the point where it is lowered on the face of said excavation; a circuit for determining the sense of rotation of the dragging mechanism; a starting circuit; a dragging mechanism motion delay circuit having inputs connected to the output of said drag rope length increment transducer as teh bucket is transported from the breakout point to the dumping point, to the output of said transducer for sensing the hoist rope length at the dumping poijt, and to the output of said hoist rope length increment transducer as the bucket is trnasported from the breakout point to the dumping point; a circuit for accelerating the dragging mechanism speed in bucket unloading having three inputs and an output; the first input of said forcing circuit connected to the output of said hoist rope length increment transducer as the bucket is transported from the breakout point to the dumping point; a logic circuit having inputs connected to the outputs of said circuit for determining the steady speed of the dragging mechanism, to the outputs of said circuit for determining the instant at which the dragging mechanism starts decelerating, to the outputs of said circuit for determining the sense of rotation of the dragging mechanism, to the output of said starting circuit, to the outputs of said dragging mechanism motion delay circuit, and to the output of said dragging mechanism speed accelerating circuit; a dragging mechanism predetermined speed signal shaper having a plurality of inputs and three outputs; the inputs of said shaper connected to the output of said logic circuit, to the output of said manual speed setting element of the dragging mechanism, and to the output of the circuit for determining the sense of rotation of the dragging mechanism; the first output of said shaper connected to the input of said circuit for determining the sense of rotation of the dragging mechanism, to the input of the starting circuit, and to the input of the circuit for determining the steady speed of the dragging mechanism; the second output of said shaper connected to the input of said circuit for determining the steady speed of the dragging mechanism; and the third output of said shaper connected to the inputs of said circuit for determining the steady speed of the dragging mechanism and to the input of said circuit for determining the instant at which the dragging mechanism starts decelerating.

26. A device as recited in claim 21, wherein said dragging mechanism predetermined speed signal shaper comprises: an integrator having an input connected to the output of said logic circuit of the dragging mechanism speed setter; an initial conditions setting circuit fo said integrator connected to the output of said manual speed setting element of the dragging mechanism; a feedback circuit of said integrator; a diode limiter connector to said integrator feedback circuit; an inverter having an input connected to the output of said integrator; a third diode and a fourth diode connected in opposition and having a common point; said thrid and fourth diodes connected in parallel with said inverter; said common point of the diodes for producing a signal proportional to the negative modulus of the predetermined mechanism speed value.

27. A device as recited in claim 23, wherein said dragging mechanism predetermined speed signal shaper comprises: an integrator having an input connected to the output of said logic circuit of the dragging mechanism speed setter; an initial conditions setting circuit of said integrator connected to the output of said manual speed setting element of the dragging mechanism; a feedback circuit of said integrator; a diode limiter connected to said integrator feedback circuit; an inverter having an input connected to the output of said integrator; a third diode and a fourth diode poled in opposition and having a common point; said third and fourth diodes connected in parallel with said inverter; said common point of the diodes for producing a signal proportional to the negative modulus of the predetermined speed value of the mechanism.

28. A device as recited in claim 24, wherein said dragging mechanism predetermined speed signal shaper comprises: an integrator having an input connected to the output of said logic circuit of the dragging mechanism speed setter; an initial conditions setting circuit of said integrator connected to the output of said manual speed setting element of the dragging mechanism; a feedback circuit of said integrator; a diode limiter connected into said integrator feedback circuit; an inverter having an input connected to the output of said integrator; a third diode and a fourth diode poled in opposition and having a common point; said third and fourth diodes connected in parallel with said inverter; said common point of the diodes for producing a signal proportional to the negative modulus of the predetermined speed value of the mechanism.

29. A device as recited in claim 26, wherein said dragging mechanism predetermined speed signal shaper comprises a source of reference voltage and a maximum signal selector circuit having two inputs and an output; one input of said maximum signal selection circuit connected to the output of said manual speed setting element of the dragging mechanism, the output input of said maximum signal selection circuit connected to the output of said reference voltage source; said maximum signal selection circuit including means for ensuring that during the period the bucket is being lifted off the face of said excavation the dragging mechanism receives a minimal setting signal, the signal produced by said manual speed setting element of the dragging mechanism being smaller than the signal generated by said reference voltage source.

30. A device as recited in claim 27, wherein said circuit for determining the steady speed of the dragging mechanism comprises: an adder having one input connected to the output of said bucket transportation time signal shaper and another input connected to said common point of the diodes of said dragging mechanism predetermined speed signal shaper; a multiplier having two inputs and an output, the first input of said multiplier being connected to the output of said adder; a relay having contacts; the second input of said multiplier coupled via the contacts of said relay to the output of said integrator of the dragging mechanism predetermined speed signal shaper and to the output of said inverter of said shaper; a threshold element having two inputs and an output; the first input of said threshold element connected to the output of said multiplier; the output of said threshold element connected to the input of said logic circuit of the dragging mechanism speed setter; a commutator having inputs connected to the output of said drag rope length increment transducer as the bucket is transported from the breakout point to the dumping point, to the output of said transducer sensing the hoist rope length at the dumping point, and to the output of said drag rope length increment transducer as the bucket is transported from the dumping point to the point where it is lowered on the face of said excavation; the output of said commutator connected to the second input of said threshold element; an inverter element connected in series with said threshold element; the output of the inverter element being connected to the input of said logic circuit of the dragging mechanism speed setter.

31. A device as recited in claim 28, wherein said circuit for determining the steady speed of the dragging mechanism comprises: an adder having one input connected to the output of said bucket transportation time signal shaper and another input connected to said common point of the diodes of said dragging mechanism predetermined speed signal shaper; a multiplier having two inputs and an output, the first input of said multiplier being connected to the output of said adder; a relay having contacts; the second input of said multiplier coupled via the contacts of said relay to the output of said integrator of said dragging mechanism predetermined speed signal setter and to the output of said inverter of said shaper; a threshold element having two inputs and an output; the first input of said threshold element connected to the output of said multiplier; the output of said threshold element connected to the input of said logic circuit of the dragging mechanism speed setter; a commutator having inputs connected to the output of said drag rope length increment transducer as the bucket is transported from the breakout point to the dumping point, to the output of siad transducer for sensing the hoist rope length at the dumping point, and to the output of said drag rope length increment transducer as the bucket is transported from the dumping point to the point where it is lowered on the face of said excavation; the output of said commutator connected to the second input of said threshold element; an inverter element connected in series with said threshold element; the output of said inverter element connected to the input of said logic circuit of the dragging mechanism speed setter.

32. A device as recited in claim 27, wherein said circuit for determining the instant at which the dragging mechanism starts decelerating comprises: a squarer having an input connected to said common point of said third and fourth diodes; a second relay having contacts; a threshold element having two inputs; the first input of said threshold element connected to the output of said inverter; the second input of said threshold element coupled via the contacts of said second relay to the output of said drag rope length increment transducer as the bucket is transported from the breakout point to the dumping point and to the output of said drag rope length increment transducer as the bucket is transported from the dumping point to the point where it is lowered on the face of said excavation; the output of said threshold element connected to the input of said logic circuit of the dragging mechanism speed setter; an inverter element connected in series with said threshold element, the output of said inverter element being connected to the input of said logic circuit of the dragging mechanism speed setter.

33. A device as recited in claim 31, wherein said circuit for determining the instant at which the dragging mechanism starts decelerating comprises: a squarer having an input coupled to said common point of said third and fourth diodes; a second relay having contacts; a threshold element having two inputs; the first input of said threshold element connected to the output of said inverter; the second input of said threshold element coupled via the contacts of said second relay to the output of said drag rope length increment transducer as the bucket is transported from the breakout point to the dumping point and to the output of said drag rope length increment transducer as the bucket is transported from the dumping point to the point where it is lowered on the face of said excavation; the output of said threshold element connected to the input of said logic circuit of the dragging mechanism speed setter; an inverter element series-connected with said threshold element, the output of said inverter element being connected to the input of said logic circuit of the dragging mechanism speed setter.

34. A device as recited in claim 21, wherein said circuit for determining the sense of rotation of the dragging mechanism comprises a threshold element and an inverter element interconnected in series.

35. A device as recited in claim 33, wherein said circuit for determining the sense of rotation of the dragging mechanism comprises a threshold element and an inverter element interconnected in series.

36. A device as recited in claim 33, wherein said circuit for determining the sense of rotation of the dragging mechanism comprises a threshold element and an inverter element interconnected in series.

37. A device as recited in claim 21, wherein said starting circuit of said dragging mechanism speed setter comprises a threshold element and an inverter element interconnected in series.

38. A device as recited in claim 27, wherein said starting circuit of said dragging mechanism speed setter comprises a threshold element and an inverter element interconnected in series.

39. A device as recited in claim 36, wherein said starting circuit of said dragging mechanism speed setter comprises a threshold element and an inverter element interconnected in series.

40. A device as recited in claim 21, wherein said dragging mechanism motion delay circuit comprises a threshold element and an inverter element interconnected in series.

41. A device as recited in claim 27, wherein said dragging mechanism motion delay circuit comprises a threshold element and an inverter element interconnected in series.

42. A device as recited in claim 39, wherein said dragging mechanism motion delay circuit comprises a threshold element and an inverter element interconnected in series.

43. A device as recited in claim 21, wherein said circuit for accelerating the dragging mechanism speed in bucket unloading comprises a threshold element and an inverter element interconnected in series.

44. A device as recited in claim 27, wherein said circuit for accelerating the dragging mechanism speed in bucket unloading comprises a threshold element and an inverter element interconnected in series.

45. A device as recited in claim 42, wherein said circuit for accelerating the dragging mechanism speed in bucket unloading comprises a threshold element and an inverter element interconnected in series.

46. A device as recited in claim 22, wherein said circuit for determining whether or not the dragging mechanism is maneuvered comprises a threshold element and an inverter element interconnected in series.

47. A device as recited in claim 27, wherein said circuit for determining whether or not the dragging mechanism is maneuvered comprises a threshold element and an inverter element interconnected in series.

48. A device as recited in claim 45, wherein said circuit for determining whether or not the dragging mechanism is maneuvered comprises a threshold element and an inverter element interconnected in series.

49. A device as recited in claim 37, wherein said starting circuit of the dragging mechanism speed setter comprises a delay element means for fixing the minimal speed of the dragging mechanism over the time interval during which the bucket is lifted off the face of said excavation in order to provide for tautness of the drag rope; the input of said delay element connected to the output of said threshold element, and the output of said delay element connected to the input of said logic circuit of the dragging mechanism speed setter.

50. A device as recited in claim 22, wherein said logic circuit of the dragging mechanism speed setter comprises: a source of reference voltage; a first gate having a main input and a plurality of control circuits; said main input of said first gate connected to the output of said reference voltage source; said control circuits of said first gate connected to the output of said bucket transportation time calculator and to the output of said starting circuit of the dragging mechanism speed setter; a second gate having a main input and a plurality of control circuits; said main input of said second gate connected to the output of said reference voltage source; said control circuits of said second gate connected to the output of said starting circuit of the dragging mechanism speed setter and to the output of said dragging mechanism motion delay circuit; a third gate having a main input and a plurality of control circuits; said main input of said third gate connected to the output of said reference voltage source; said control circuits of said third gate connected to the output of said circuit for determining the steady speed of the dragging mechanism, to the output of said dragging mechanism motion delay circuit, and to the output of said circuit for determining the sense of rotation of the dragging mechansim, a fourth gate having a main input and a plurality of control circuits; said main input of said fourth gate connected to the output of said reference voltage source; said control circuits of said fourth gate connected to the output of said circuit for determining the instant at which the dragging mechanism starts decelerating and to the output of said circuit for determining the sense of rotation of the dragging mechanism; a fifth gate having a main input and a plurality of control circuits; said main input of said fifth gate connected to the output of said reference voltage source; said control circuits of said fifth gate connected to the output of said circuit for determining the steady speed of the dragging mechanism, to the output of said circuit for determining the sense of rotation of the dragging emchanism, and to the output of said circuit for determining whether or not the dragging emchanism is maneuvered; a sixth gate having a main input and a plurality of control circuits; said main input of said sixth gate connected to the output of said reference voltage source; said control circuits of said sixth gate connected to the output of said circuit for determining the instant at which the dragging mechanism starts decelerating and to the output of said circuit for determining the sense of rotation of the dragging mechanism; a seventh gate having a main input and a plurality of control circuits; said main gate of said seventh gate connected to the output of said reference voltage source; said control circuits of said seventh gate connected to the output of said circuit for accelerating the dragging mechanism speed in bucket unloading and to the output of said circuit for determining the sense of rotation of the dragging mechanism; an eighth gate having a main input and a plurality of control circuits; said main input of said eighth gate connected to the output of said hoisting mechanism speed transducer; said control circuits of said eighth gate connected to the output of said circuit for determining whether or not the dragging mechanism is maneuvered and to the output of said circuit for determining the sense of rotation of the dragging mechanism.

51. A device as recited in claim 26, wherein said circuit for determining the steady speed of the dragging mechanism comprises: an adder having one input connected to the output of said bucket transportation time signal shaper, the other input of said adder connected to said common point of the diodes of said dragging mechanism predetermined speed signal shaper; a multiplier having two inputs and an output, the first input of said multiplier being connected to the output of said adder; a relay having contacts; the second input of said multiplier coupled via the contacts of said relay to the output of said integrator of the dragging mechanism predetermined speed signal shaper and to the output of said inverter of that same shaper; a threshold element having two inputs and an output; the first input of said threshold element connected to the output of said multiplier; the output of said threshold element connected to the input of said logic circuit of the dragging mechanism speed setter; a commutator having inputs connected to the output of said drag rope length increment transducer as the bucket is transported from the breakout point to the dumping point, to the output of said transducer for sensing the hoist rope length at the dumping point, and to the output of said drag rope length increment transducer as the bucket is transported from the dumping point to the point where it is lowered on the face of said excavation; the output of said commutator connected to the second input of said threshold element; an inverter element connected in series with said threshold element; the output of said inverter element connected to the input of said logic circuit of the dragging mechanism speed setter; said circuit for determining the instant at which the dragging mechanism starts decelerating comprising a squarer having an input connected to said common point of said third and fourth diodes; a second relay having contacts; a threshold element having two inputs; the first input of said threshold element connected to the output of said inverter; the second input of said threshold element coupled via the contacts of said second relay to the output of said drag rope length increment transducer as the bucket is transported from the breakout point to the dumping point and to the output of said drag rope length increment transducer as the bucket is transported from the dumping point to the point where it is lowered on the face of said excavation; the output of said threshold element connected to the input of said logic circuit of the dragging mechanism speed setter; an inverter element connected in series with said threshold element, the output of said inverter element being connected to the input of said logic circuit of the dragging mechanism speed setter; said circuit for determining the sense of rotation of the dragging mechanism comprising a threshold element and an inverter element interconnected in series; said starting circuit of said dragging mechanism speed setter comprising a threshold element and an inverter element interconnected in series; said dragging mechanism motion delay circuit comprising a threshold element and an inverter element interconnected in series; said circuit for accelerating the dragging mechanism speed in bucket unloading comprising a threshold element and an inverter element interconnected in series; said circuit for determining whether or not the dragging mechanism is maneuvered comprising a threshold element and an inverter element interconnected in series; said starting circuit of the dragging mechanism speed setter comprising a delay element which fixes the minimal speed of the dragging mechanism over the time interval during which the bucket is lifted off the face of said excavation in order to provide tautness in the drag rope during the breakout operation; the input of said delay element connected to the output of said threshold element, the output of said delay element being connected to the input of said logic circuit of the dragging mechanism speed setter; said bucket transportation time calculator comprising a starting circuit having an output connected to the input of said logic circuit of the dragging mechanism speed setter.

52. A device as recited in claim 51, wherein said logic circuit of the dragging mechanism speed setter comprises: a source of reference voltage; a first gate having a main input and a plurality of control circuits; said main input of said first gate connected to the output of said reference voltage source; said control circuits of said first gate connected to the output of said starting circuit of the bucket transportation time calculator and to the output of said inverter element of the starting circuit of the dragging mechanism speed setter; a second gate having a main input and a plurality of control circuits; said main input of said second gate connected to the output of said reference voltage source; said control circuits of said second gate connected to the output of said delay element of the starting circuit of the dragging mechanism speed setter and to the output of said threshold element of the dragging mechanism motion delay circuit; a third gate having a main input and a plurality of control circuits; said main input of said third gate connected to the output of said reference voltage source; said control circuits of said third gate connected to the output of said inverter element of the circuit for determining the steady speed of the dragging mechanism, to the output of said inverter element of the dragging mechanism motion delay circuit, and to the output of said threshold element of the circuit for determining the sense of rotation of the dragging mechanism; a fourth gate having a main input and a plurality of control circuits; said main input of said fourth gate connected to the output of said reference voltage source; said control circuits of said hourth gate connected to the output of said inverter element of the circuit for determining the instant at which the dragging mechanism starts decelerating and to the output of said inverter element of the circuit for determining the sense of rotation of the dragging mechanism; a fifth gate having a main input and a plurality of control circuits; said main input of said fifth gate connected to the output of said reference voltage source; said control circuits of said fifth gate connected to the output of said threshold element of the circuit for determining the steady speed of the dragging mechanism, to the output of said threshold element of the circuit for determining the sense of rotation of the dragging mechanism, and to the output of said threshold element of the circuit for determining whether or not the dragging mechanism is maneuvered; a sixth gate having a main input and a plurality of control circuits; said main input of said sixth gate connected to the output of said reference voltage source; said control circuits of said sixth gate connected to the output of said threshold element of the circuit for determining the instant at which the dragging mechanism starts decelerating and to the output of said inverter element of the circuit for determining the sense of rotation of the dragging mechanism; a seventh gate having a main input and a plurality of control circuits; said main input of said seventh gate connected to said reference voltage source; said control circuits of said seventh gate connected to the output of said threshold element of the circuit for accelerating the dragging mechanism speed in bucket unloading and to the output of said threshold element of the circuit for determining the sense of rotation of the dragging mechanism; an eighth gate having a main input and a plurality of control circuits; said main input of said eighth gate connected to the output of said hoisting mechanism speed transducer; said control circuits of said eighth gate connected to the output of said threshold element of the circuit for determining whether or not the dragging mechanism is maneuvered and to the output of said inverter element of the circuit for determining the sense of rotation of the dragging mechanism.

53. A device as recited in claim 26, wherein said dragging mechanism predetermined speed signal shaper comprises a gate circuit and a resistor coupled via said gate circuit into said feedback circuit of the integrator; the control circuits of said gate circuit connected to the output of said circuit for determining the sense of rotation of the dragging mechanism and to the output of said circuit for determining whether or not the dragging mechanism is maneuvered; said resistor including means for preventing a stepwise change of the output signal when said shaper receives at the input thereof a signal proportional to the speed of the hoisting mechanism when the dragging mechanism is maneuvered to prevent slackening of the drag rope as the bucket is transported from the dumping point to the point where it is lowered on the face of said excavation.

54. A device as recited in claim 24, wherein said logic circuit of the hoisting mechanism speed setter has connected thereto the output of said starting circuit of the dragging mechanism speed setter.

55. A device as recited in claim 6, wherein said swinging mechanism speed setter comprises: a circuit for converting the coordinates of the bucket position to the acceleration time of the swinging mechanism, said acceleration time being proportional to the period of swing of the pendulum, and said circuit having a plurality of inputs and outputs; said inputs of the converter circuit connected to the output of said hoist rope overall length transducer, and to the output of said drag rope overall length transducer; a circuit for determining the steady speed of the swinging mechanism, said circuit having a plurality of inputs and outputs; said inputs of said circuit for determining the steady speed of the swinging mechanism connected to said output of the bucket position coordinate converter circuit, to the output of said bucket transportation time calculator, to the output of said platform swing angle transducer as the bucket is transported from the breakout point to the dumping point, and to the output of said platform swing angle transducer as the bucket is transported from the dumping point to the point where it is lowered on the face of said excavation; a circuit for determining the value of the starting acceleration of the swinging mechanism having inputs connected to the output of said bucket position coordinate converter circuit and to the output of said circuit for determining the steady speed of the swinging mechanism; a circuit for determining the instant at which the swinging mechanism starts decelerating having inputs connected to the output of said platform swing angle transducer as the bucket is transported from the breakout point to the dumping point, to the output of said platform swing angle transducer as the bucket is transported from the dumping point to the point where it is lowered on the face of said excavation, to the output of said transducer for sensing the bucket angular deflection in a horizontal plane, and to the output of said bucket transportation time calculator; a swing mechanism predetermined speed signal shaper having inputs coupled to the output of said circuit for determining the steady speed of the swinging mechanism, to the output of said platform speed transducer, and to the output of said circuit for determining the value of the starting acceleration of the swinging mechanism; a circuit for determining the sense of rotation of the swinging mechanism having an input connected to the output of said swinging mechanims predetermined speed signal shaper.

56. A device as recited in claim 9, wherein said swinging mechanism speed setter comprises: a circuit for converting the bucket position coordinates to the time of acceleration of the swinging mechanism, said acceleration time being proportional to the period of swing of the pendulum, said converter circuit having a plurality of inputs and outputs; said inputs of the converter circuit connected to the output of said hoist rope overall length transducer and to the output of said drag rope overall length transducer; a circuit for determining the steady speed of the swinging mechanism and having a plurality of inputs and outputs; said inputs connected to said output of the bucket position coordinate converter circuit, to the output of said bucket transportation time calculator, to the output of said platform swing angle transducer as the bucket is transported from the breakout point to the dumping point, and to the output of said platform swing angle transducer as the bucket is transported from the dumping point to the point where it is lowered on the face of said excavation; a circuit for determining the value of the starting acceleration of the swinging mechanism having inputs connected to the output of said bucket position coordinate converter circuit and to the output of said circuit for determining the steady speed of the swinging mechanism; a circuit for determining the instant at which the swinging mechanism starts decelerating having inputs connected to the output of said platform swing angle transducer as the bucket is transported from the breakout point to the dumping point, to the output of said platform swing angle transducer as the bucket is transported from the dumping point to the point where it is lowered on the face of said excavation, to the output of said transducer for sensing the bucket angular deflection in a horizontal plane, and to the output of said bucket transportation time calculator; a swinging mechanism predetermined speed signal shaper having inputs connected to the output of said circuit for determining the steady speed of the swinging mechanism, to the output of said platform speed transducer, and to the output of said circuit for determining the value of the starting acceleration of the swinging mechanism; a circuit for determining the sense of rotation of the swinging mechanism having an input connected to the output of said swinging mechanism predetermined speed signal shaper.

57. A device as recited in claim 21, wherein said swinging mechanism speed setter comprises: a circuit for converting the coordinates of the bucket position to the acceleration time of the swinging mechanism, said acceleration time being proportional to the period of swing of the pendulum, said converter circuit having a plurality of inputs and outputs; said inputs of said converter circuit connected to the output of said hoist rope overall length transducer and to the output of said drag rope overall length transducer; a circuit for determining the steady speed of the swinging mechanism having a plurality of inputs and outputs; said inputs connected to said output of the bucket position coordinate converter circuit, to the output of said bucket transportation time calculator, to the output of said platform swing angle transducer as the bucket is transported from the breakout point to the dumping point, and to the output of said platform swing angle transducer as the bucket is transported from the dumping point to the point where it is lowered on the face of said excavation; a circuit for determining the value of the starting acceleration of the swinging mechanism having inputs connected to the output of said bucket position coordinate converter circuit and to the output of said circuit for determining the steady speed of the swinging mechanism; a circuit for determining the instant at which the swinging mechanism starts decelerating having inputs connected to the output of said platform swing angle transducer as the bucket is transported from the breakout point to the dumping point, to the output of said platform swing angle transducer as the bucket is transported from the dumping point to the point where it is lowered on the face of said excavation, to the output of said transducer for sensing the bucket angular deflection in a horizontal plane, and to the output of said bucket transportation time calculator; a swinging mechanism predetermined speed signal shaper having inputs connected to the output of said circuit for determining the steady speed of the swinging mechanism, to the output of said platform speed transducer, and to the output of said circuit for determining the value of the starting acceleration of the swinging mechanism; a circuit for determining the sense of rotation of the swinging mechanism having an input connected to the output of said swinging mechanism predetermined speed signal shaper.

58. A device as recited in claim 55, wherein said circuit for determining the steady speed of the swinging mechanism comprises: an adder having inputs connected to the output of said circuit for converting the bucket position coordinates to the swinging mechanism acceleration time proportional to the period of swing of the pendulum and to the output of said bucket transportation time calculator; a first divider having inputs connected to the output of said adder, to the output of said platform swing angle transducer as the bucket is transported from the breakout point to the dumping point, and to the output of said platform swing angle transducer as the bucket is transported from the dumping point to the point where it is lowered on the face of said excavation; a first memory element having an input connected to the output of said first divider; a second memory element having an input connected to the output of said first memory element; a threshold element having inputs connected to the output of said first memory element and to the output of said swinging mechanism predetermined speed signal shaper; an output relay having a control winding; said control winding of the output relay connected to the output circuit of said threshold element.

59. A device as recited in claim 57, wherein said circuit for determining the steady speed of the swinging mechanism comprises: an adder having inputs connected to the output of said circuit for converting the bucket position coordinates to the swinging mechanism acceleration time proportional to the period of swing of the pendulum and to the output of said bucket transportation time calculator; a first divider having inputs connected to the output of said adder, to the output of said platform swing angle transducer as the bucket is transported from the breakout point to the dumping point, and to the output of said platform swing angle transducer as the bucket is transported from the dumping point to the point where it is lowered on the face of said excavation; a first memory element having an input connected to the output of said first divider; a second memory element having an input connected to the output of said first memory element; a threshold element having inputs connected to the output of said first memory element and to the output of said swinging mechanism predetermined speed signal shaper; an output relay having a control winding; said output relay control winding connected into the output circuit of said threshold element.

60. A device as recited in claim 55, wherein said circuit for determining the value of the swinging mechanism starting acceleration comprises: a third memory element having an input connected to the output of said bucket position coordinate converter; a second divider having inputs connected to the output of said first memory element and to the output of said third memory element; the output of said second divider connected to the input of said swinging mechanism predetermined speed signal shaper.

61. A device as recited in claim 59, wherein said circuit for determining the value of the swinging mechanism starting acceleration comprises: a third memory element having an input connected to the output of said bucket position coordinate converter; a second divider having inputs connected to the output of said first memory element and to the output of said third memory element; the output of said second divider connected to the input of said swinging mechanism predetermined speed signal shaper.

62. A device as recited in claim 55, wherein said circuit for determining the instant at which the swinging mechanism starts decelerating comprises: an adder having inputs connected to the output of said platform swing angle transducer as the bucket is transported from the breakout point to the dumping point, to the output of said platform swing angle transducer as the bucket is transported from the dumping point to the point where it is lowered on the face of said excavation, and to the output of said transducer for sensing the bucket angular deflection in a horizontal plane; a differentiator having inputs connected to the output of said adder; a multiplier having inputs connected to the output of said bucket transportation time calculator and to the output of said differentiator; a threshold element said multiplier and to the output of said adder; an output relay having a control winding; said control winding being coupled into the output circuit of said threshold element of the circuit for determining the instant at which the swinging mechanism starts decelerating.

63. A device as recited in claim 61, wherein said circuit for determining the instant at which the swinging mechanism starts decelerating comprises: an adder having inputs connected to the output of said platform swing angle transducer as the bucket is transported from the breakout point to the dumping point, to the output of said platform swing angle transducer as the bucket is transported from the dumping point to the point where it is lowered on the face of said excavation, and to the output of said transducer for sensing the bucket angular deflection in a horizontal plane; a differentiator having inputs connected to the output of said adder; a multiplier having inputs connected to the output of said bucket transportation time calculator and to the output of said differentiator; a threshold element having inputs connected to the output of said multiplier and to the output of said adder; an output relay having a control winding; said control winding connected to the output circuit of said threshold element of the circuit for determining the instant at which the swinging mechanism starts decelerating.

64. A device as recited in claim 55, wherein said swinging mechanism predetermined speed signal shaper comprises: an integrator having two main inputs, an initial conditions setting circuit, a feedback circuit and an output; the input of said initial conditions setting circuit connected to the output of said swinging mechanism speed transducer, said first main input being connected to the output of said circuit for determining the steady speed of the swinging mechanism; said second main input connected to the output of said circuit for determining the value of the swinging mechanism starting acceleration; an inverter connected in series with said integrator; the output of said inverter connected to the input of said circuit for determining the sense of rotation of the swinging mechanism.

65. A device as recited in claim 63, wherein said swinging mechanism predetermined speed signal shaper comprises: an integrator having two main inputs, an initial conditions setting circuit; a feedback circuit and an output; said initial conditions setting circuit having coupled to an input thereof the output of said swinging mechanism speed transducer; contacts of said output relay of the circuit for determining the instant at which the swinging mechanism starts decelerating; said first main input of the integrator coupled to the output of said second memory element via said contacts of the output relay of the circuit for determining the instant at which the swinging mechanism starts decelerating; contacts of said output relay of the circuit for determining the steady speed of the slewing mechanism; said second main input coupled to the output of said second divider via said contacts of the output relay of the circuit for determining the steady speed of the swinging mechanism; an inverter having an input connected to the output of said integrator and an output connected to the input of said circuit for determining the sense of rotation of the swinging mechanism.

66. A device as recited in claim 57, wherein said swinging mechanism speed setter comprises: a function selector of the dragline excavator; a relay with contacts being controlled by said function selector; a swinging mechanism start-up delay circuit for the operation of the dragline excavator in a 360° mode, inputs of said delay circuit being coupled to the output of said bucket transportation time signal shaper, and to the output of said third adder of the bucket transportation time calculator; a starting relay having a control winding and contacts; said control winding of the starting relay via said contacts of the relay controlled by the function selector being coupled to the output of said swinging mechanism start-up delay circuit and to the output of the starting circuit of the dragging mechanism speed setter.

67. A device as recited in claim 25, wherein said swinging mechanism speed setter comprises: a function selector of the dragline excavator; a relay with contacts controlled by said function selector; a swinging mechanism start-up delay circuit for the operation of the dragline excavator in a 360° mode, inputs of said delay circuit being connected to the output of said bucket transportation time shaper and to the output of said third adder of the bucket transportation time calculator; a starting relay with a control winding and contacts; said control winding of the starting relay via said contacts of the function selector-controlled relay being coupled to the output of said swinging mechanism start-up delay circuit and to the output of the starting circuit of the dragging mechanism speed setter.

68. A device as recited in claim 65, wherein said swinging mechanism speed setter comprises: a function selector of the dragline excavator; a relay with contacts controlled by said function selector; a swinging mechanism start-up delay circuit for the operation of the dragline excavator in a 360° mode, inputs of said delay circuit being connected to the output of said bucket transportation time signal shaper and to the output of said third adder of the bucket transportation time calculator; a starting relay with a control winding and contacts; said control winding via said contacts of the function selector-controlled relay being coupled to the output of said swinging mechanism start-up delay circuit and to the output of the starting circuit of the dragging mechanism speed setter; said contact of the starting relay connected to the circuit for connecting the output of said second divider with the input of said integrator of the swinging mechanism predetermined speed signal shaper.

69. A device as recited in claim 65, wherein said circuit for determining the sense of rotation of the swinging mechanism comprises a threshold element and an inverter element interconnected in series.

70. A device as recited in claim 67, wherein said circuit for determining the sense of rotation of the swinging mechanism comprises a threshold element and an inverter element interconnected in series.

71. A device as recited in claim 69, wherein said swinging mechanism speed setter comprises a switch of the initial sense of rotation of the platform and a relay having contacts; a winding of said relay coupled via said switch of the initial sense of rotation to the output of said threshold element of the circuit for determining the sense of rotation of the swinging mechanism and to the output of the inverter element of the circuit for determining the sense of rotation of the swinging mechanism; the contacts of said relay coupled to the circuit for connecting the output of the swinging mechanism speed setter with the input of the integrator of the swinging mechanism predetermined speed signal shaper and with the output of the inverter of said shaper.

72. A device as recited in claim 55, wherein the output of said circuit for converting the bucket position coordinates to the swinging mechanism acceleration time proportional to the period of swing of the pendulum is connected to the input of said third adder of the bucket transportation time calculator.

73. A device as recited in claim 70, wherein said control circuit of the third gate of said logic circuit of the hoisting mechanism speed setter is coupled via said dragline excavator function selector to the circuit for determining the sense of rotation of the swinging mechanism.

74. A device as recited in claim 2, wherein said hoist rope tension setting circuit comprises: a digging path transducer connected to said bucket dragging mechanism; a hoist rope initial tension setter; a hoist rope final tension setter; a first adder having inputs connected to the output of said hoist rope initial tension setter and to the output of said hoist rope final tension setter; a digging path setter having an input connected to the output of said first adder; a multiplier having inputs connected to the output of said digging path setter and to the output of said digging path transducer; a second adder having inputs connected to the output of said multiplier and to the output of said hoist rope initial tension setter, the output of said second adder being connected to the input of said hoist rope tension controller.

75. A device as recited in claim 5, wherein said first protection unit of the dragging mechanism program speed setting comprises a cam mechanism; a potentiometer coupled to said mechanical adder, the slider of said potentiometer being coupled to said cam mechanism, and an adder having three inputs and an output, one input of said adder being connected to the output of said potentiometer, the second input being connected to the output of said gate, the third input being connected to the output of said reference voltage source, the output of said adder being connected to the second input of said first OR circuit.

* * * * *